United States Patent [19]

Ehrat

[11] 3,959,592

[45] May 25, 1976

[54] METHOD AND APPARATUS FOR TRANSMITTING AND RECEIVING ELECTRICAL SPEECH SIGNALS TRANSMITTED IN CIPHERED OR CODED FORM

[75] Inventor: Kurt Ehrat, Zurich, Switzerland

[73] Assignee: Gretag Aktiengesellschaft, Regensdorf, Switzerland

[22] Filed: Dec. 17, 1973

[21] Appl. No.: 425,608

[30] Foreign Application Priority Data

Dec. 21, 1972 Switzerland ..... 18628/72

[52] U.S. Cl. ..... 179/1.5 E; 179/1.5 R

[51] Int. Cl.[2] ..... H04K 1/04

[58] Field of Search ..... 179/1.5 R, 1.5 E

[56] References Cited

UNITED STATES PATENTS

| | | | |
|---|---|---|---|
| 2,627,541 | 2/1953 | Miller | 179/1.5 E |
| 2,640,880 | 6/1953 | Aigrain et al. | 179/1.5 E |
| 2,672,512 | 3/1954 | Mathes | 179/1.5 E |
| 3,504,286 | 3/1970 | Jacobaeus | 179/1.5 R |

*Primary Examiner*—Malcolm F. Hubler
*Assistant Examiner*—H. A. Birmiel
*Attorney, Agent, or Firm*—Werner W. Kleeman

[57] ABSTRACT

A method of, and apparatus for, transmitting and receiving electrical speech signals transmitted in ciphered form, wherein at the transmitter end there are formed in sections or intervals from the speech signals to be transmitted, by frequency analysis, signal components or parameter signals containing frequency spectrum-, voiced/voiceless information- and fundamental sound pitch coefficients, these signal components are ciphered, the ciphered signal components or parameter signals are transformed into a transmission signal and this transmission signal is transmitted over a transmission channel, and at the receiver end there is reobtained from the transmission signal the ciphered signal components or parameter signals and deciphered, and from the thus-obtained deciphered signal components or parameter signals there is generated by synthesis a speech signal which is similar to the original speech signal. According to the invention there is employed at the transmitter end for the synthesis of the transmission signal harmonic frequencies of a common fundamental frequency with constant fundamental period at least for each signal section or signal interval, the amplitudes of the individual harmonic frequencies are determined by means of the ciphered signal components or parameter signals, and from the received transmission signal by frequency analysis over at least a respective one full fundamental period there is reobtained the fundamental frequency of the ciphered parameter signals or signal components in intervals or sections. Further, for the receiver end synthesis of the speech which is similar to the original speech signal there are employed harmonic frequencies of a common fundamental frequency and such frequencies are individually modulated by the deciphered parameters signals or signal components, and the transmitter end-frequency analysis of the speech signal and the receiver end-frequency analysis of the transmission signal is carrier out by means of individually accessible harmonic frequencies of a respective common fundamental frequency.

35 Claims, 54 Drawing Figures

FROM 134
135
143
MULTIPLIER
95
MSY
151
160
133
FROM 25
MPZ
167
159
150
MC N
149
122
FROM 123
MC 2
148
130
TO 31
MC 1
147
121
SUMMATION ELEMENT
MG
146
MS
145
95
MR
144
127
129
125
FROM 110,111 und 112

An (t)
Bn (t)
Bn
An
0
t
$T_G$

TA
TA
AP1
AP2
AP3
AP4
a
t

TS
b
TG
t c
t

TL
d
t e
t
L
0
0
L
0
L
L f
t g
t

SH 0
SH 1
SH 2
SH 3
a
b
c
d
e
f
t
t1
t2
t3
t4
t21
t22
t31
t32
t21'
t22'
t31'
t32'
t21"
t22"
t31"
t32"
At1
At2
At3
ΔAz,3
ΔA2,3
8
TA
tH
-TA/4
+TA/4

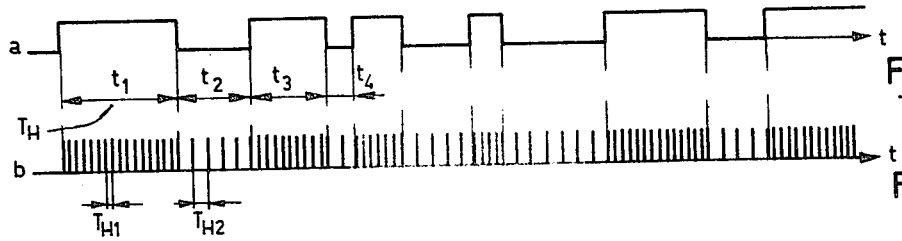
FIG.16A
FIG.16B
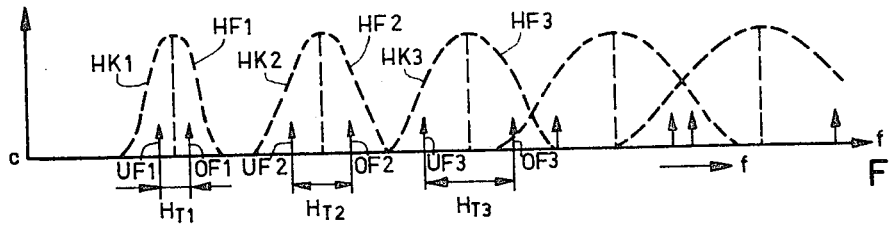
FIG.16C
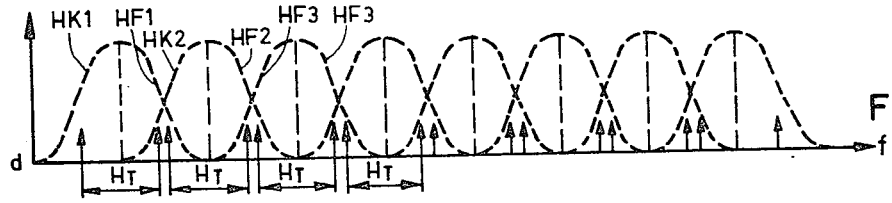
FIG.16D
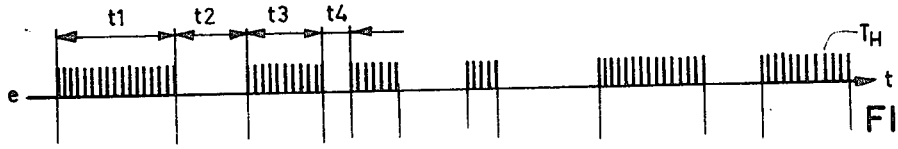
FIG.16E
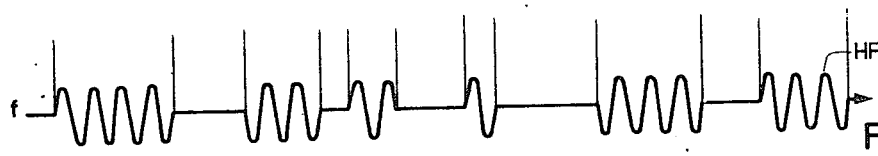
FIG.16F
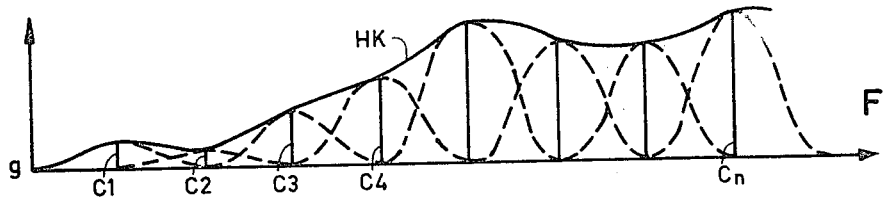
FIG.16G FIG. 19
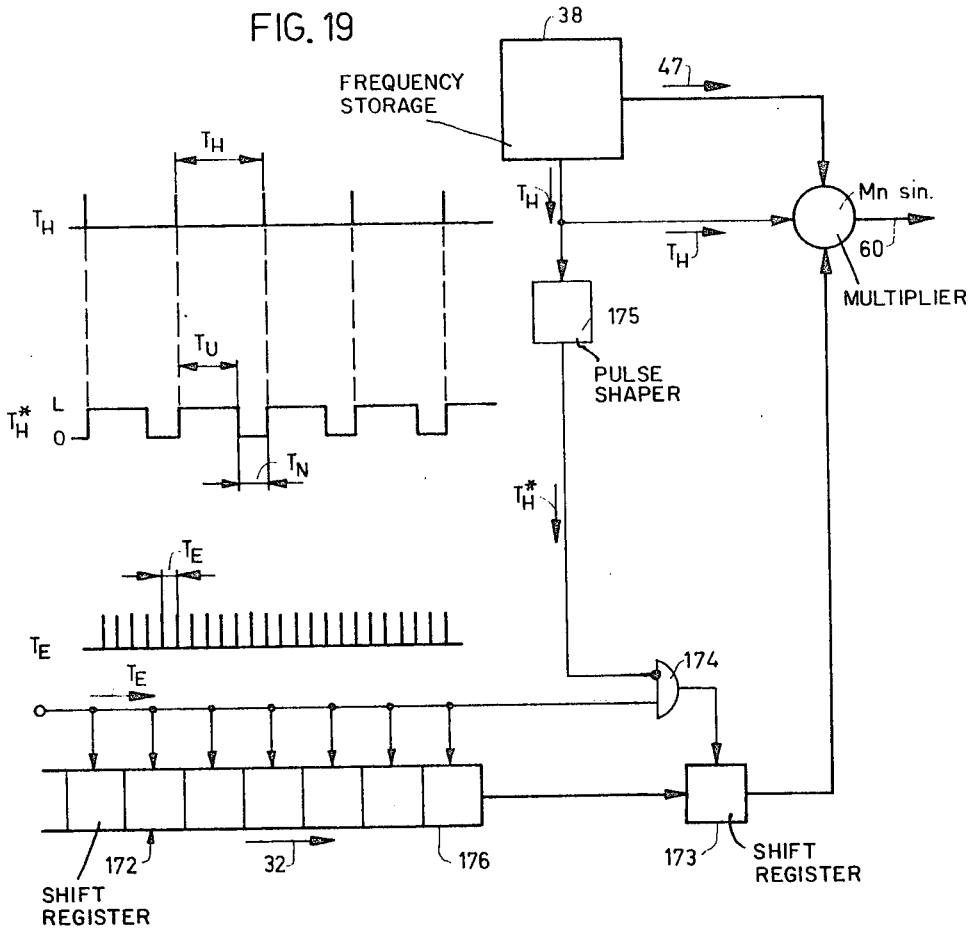
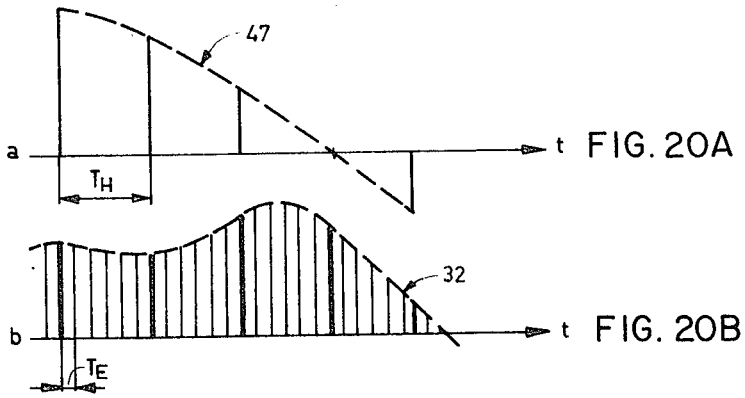
FIG. 20A
FIG. 20B

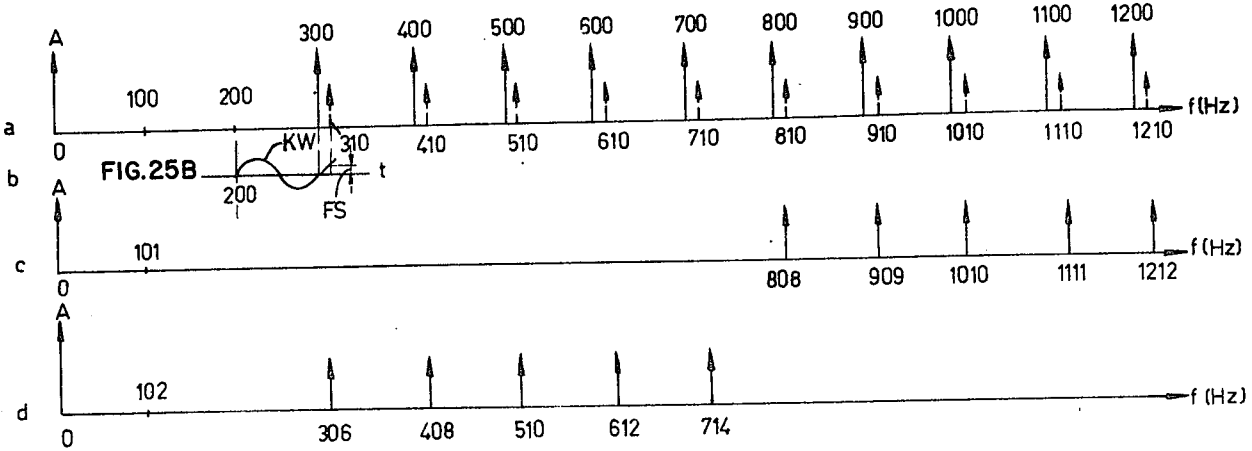
FIG. 25A
FIG. 25C
FIG. 25D
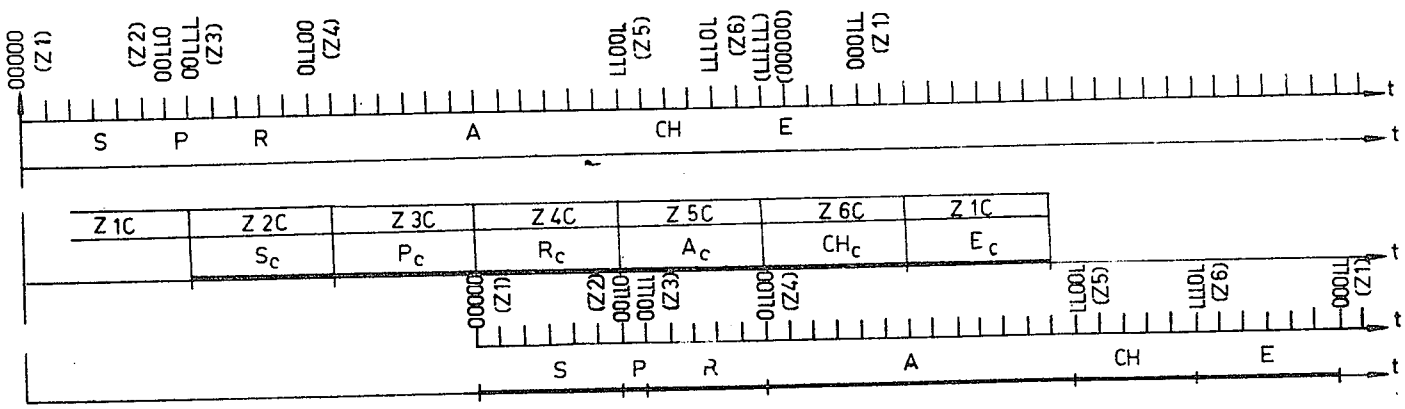
FIG. 26A
FIG. 26B
FIG. 26C

METHOD AND APPARATUS FOR TRANSMITTING AND RECEIVING ELECTRICAL SPEECH SIGNALS TRANSMITTED IN CIPHERED OR CODED FORM

BACKGROUND OF THE INVENTION

The present invention relates to a new and improved method of transmitting and receiving electrical speech or voice signals which are transmitted in ciphered or coded form, wherein at the transmitter side or part there are formed from the speech signal to be transmitted, by frequency analysis, signal components or parameter signals which, in intervals or sections, contain frequency spectrum coefficients, voiced/unvoiced information coefficients and fundamental sound pitch coefficients, these parameter signals are coded or enciphered, the coded parameter signals are transformed into a transmission signal and the latter is transmitted via a transmission channel, and further, wherein at the receiver side or part there is again obtained from the received transmitted signal the coded parameter signals and such are decoded or deciphered, and from the thus obtained decoded parameter signals there is produced by synthesis a speech signal similar to the original speech signal.

In heretofore known systems the coded signal components or parameter signals are transformed by means of a modulator device into a transmission signal which can be transmitted via a voice channel. This transmission signal consists of frequency modulated, phase modulated or otherwise modulated, sequentially transmitted pulses, the transmission rate amounting to, for instance, 1200, 2400 or 4800 bits/sec.

At the receiver end the received transmission signal, with the heretofore known installations, is demodulated by a demodulator device in order to again obtain the coded signal components or parameter signals.

A state-of-the-art installation which functions in accordance with the above-described technique is the so-called "Vocoder". This installation comprises a signal analysis device equipped with a multiplicity of band filters, this system serving to obtain the frequency spectrum coefficients. From the low frequency portions there is determined in a fundamental sound pitch detector the fundamental sound pitch coefficient of voiced sounds and from the energy relationship between the high and low frequencies there is determined at the voice detector the voiced/unvoiced information coefficient. In the signal synthesis device there is likewise present a multiplicity of band filters, the passband damping of which can be modulated by the frequency spectrum coefficients. At the output of such band filters there is obtained the synthesized speech when there is introduced at the input of the signal synthesis device for voiced sounds spike pulses in cycle with the fundamental sound pitch and for voiceless sounds a noise signal.

There are also known physical manifestations of such installations which possess, instead of the band filters, active filters, digital filters or transmission networks which can be modulated.

The heretofore known systems are associated with different drawbacks. For the conversion of the coded signal components or parameter signals appearing in the transmission signal they require the above-mentioned modulation-and demodulation devices, so-called MODEM units and additionally for the operation of such devices also parallel/series converters and series/parallel converters. Hence, there is required a considerable expenditure in such devices and converters.

The high rate of the series infed information during the transmission of, for instance, 4800 bits/sec. requires short pulse lengths of about 0.2 ms, rendering the transmission difficult at narrow band transmission channels. Due to the short pulse length there is increased the difficulty of attaining the synchronization which is important during ciphering. A further drawback of the heretofore known installations is the faulty quality of the speech or voice produced by synthesis, and such is attributable to the imperfect construction of the signal synthesis device. Finally, the known installations are relatively complicated in construction and design and are not readily suitable for realizing a uniform construction with highly integrated, digital circuit components, and moreover saving of circuit components through the use of sequential operating steps is only possible to a limited extent.

SUMMARY OF THE INVENTION

Hence, it is a primary object of the present invention to provide an improved method of, and apparatus for, overcoming the above drawbacks which are present in the state-of-the-art systems and techniques.

Now in order to implement this and still further objects of the invention, which will become more readily apparent as the description proceeds, the method aspects of this development are manifested by the features that for the synthesis of the transmission signal at the transmitter end there are employed harmonic frequencies of a common fundamental frequency having constant fundamental period at least for each signal interval, that the amplitudes of the individual harmonic frequencies are determined by the coded parameter signals, that from the received transmission signal there is reobtained in intervals, by frequency analysis, over at least a respective full fundamental period, the fundamental frequency of the ciphered parameter signals, that for the receiver end-synthesis of the speech signal similar to the original speech signal there are employed harmonic frequencies of a common fundamental frequency and such frequencies are individually modulated by the deciphered parameter signals, and the transmitter end-frequency analysis of the speech signal and the receiver end-frequency analysis of the transmitted signal occurs by means of individually accessible harmonic frequencies of a respective common fundamental frequency.

As indicated above, the invention is not only concerned with the aforementioned method aspects, but also pertains to an installation for transmitting and receiving electrical speech signals which are transmitted in a coded or ciphered form, and the installation of this development for the practice of the method aspects is manifested by the features that there is provided a signal analysis device or analyzer for deriving at the receiver end the paramenter signals by frequency analysis of the speech or voice signal to be transmitted, a cipher-decipher device for ciphering and/or deciphering the parameter signals, a first device for the transmitter end-conversion of the ciphered parameter signals into the transmission signal. Further there is provided a second device for again obtaining at the receiver end the ciphered parameter signals from the received transmission signal, and a synthesis device or arrangement for forming at the receiver end a speech or voice signal similar to the original speech or voice signal from the reobtained parameter signals. According to the invention, the first device is constituted by a signal synthesis device which embodies a frequency store or storage for producing individually modulatable harmonic frequencies with a common fundamental frequency. The second device is constituted by a signal analysis device or analyzer which embodies a frequency store or storage for generating individually deliverable harmonic frequencies with a common fundamental frequency, wherein the individual frequencies each can be delivered in a respective phase position which can be characterized as sine harmonic and a phase position shifted by 90° which can be characterized as cosine harmonic.

A particularly advantageous construction embodiment of the installation is manifested by the features that there are provided switching or reversing elements for switching the installation from the transmitting mode to the receiving mode and vice versa, wherein the signal synthesis device, which when operating in the transmitting mode serves to generate the transmission signal composed of harmonic frequencies, when operating in the receiving mode can be employed to form a speech or voice signal from the deciphered parameter signals and which speech signal is at least similar to the original speech signal. Further, the analysis device, which in the receiving mode serves to obtain the ciphered parameter signals from the received transmission signal, can be employed in the transmitting mode for deriving the parameter signals from the speech or voice signal which is to be transmitted.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 14, which embodies

FIG. 16, which embodies FIGS. 16A to 16G, is a graphic illustration of signals in a time- and frequency range as such appear in the apparatus depicted in FIG. 15;

FIG. 19 is a schematically illustrated apparatus for multiplying two digital signals with different clock frequencies;

FIG. 20, encompassing FIGS. 20A and 20B, graphically illustrates the signals intended to be processed in the apparatus of FIG. 19;

FIG. 25, encompassing FIGS. 25A to 25D, illustrates a frequency plan for explaining the carrier drift compensation; and FIG. 26, encompassing FIGS. 26A to 26C, illustrates diagrams for explaining an installation with variable voice signal section boundaries.

DETAILED DESCRIPTION OF THE PREFERRED EMBODIMENTS

Figure 1:
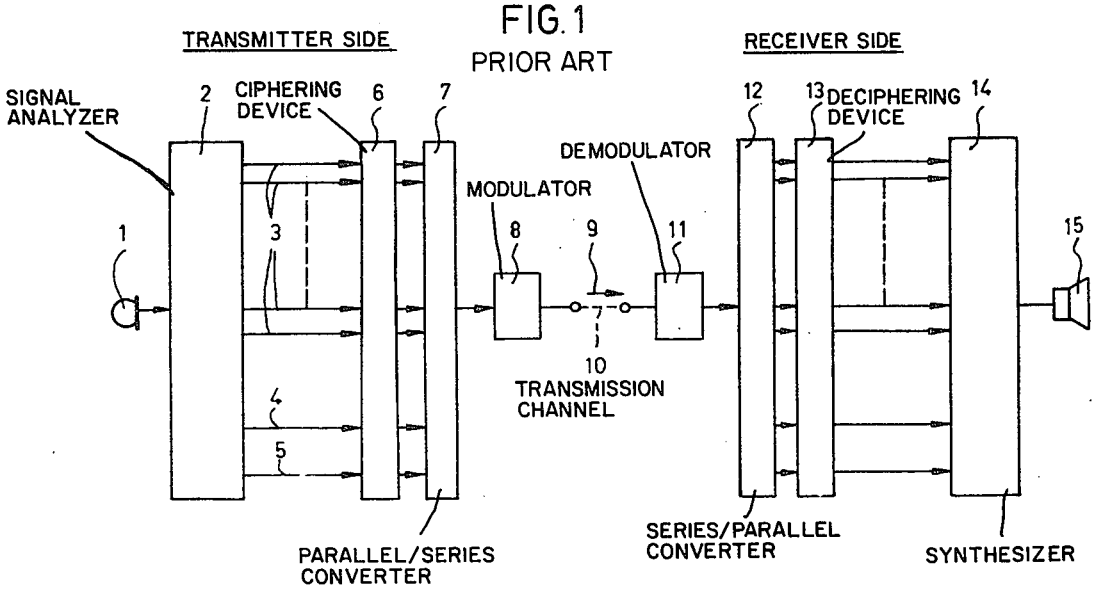
FIG. 1 PRIOR ART
FIG. 1 is a schematic block diagram of a prior art installation for ciphering, transmission and deciphering of voice or speech signals.

Describing now the drawings, in FIG. 1 there is depicted a prior art installation for transmitting and receiving electrical speech or voice signals which are transmitted in a coded or ciphered form. This installation possesses a voice ciphering device or coder at the side of the transmitter shown at the left-hand portion of FIG. 1 and which is electrically coupled through the agency of a transmission channel 10 with a voice deciphering device or decoder arranged at the receiver side of the installation. The analog or speech signals generated by a microphone 1 into which there is spoken arrives at a signal analysis device or analyzer 2 which through the agency of a number of parallel lines or conductors 3, 4 and 5 delivers the signal components or parameter signals which are derived thereat in the frequency range to a ciphering device or coder 6. These parameter signals are composed of a number of frequency spectrum coefficients, a fundamental sound pitch coefficient and a voice/unvoiced information coefficient, also referred to as voice/voiceless information coefficient.

The parameter signals are coded in the ciphering device 6 and in a parallel/series converter 7 are converted into sequential information or intelligence which is modulated by means of a modulation device or modulator 8 and transmitted in the form of a transmission signal 9 via a transmission or speech channel 10 to a deciphering device or decoder arranged at the side of the receiver.

At the receiver end the transmission signal is demodulated in a demodulation device or demodulator 11 and with the aid of a series/parallel converter 12 is transformed into the parallel information of the different ciphered parameter signals. The parameter signals deciphered in a deciphering device 13 are delivered to a signal synthesis device or synthesizer 14 and the synthesized voice signals generated in such signal synthesis device arrive at the earphones or loudspeaker 15.

To transmit in the other direction, there is again required a further installation of the type shown in FIG. 1, and specifically for two-way or duplex communications as well as for simplex operations.

Figure 2:
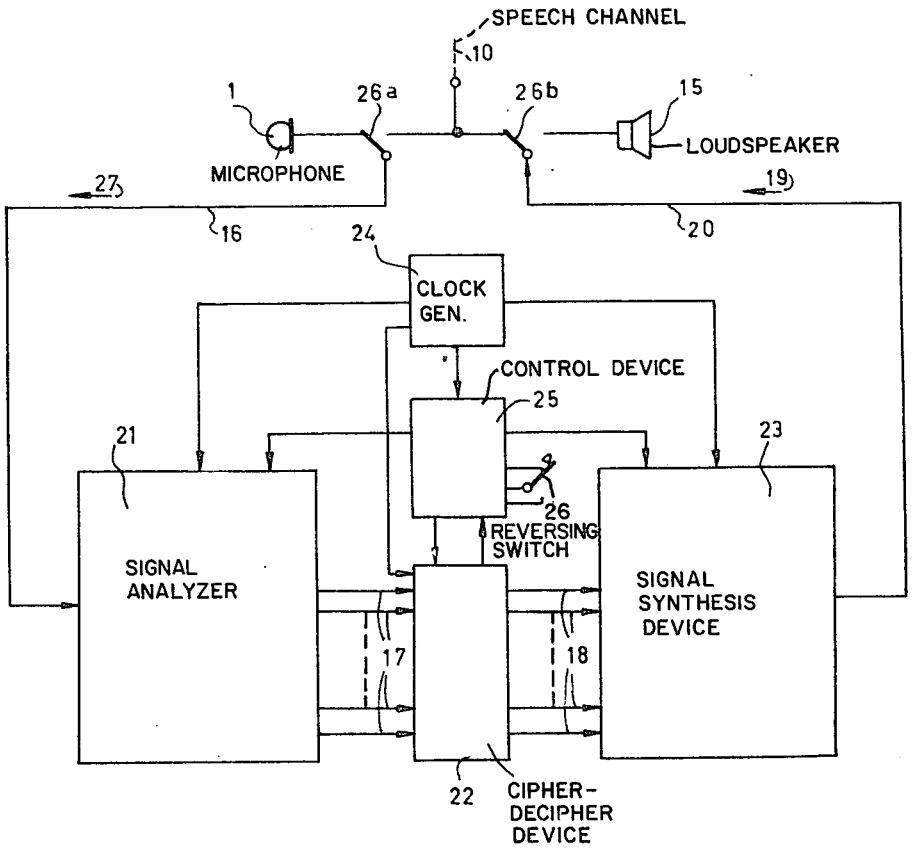
FIG. 2 is a simplified schematic block diagram of an exemplary embodiment of installation designed according to the teachings of the invention.

Now in FIG. 2 there has been shown a simplified block diagram of an installation designed according to the invention. In contrast to the prior art installation depicted in FIG. 1, with the equipment shown in FIG. 2, the same devices serve both for the transmitting mode as well as also for the receiving mode. The most important connection lines or conductors in this block circuit diagram have been marked with appropriate reference characters. The signals or information appearing at such lines have been designated by arrows provided with reference characters adjacent to the corresponding lines. The arrows denote the direction of flow of the signals or information.

The installation or system portrayed in FIG. 2 will be understood to encompass a signal analysis device or analyzer 21, a cipher-decipher device 22, a signal synthesis device or arrangement 23, a clock generator 24 and a control device 25. With the aid of a reversing switch 26, the installation can be selectively shifted from the transmitting mode to the receiving mode or vice versa. This reversing switch 26 is provided with the reversing switch contacts 26*a*, 26*b*. The system shown in FIG. 2 has been illustrated in its transmitting mode, and which mode of operation will be explained more fully hereinafter. The electrical analog voice or speech signals 27 generated at the microphone 1, and corresponding to the spoken sound or speech, arrive via the reversing contact 26*a* through a line or conductor 16 at the signal analyzer or analysis device 21. In this device controlled by the clock generator 24 and the control device 25, the analog speech signals are analyzed either in an analog or digital manner and the derived parameter signals are delivered via a number of conductors or lines 17 to the cipher-decipher device 22. The ciphered or coded signal components arrive through the agency of parallel lines 18 at the signal synthesis device 23 which, with the aid of the ciphered signal components, produces a synthesized analog transmission signal 19 which arrives through the agency of a conductor or line 20 and the reversing contact 26b at the voice or speech channel 10. In the receiving mode the reversing switch means 26a, 26b are shifted into the other position. The transmission signal appearing at the line 10 arrives as an input signal 27 at the signal analysis device 21, where by means of frequency analysis the ciphered parameter signals are determined or derived and transmitted for deciphering via the lines 17 to the cipher-decipher device 22. The deciphered or decoded parameter signals arrive via the lines 18 at the signal synthesis device 23 where there is produced the synthesized voice or speech and is delivered via the conductor 19, the thrown contact 26*b*, to the loudspeaker 15.

A decisive advantage of the system depicted in FIG. 2 is that there are not necessary any additional modulation- or demodulation devices. The signal analysis device of the transmitting station of the installation, for instance that shown in FIG. 2, and the signal analysis device of the receiving station, not depicted in FIG. 2, as well as both of the signal synthesis devices of these two stations are identical, resulting in considerable reduction in the fabrication costs of such installation.

With regard to FIG. 3 there will hereinafter be more fully described the digital mode of operation of the installation depicted in this Figure. The signal analyzer or signal analysis device 21 possesses an analog-digital converter 28 which transforms the analog speech signals 27 generated by the microphone 1 into digital speech signals 29. For this purpose the analog speech signals 27 in the analog-digital converter 28 are periodically sampled with a clock frequency delivered by the clock generator 24 and the sampled amplitude values appear as a sequence of binary numbers, the numerical values of which correspond to the amplitude values. These binary numbers are particularly suitable for the further processing by digital electronic switching means and specifically both for storage as well as also for transmission and logical operations. The binary numbers can be represented by the two intelligence or information bits "0" and "1".

The clock frequency delivered to the analog-digital converter 28 can amount to for instance $10^4$ Hz and the binary numbers can possess a digit or place number of 10 to 12 for a signal resolution of 1 – 0.25 per mil, so that it is possible to determine the entire dynamic content of the speech.

The binary coded digital voice or speech signal 29 is delivered to a compressor 30. Such is switchable to the operating mode transmitting or receiving via a control input S2 by means of the control device 25. The installation of FIG. 3 has been shown in the transmitting mode. It is the function of the compressor 30 to reduce the dynamic content of the voice signal during the transmitting mode of operation, in order to simplify the construction of the cipher-decipher device 22. Instead of the 10–12 place binary numbers delivered to the compressor 30 there appear at its output only 6–7 place binary numbers.

The digital voice or speech signal is divided by means of the control device 25 into signal intervals or sections of, for instance, 25 or 30 ms length and, in each instance, one such signal interval or increment is stored in a short-time storage or store 31 in a manner to be described more fully hereinafter. If the clock frequency, which is delivered to the analog-digital converter 28, amounts to $10^4$ Hz, then for each signal interval there must be stored in the short-time storage 31 in the form of binary numbers 250 sampling values. The highest occurring place value of the binary numbers of the signal interval, in which the binary number 1 occurs for instance more than four times, is then considered as important for the regulation and this place value is shifted, by shifting of the decimal point through a number of binary places which are the same for all binary numbers of the signal interval, to the regulation place value. The decimal point shifting number is the regulation value of a signal interval. The same regulation place value is preferably used for all signal intervals. In a binary number system, for instance displacement of shifting of the decimal point by one place to the right corresponds to a multiplication by the factor 2, by two places to the right to a multiplication by the factor 4, and by three places to the right to a multiplication with the factor 8, and shifting of the decimal point by one place to the left corresponds to a division by the number 2, by two places to the left to a division by the number 4, and by three places to the left to a division by the number 8. This simple type of arithmetic permits regulating the digital voice signal in discrete stages of the factor 2 in a simple manner by decimal point shifting the binary numbers of a signal interval. The factor 2 approximately corresponds to a peak shifting or variation of the dynamics of the voice signal by 6 dB, with 0–5 decimal point displacements, i.e. with regulation values between 0 and 5 it is possible to undertake regulation or compression of the dynamics by 0, 6, 12, 18, 24 or 30 dB.

The regulation values 100 derived at the compressor 30 are determined for each signal interval and arrive via a gate 90, a conductor or line 99, a gate 103, a conductor or line 106 at the cipher-decipher device 22 where they are coded or ciphered and subsequently transmitted. The regulation values 100 deciphered at the receiver end are delivered to an expander 79 for shifting the decimal point position in the other direction, so that by expansion of the synthetic generated, digital voice signal there is obtained the original value. Instead of the just-described regulation technique there can be also employed a different type of regulation of the voice signal.

Figure 4:
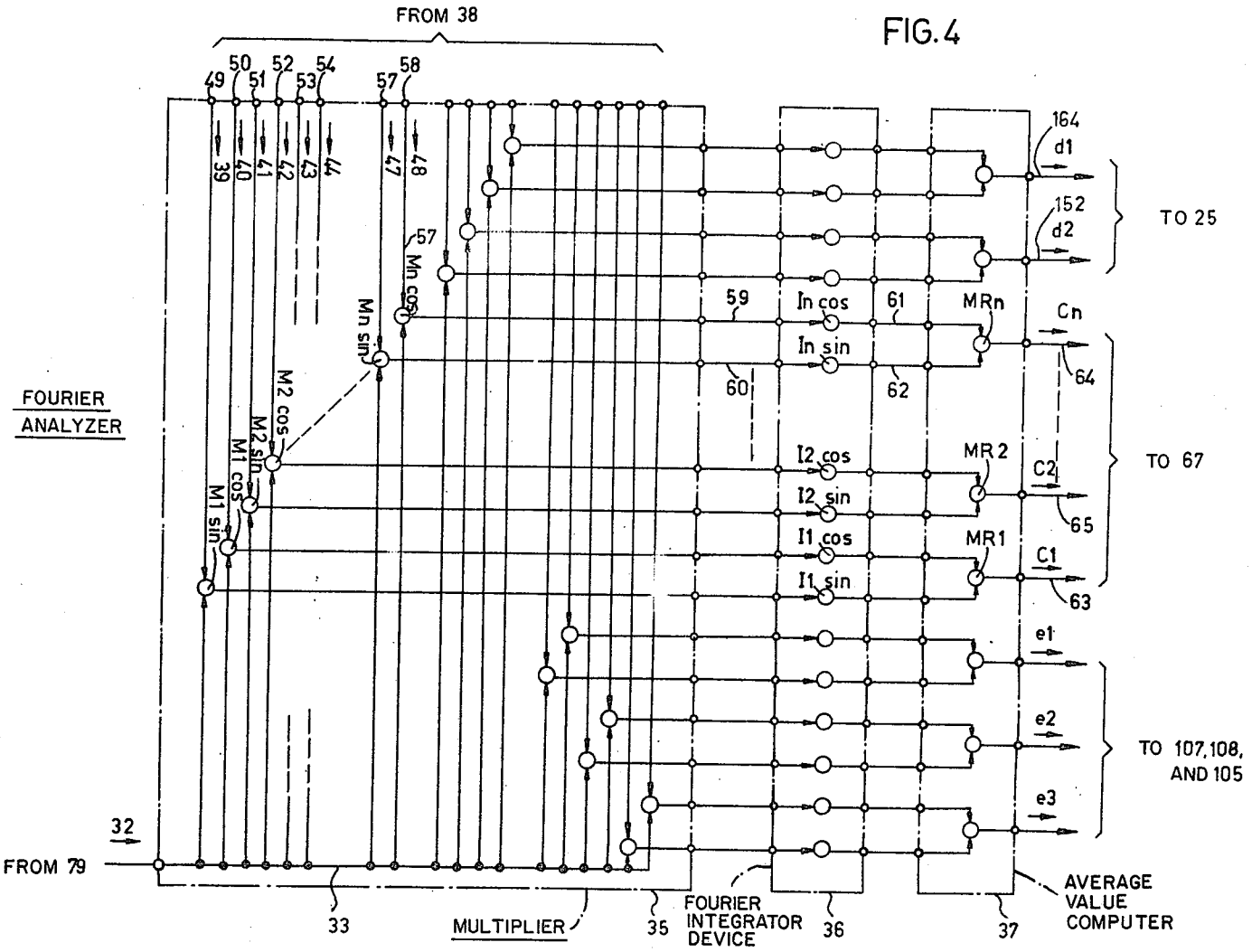
FIG. 4 is a schematic circuit diagram of a Fourier analyzer of the installation shown in FIG. 3.
Figure 5:
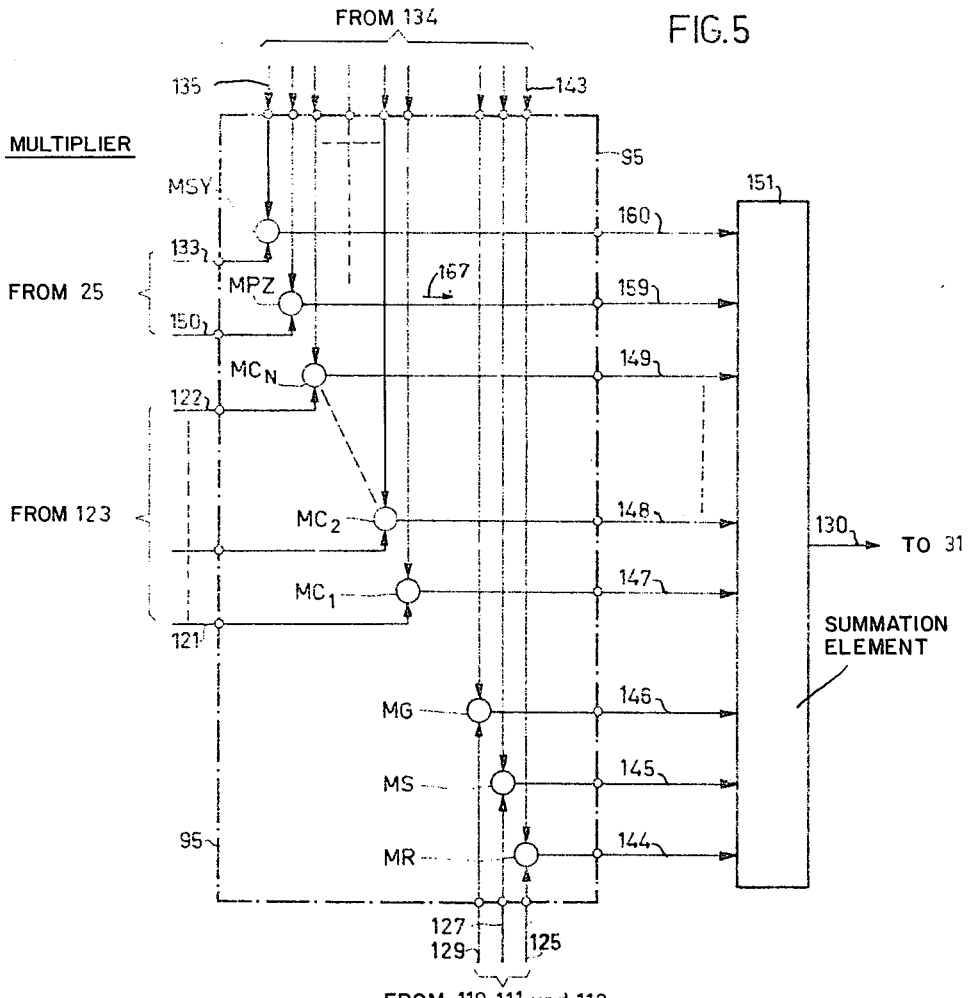
FIG. 5 is a schematic circuit diagram of the synthesis device or arrangement employed in the installation of FIG. 3.

The regulated digital voice signal 32, the binary number value of which has been reduced for instance to 6–8 places, arrives from the output of the compressor 30 as an input signal, via a line 33, at a Fourier analyzer 34, which will be considered in greater detail in conjunction with FIG. 4. This Fourier analyzer 34 contains a multiplier 35, a Fourier integrator device 36 and an average value computer 37. At the output side of the Fourier analyzer 34, at the conductors or lines 63, 64, of which there have only been shown three, there appear the Fourier coefficients $C_1$–$C_n$ and frequency spectrum coefficients, respectively, of the analyzed voice signal in the form of binary numbers. For the Fourier analysis there is required a frequency storage 38 which contains the information required for generating harmonic frequencies. This frequency storage 38 can generate a number of harmonic frequencies which can be employed for signal synthesis and/or signal analysis. According to a first embodiment of such frequency storage, the course of the curve for each individual harmonic frequency over at least one-half period of the fundamental frequency is stored in digital form; these storage values can be individually read-out. Such type frequency storages preferably possess semi-conductor storage elements, which are known in the art under the designation ROM.

Figure 6:
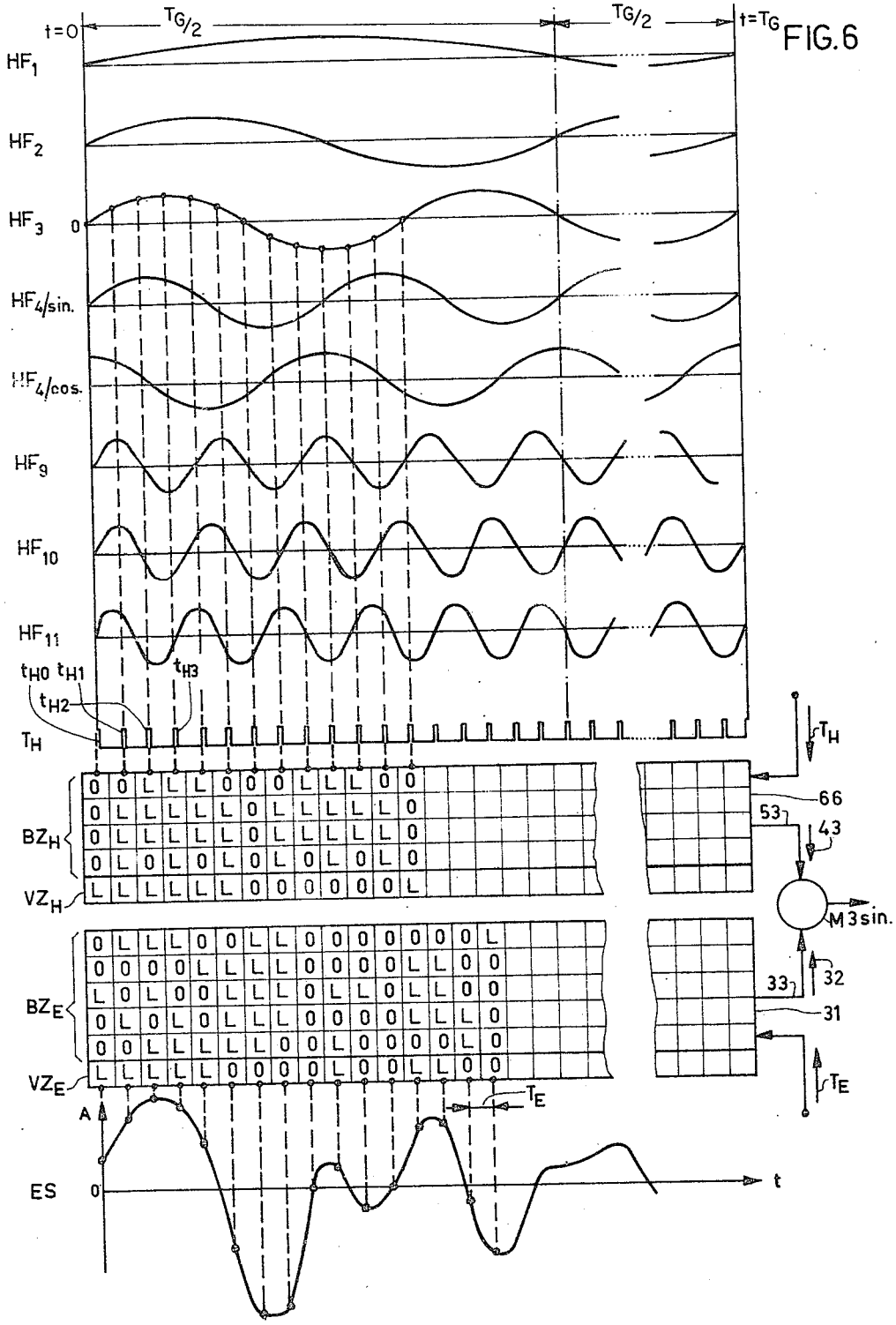
FIG. 6 graphically illustrates a fundamental frequency and a number of its overtones or harmonics, and also schematically illustrates shift registers for carrying out the autocorrelations and cross-correlations as well as graphically illustrating a voice or speech signal which is to be examined.

In the upper portion of FIG. 6 there is shown a fundamental frequency $HF_1$ and also a number of overtones or harmonic frequencies in analogous manner in the form of sine and cosine curves respectively, over a period of $T_G$ of the fundamental frequency. Viewed from the top towards the bottom, there is illustrated the fundamental frequency $HF_1$ with a period of $T_G$, the second harmonic $HF_2$ with two periods, the third and fourth harmonics $HF_3$ and $HF_4$ with the corresponding number of periods. At the fourth harmonic there are plotted two phase positions which differ by 90°, namely the curve $HF_4$/sin designated as the "sine harmonic" and the curve $HF_4$/cos designated by "cosine-harmonic". Of the remaining harmonic frequencies there have only been shown the curves of the ninth, tenth and eleventh harmonic frequencies, in other words the curves $HF_9$, $HF_{10}$ and $HF_{11}$.

The frequency storage 38 can individually deliver, for instance, information concerning all of the harmonic frequencies from the first to the fortieth or fiftieth harmonic frequency. Along the abscissa of the curve of FIG. 6 there is plotted the time $t$ and along the ordinate the amplitude of the harmonic oscillations. The information concerning the harmonic frequencies over a full period $T_G$ are stored at the frequency storage 38 and the read-out of this information can be interpreted such that a vertical time axis from $t=0$ to $t=T_G$ travels or migrates with constant speed transversely over the storage range from the left towards the right, wherein the intersection point of such time axis with the individual harmonic curves constitutes the stored momentary value of the harmonic frequencies. Immediately after the throughpassage in each instance of a complete fundamental period $T_G$ the time axis again begins at $t=0$ with its migration from the left towards the right. A complete throughpassage of the time axis from the left towards the right corresponds to the one-time output of the complete storage content of the frequency storage 38. In so doing, there appear at a number of conductors 49, 58, of which only two have been shown in FIG. 3, corresponding digital frequency signals. In this manner it is possible to continuously generate sinusoidal, harmonic frequencies which are free of phase shifts and gaps.

At the frequency storage 38 there can also only be stored the information over one-half period of the fundamental frequency $HF_1$. From the showing of FIG. 6 it will be apparent that for the even harmonic frequencies there is present for $t=0$ and $t=T_G/2$ the same phase position and for the uneven harmonic frequencies for $t=0$ and $T_G/2$ the phase positions are different by 180°. For the output of continuous harmonic frequencies free of phase shifts, for these variants it is thus necessary, after the delivery of the entire storage content at the time point $t=T_G/2$, to reverse in polarity the amplitudes of the uneven harmonic curve portions. With the aid of these measures it is only necessary to store the information of the harmonic frequencies over one-half period of the fundamental frequency.

As explained above the curves which are portrayed in analog form in FIG. 6 are stored digitally in the frequency storage 38. For instance, the digital storage of the amplitude values of the third harmonic frequency $HF_3$ are contained in the form of binary numbers in a partial store 66 of the frequency storage 38. This partial store or storage 66 has been schematically depicted in FIG. 6. The individual binary numbers $BZ_H$ contained in each stage of the partial store 66 and wherein each such stage possesses a number of storage places, can be read-out in synchronism with the clock frequency produced by the clock generator. The clock pulses which appear at the times $t_{H0}$, $t_{H1}$, $t_{H2}$, $t_{H3}$ and so forth, are shown in FIG. 6 at the line designated by reference numeral $T_H$. The binary numbers stored in each stage of the partial store 66 correspond to the amplitude values at the associated time points of the analog depicted third harmonic frequency $HF_3$ in FIG. 6. The stored amplitude values are indicated by points in the curve. In the partial store 66 depicted in FIG. 6 there can be stored, for instance, four place binary numbers $BZ_H$ and additionally a sign bit $VZ_H$, so that the stored amplitude value can be stored with ± 15 amplitude stages. With positive amplitudes the sign bit $VZ_H = 1$ and with negative amplitudes the sign bit $VZ_H = 0$. The binary number directly located over the sign bit is the least significant and the uppermost one is the most significant value of the binary number. Therefore, for instance at the time point $t_{H0}$ the stored binary number is 0000 corresponding to the amplitude value 0 associated with the curve $HF_3$, at the time point $t_{H1}$ the positive binary number 0111, corresponding to the value +7, at the time point $t_{H2}$ the positive binary number 1110, corresponding to the amplitude +14 of the curve $HF_3$. The partial store 66 of the frequency storage 38 operates as a shift register, wherein with each new infed clock pulse $T_H$ there is delivered at the output of the partial store 66 a new binary number $BZ_H$ of the illustrated sequence, which output is connected with a line 53 of the parallel lines or conductors which connect the frequency storage 38 with Fourier analyzer 34. Hence, at this conductor or line 53 there accordingly appears a digital frequency signal 43 characteristic of the third overtone or harmonic, and in this regard attention is also invited to FIG. 4. The amplitude quantitization with ± 15 amplitude stages has only been given by way of example, it can also exhibit ± 31 or ± 63 stages.

The clock period $T_H$ in reality is considerably shorter than such has been shown in FIG. 6. If, for instance, the frequency storage 38 should deliver information regarding a harmonic frequency of for instance 5 kHz, then the clock frequency must be at least 10 kHz and therefore the clock period $T_H = 0.1$ ms.

In the partial store 66 of FIG. 6 there is stored the information for the third harmonic frequency $HF_3$. For each further harmonic frequency there is provided a further similar type partial store, wherein each output of this storage is connected with one of the parallel lines between the frequency storage 38 and the Fourier analyzer 34. For the speech analysis, for each harmonic frequency, apart from the information derived from a sine harmonic, there must also be held in readiness the information of a cosine harmonic phase-shifted by 90°, by means of the frequency storage 38. This information likewise can be stored in one of the partial stores 66 and be read-out therefrom. However, there is also present the possibility to obtain from the information of the sine harmonics the information derived from the cosine harmonics with the aid of 90° phase-shifted taps of the partial store.

The clock frequency delivered to the frequency storage 38 is delivered to all of its partial stores 66, so that the binary numbers corresponding to the momentary amplitude values of the individual harmonic frequencies simultaneously appear at the outputs of the partial stores. The clock frequency should be a whole multiple of the fundamental frequency $f_G$. The storage place number of such type frequency storage 38 is quite high. With a fundamental frequency of 66 ⅔ Hz with a period of $T_G = 15$ ms, a storage during one-half of the fundamental period, in other words over 7.5 ms, and a clock period of $T_H = 0.1$ ms, there are to be stored 75 binary numbers per harmonic frequency, wherein only the sine harmonics are taken into account. If, for instance, there should be derived from the frequency storage 38 information concerning 40 harmonic frequencies, then there are to be stored a total of 75 × 40 = 3000 binary numbers. If the binary numbers are five place numbers and with a sign bit even six place numbers, then the total storage capacity of the frequency storage amounts to 6 × 3000 = 18,000 bits. With the objective of considerably reducing this large storage capacity there will be described hereinafter another exemplary embodiment of frequency storage which requires considerably less expenditure. The principal function of the intallation is, however, the same for all variations of the frequency storages and will be described hereinafter with reference to the above-disclosed frequency storage 38 and FIGS. 3 to 6. At the line ES there is plotted the amplitude course of an analog input signal as a function of time $t$, which input signal corresponds to the regulated voice signal 32. If the installation is placed into the transmitting mode, then the analog voice signal 27 appears at the analog-digital converter 28 and at that location is sampled with a clock period $T_E$ for forming a sequence of for instance nine place binary numbers. The digital voice signals 29 generated at the analog-digital converter 28 are delivered to the compressor 30 and the nine-place binary numbers are transformed, for instance, into five-place binary numbers $BZ_E$. These five-place binary numbers arrive in the form of the regulated digital voice signal 32 at the short-time storage 31 which has only likewise been schematically depicted in FIG. 6. At the curve which portrays in analog form the regulated, digital voice signal 32 and plotted in line ES of FIG. 6, there are marked by points those amplitude values, the digital values of which are stored in the individual stages of the short-time storage 31 in the form of the binary numbers $BZ_E$, wherein the lowest binary number again signifies the amplitude sign $VZ_E$. The quantitization of the amplitude values with the aid of five binary places and a sign bit occurs for instance with ± 31 amplitude stages. The number of amplitude stages could however also amount to ± 63 or ± 120 stages to which end there are required six- or seven place binary numbers respectively.

The clock period $T_E$, by means of which there is sampled the analog illustrated regulated digital voice signal according to line ES of FIG. 6, can be equal to the clock period $T_H$ and synchronized therewith, and which is delivered to the frequency storage 38. In this instance the multiplication of the binary numbers, which are produced by the frequency storage 38, can be carried out particularly simple with those binary numbers which are delivered by the short-time storage 31. In the disclosure to follow there will be demonstrated how the multiplication of those binary numbers also can be carried out without synchronization of both clock frequencies $T_H$ and $T_E$. According to the schematic illustration in FIGS. 3 and 4 the regulated, digital voice signal 32 is delivered via the conductor or line 33 and the intelligence or information 43 concerning the third harmonic frequency $HF_3$ via the line 53 to a multiplier M3 sin. This multiplier is part of multiplier device 35 which is only partially illustrated in the drawings.

The individual information which is read-out of the frequency storage 38 concerning the sine harmonics and cosine harmonics is delivered via the parallel lines 49–58 as information signals 39–48 to the multiplier device 35 of the Fourier analyzer 34 (FIG. 4), which multiplier device 35 will be understood to contain the multipliers M1 sin, M1 cos, M2 sin, M2 cos to Mn sin and Mn cos. Similarly also the regulated, digital voice signal 32 arrives via the common conductor or line 33 at all multipliers of the multiplier device 35. The analysis of the regulated, digital voice signal 32 for determining the frequency spectrum coefficients C1, C2, C3 to Cn occurs according to the known Fourier series or equations, these coefficients are therefore hereinafter referred to as Fourier coefficients.

In the following derivation of the Fourier analysis the regulated, digital voice signal 32 has been designated by reference character $f_E(t)$. Furthermore, there is initially assumed that this signal is harmonic and has the same fundamental frequency as that of the frequency storage 38. The fundamental angular frequency is accordingly $\omega_G = 2\pi f_G = (2\pi/T_G)$ and the duration of the period of the fundamental frequency is $T_G$. The signal $f_E(t)$ contains the harmonic frequencies $\omega_G$, $2\omega_G$, $3\omega_G$ to $n\omega_G$ and no DC-components. In order that the analysis can be carried out independent of phase, the signal $f_E(t)$ is subdivided into sine and cosine terms, wherein reference character $A_n$ represents the amplitude of the sine term and reference character $B_n$ the amplitude of the cosine term of the nth harmonic with the angular frequency $n\omega_G$. This signal therefore can be represented by the following equation:

$$f_E(t) = \sum_{n=1}^{n=n} (Bn \cos n\,\omega_G t + An \sin n\,\omega_G t)$$

The amplitudes A*n* and B*n* for the *n*th harmonic of the signal with the angular frequency $n\omega_G$ are obtained by multiplication of the signal $f_E(t)$ with the sine harmonic sin $n\omega_G$ and the cosine harmonic cos $n\omega_G$ respectively and by integration over a period $T_G$. This can be expressed by:

$$An = K \int_0^{T_G} f_E(t) \cdot \sin n\omega_G t\, dt$$

$$Bn = K \int_0^{T_G} f_E(t) \cdot \cos n\omega_G t\, dt$$

wherein *An* and *Bn* are the correlation values between the signal $f_E(t)$ and the sine- and cosine harmonics sin $n\omega_G$ and cos $n\omega_G$ respectively. The Fourier coefficients C1–C*n* can be calculated for instance for the *n*th harmonic from the equation $$Cn = \sqrt{An^2 + Bn^2}$$

According to FIG. 4 the multiplication $f_E(t)$ sin $n\omega_{Gt}$ and $f_E(t)$ cos $n\omega_{Gt}$ are carried out in the multipliers M*n* sin and M*n* cos of the multiplier device 35, wherein the regulated, digital voice signal 32 corresponds to the signal $f_E(t)$ and the sine harmonic sin $n\omega_G$ and the cosine harmonic cos $n\omega_G$ are derived as information signals 47 and 48 from the frequency storage 38 via the lines 57 and 58 and delivered to the multipliers.

The thus obtained product $f_E(t)$ cos $n\omega_G$ and $f_E(t)$ sin $n\omega_G$ arrive via the conductors or lines 59 and 60 at the integrators I*n* cos and I*n* sin, at which by integration over a period $T_G$ there are obtained the amplitude coefficients B*n* and An which are delivered via the lines 61 and 62 to an average value computer element MR*n* of the average value computer 37, as sucn can be best seen by referring to FIG. 4. The average value computer element MR*n* calculates the Fourier coefficient C*n* of the *n*th harmonic of the signal $f_E(t)$ according to the equation:

$$Cn = \sqrt{An^2 + Bn^2}$$

which value is delivered via a line 64 from the Fourier analyzer 34 to the signal component or parameter signal computer 67. In analogous manner there is obtained from the average value computer elements MR1, MR2 the Fourier coefficients C1, C2 of the first and second harmonics of the signal $f_E(t)$ and such are further transmitted via conductors 63 and 65 to the parameter signal computer 67. In this manner there are generated all Fourier coefficients for the third to the ($n$−1)th harmonics by means of non-illustrated average value computer elements.

Further signal components *e*1, *e*2 and *e*3 as well as *d*1 and *d*2, which likewise can be generated by the average value computer 37, are not required in the operating state corresponding to the transmitting mode and their function will be first considered more fully hereinafter. The Fourier coefficients C1, C2 to C*n* of the regulated, digital voice signal over a section length or interval of the fundamental period $T_G$, as already mentioned, are either delivered to the parameter signal computer 67 or directly to the cipher- and decipher device 22. All of the signal values or magnitudes, especially the Fourier coefficients derived by the Fourier analyzer 34 are delivered in the form of binary numbers.

The computations which are to be carried out are multiplication of two binary numbers, for instance the binary numbers $BZ_H$ and $BZ_E$ which in each case are located above one another according to the showing of FIG. 6, while taking into account the sign $VZ_H$ and $VZ_E$. Integration is carried out by continuous addition of binary numbers in standard binary adders and the operation $\sqrt{An^2 + Bn^2}$ is carried out in a binary number system. As shown in conjunction with FIG. 6, the clock frequency by means of which the voice signal is sampled can be equal to the clock frequency delivered to the frequency storage 38 and can amount to for instance 10 kHz, from which there result the clock periods $T_E = T_H = 0.1$ ms $= 100\mu s$. For carrying out the multiplications and additions during the integration time there are available in each case $100\mu s$ per sampling operation, that is to say, for sampling a binary number. The arithmetic operation $\sqrt{An^2 + Bn^2}$ is carried out per signal interval or per fundamental period $T_G$ respectively. As will be explained more fully hereinafter a great number of these arithmetic operations can be carried out in sequence at an increased rate, so that there can be realized a saving in many multipliers, adders and average value computer elements.

With the previous description of the analysis operation there was assumed that the voice or speech signals are absolutely periodic and the fundamental frequencies of the fundamental frequency delivered by the frequency storage 38 and the voice signal are identical. This is, for instance, the case when the system is switched to the receiving mode and the signal analyzer 21 to a certain extent serves as demodulator. As already mentioned above, for instance the amplitude value of a sine term $$An = K \int_{o}^{T_G} f_E(t) \cdot \sin n\omega_G t \, dt$$

is the cross-correlation value KW between the function $f_E(t)$ and the function $\sin n\omega_G t$. Generally, the cross-correlation value KW between two sine functions with the amplitude 1 and the angular frequency $n1\omega_G$ and $n2\omega_G$ as a function of time can be expressed as follows:

$$KW_{(t)} = \int_{o}^{t} \sin n_1 \omega_G t \cdot \sin n_2 \omega_G t \, dt$$

$$KW_{(t)} = \tfrac{1}{2}\int_{o}^{t} [\cos (n_1 - n_2)\omega_G t - \cos (n_1 + n_2)\omega_G t] dt$$

For the correlation of two similar frequencies, in other words $n1 = n2 = n$ the function $KW(t)$ becomes the auto-correlation value $$KW_{(t)} = \tfrac{1}{2}\int_{o}^{t} [1 - \cos 2n\, \omega_G t] dt$$

$$KW_{(t)} = \frac{t}{2} - \frac{\sin 2n\, \omega_G t}{2 \cdot 2n\, \omega_G}$$

Figure 7:
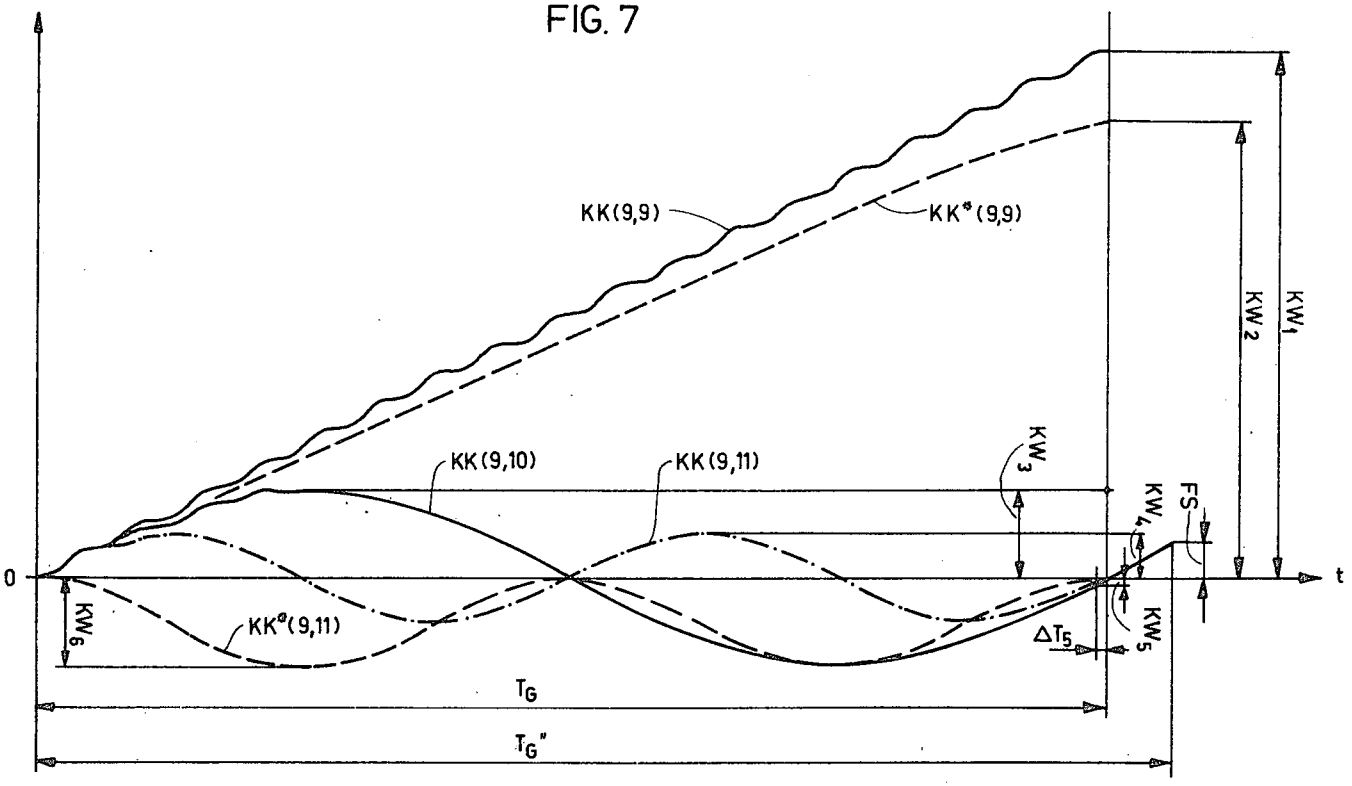
FIG. 7 is a graphic illustration of autocorrelation-and cross-correlation curves for the Fourier analysis.

This time course has been plotted in FIG. 7 for $n = 9$ and $\omega = 9\omega_G$, in other words, the ninth harmonic $HF_9$, as the curve KK(9,9). This curve, apart from superimposing with the double frequency, has a linear ascent. The correlation value KW1 is the correlation value of the ninth harmonic with itself (auto-correlation value) which is attained after a fundamental period $T_G$, that is to say for $t = T_G$. The correlation value between two neighboring harmonic frequencies, the frequency difference of which is the fundamental frequency, in other words for instance $n1 = n$ and $n2 = n-1$ results in the following function:

$$KW_{(t)} = \tfrac{1}{2}\int_{o}^{t} [\cos \omega_G t - \cos(2n - 1)\omega_G t] dt$$

$$KW_{(t)} = \tfrac{1}{2} \left[ \frac{\sin \omega_G t}{\omega_G} - \frac{\sin (2n - 1)\omega_G t}{(2n - 1)\omega_G} \right]$$

The first term is a sine oscillation with the angular frequency $\omega_G$ and the period length $$T_G = \frac{2\pi}{\omega_G}$$

of the fundamental frequency, the second term is a high frequency sinusoidal oscillation with smaller amplitude of both terms corresponding to the lower and upper sidebands with amplitude modulation. For the value $t = T_G$ there is present the correlation value = 1 over a correlation range of the fundamental period, since for the function $$T_G = \frac{2\pi}{\omega_G}$$

both terms become null. In FIG. 7 the curve KK(9,10) is the cross correlation course between the ninth and the neighboring tenth harmonic frequencies $HF_9$ and $HF_{10}$ with the maximum correlation value $KW_3$ which corresponds to $$\frac{1}{2\pi} = \frac{1}{6}$$

of the auto-correlation value $KW_1$.

The correlation values between two harmonic frequencies, the frequency difference of which is twice the fundamental frequency, in other words for instance $n1 = n$ and $n2 = n-2$, have the following function:

$$KW_{(t)} = \tfrac{1}{2}\int [\cos 2\omega_G t - \cos(2n - 2)\, \omega_G t] dt$$

$$= \tfrac{1}{2} \left[ \frac{\sin 2\omega_G t}{2\omega_G} - \frac{\sin(2n - 2)\omega_G t}{2(n - 2)\omega_G} \right]$$

The first term is a sinusoidal oscillation with an angular frequency $2\omega_G$ and the period length $$\frac{T_G}{2} = \frac{2\pi}{2\omega_G},$$

in other words one-half the period of the fundamental frequency. The second term is again a high-frequency sinusoidal oscillation with small amplitude. Also here the correlation value over the correlation range of a fundamental period = 0.

In FIG. 7 the curve KK(9,11) is the correlation course between the ninth and eleventh harmonic frequencies $HF_9$ and $HF_{11}$ with the maximum correlation value $KW_4$, which corresponds to $$\frac{1}{4\pi} = \frac{1}{12}$$

of the autocorrelation value $KW_1$ and one-half of the correlation value KW3. If there is analyzed by correlation a periodic, harmonic signal with the harmonic frequencies of a frequency storage generating the same, wherein the fundamental frequency generated by the frequency storage is the same as the signal which is to be analyzed, and if furthermore the fundamental period $T_G$ is selected as the correlation duration or Fourier analysis duration, then the Fourier analysis for each harmonic provides the exact Fourier coefficients, since the correlation with the secondary or auxiliary frequencies produces the value null when the integration is carried out over a fundamental period length $T_G$, and specifically this value is null for random phase positions.

Figure 8:
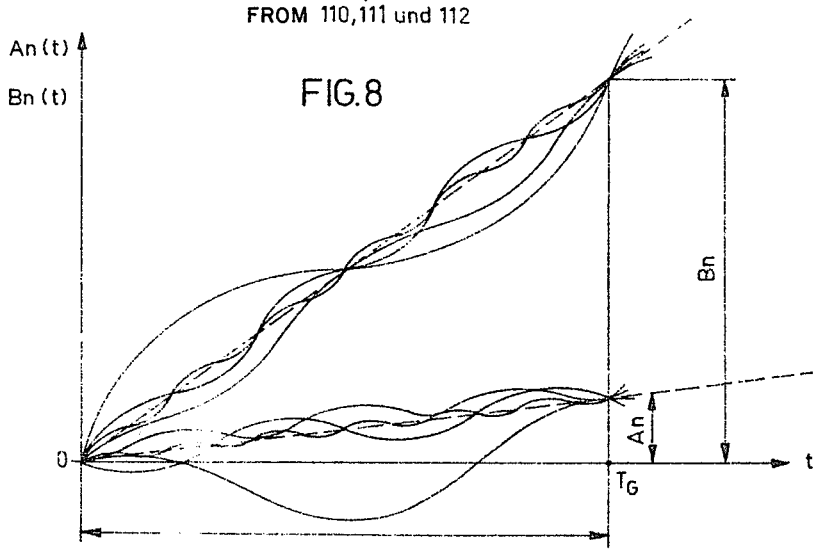
FIG. 8 graphically illustrates correlation curves serving to explain the Fourier analysis.

In FIG. 7 there is plotted, for instance, the cross correlation course between the harmonic frequencies $HF_9$ and $HF_{11}$ by the curves **KK*(9,11), whereby however the harmonic frequency $HF_9$ is phase-shifted out of the depicted position by 90°. Also here at the end of the correlation period, i.e. after the fundamental period $T_G$, the value is equal to null. The maximum deviations of the correlation value $KW_6$ from null, within the correlation range, here attain double the value in relation to the curve KK(9,11). In FIG. 8** there is portrayed the course of the contributions of the individual harmonic frequencies of the signal to be analyzed for forming the amplitude values A*n* and B*n* over the integration range of the fundamental period $T_G$. The portion of the sought frequency has been depicted in broken lines. During the course of the integration the secondary harmonics produce sinus-shaped deviations, the frequency of which corresponds to the frequency spacing of the secondary harmonics from the frequency which is sought and the amplitude deviation always becomes smaller inversely proportional to increasing frequency spacing.

For a correlation duration, which corresponds to the fundamental period $T_G$, the contribution of the secondary harmonics to the amplitudes A*n* and B*n* and thus to the Fourier coefficients $Cn = \sqrt{An^2 + Bn^2} = 0$. Of course, this contribution for each whole multiple of the fundamental period $T_G$ likewise equals 0, so that the integration also can be carried out over twice $T_G$ or thrice $T_G$.

The curve KK*(9,9) of FIG. 7 shows the correlation course between two frequencies which are different by a small amount, for instance $(1/6)\, f_G$, in other words one-sixth of the fundamental frequency, for instance $n1 = n$ and $n2 = n - (1/6)$. The correlation value $KW_2$ after a correlation duration of the length of the fundamental period $T_G$ with this detuning through one-sixth of the fundamental frequency still amounts to about 86% of the autocorrelation value $KW_1$. Such detuning can occur during the transmission of the transmission signal via a carrier line which is subject to pronounced carrier drift. The curve KK*(9,9) constitutes the ascending portion of a sinusoidal oscillation with the period length $6T_G$, since $n2 = n - (1/6)$. The effect of the secondary harmonics upon the course of the correlation value KW(*t*) is independent of the absolute frequency and only dependent upon the difference of the order number of the sought harmonics from the order number of the secondary harmonics. The course of the cross correlation value KW(*t*) between the tenth and eleventh harmonics, apart from the high-frequency superimposing, is the same as for instance between the thirtieth and thirty-first harmonics. In both cases the correlation value KW(*t*) over a fundamental period length $T_G$ provides a full sinusoidal oscillation.

In FIG. 8 there is portrayed as a function of time *t* the course of the correlation value $$An = K \int_0^t f_{E(t)} \cdot \sin n\omega_G \cdot t \, dt$$

$$Bn = K \int_0^t f_{E(t)} \cdot \cos n\, \omega_G \cdot t \, dt$$

For $t = T_G$, that is to say, for a correlation interval which corresponds to the fundamental period, the correlation values are constituted by the amplitudes A*n* and B*n*, wherein $\sqrt{An^2 + Bn^2} = C_n$ constitutes the Fourier coefficient of the *n*th harmonic. The values A*n*(*t*) and B*n*(*t*) oscillate about broken illustrated lines, which for $t = 0$ travel through null and for $t = T$ through the ordinate values A*n* and B*n* respectively. Only for $t = T_G$ or a whole integer multiple thereof can there be determined the exact values of A*n* and B*n*. For all intermediate values they are influenced according to FIG. 8 by the secondary harmonics.

When the installation has been adjusted so as to operate in its transmitting mode, then the signal analysis device 21 serves for obtaining the decisive parameter signals from the regulated, digital voice signals 32. These parameter signals, as mentioned above, apart from containing the Fourier coefficients also contain the voiced/voiceless information coefficients, which for instance in the case of purely voice spoken sounds, such as "A", "E", "I", "O", "U" and so forth, assume the value 0 and for the pure unvoiced or voiceless spoken sounds such as "*s*", "*sch*", "*f*" and so forth, assume the value 1. In the case of voiced sounds with harmonic frequency spectrum their fundamental sound pitch is furthermore an important characteristic which is defined by the fundamental sound pitch coefficients, for instance portrayed as binary number.

The voiced/voiceless information coefficient 69 and the fundamental sound pitch coefficient 70 are obtained, for instance, by means of a voice character- and fundamental sound analyzer 68 contained in the signal analysis device or analyzer 21. According to a second exemplary embodiment, which will be discussed more fully hereinafter, both coefficients are obtained with the aid of the Fourier analyzer 34 at the parameter signals computer 67.

The regulated digital voice signal 32, is delivered to the voice character- and fundamental sound analyzer 69. This has been schematically depicted at the lower portion of FIG. 9, specifically in FIG. 9F, and essentially embodies a delay line or conductor 72 constructed for instance as a shift register and having at least two taps $AB_F$ and $AB_V$, the time increment or distance $\Delta t_x$ (FIG. 9D) of which is variable. The taps are coupled with the inputs of an autocorrelator 71 from which there can be derived the autocorrelation value of the voice signal with a voice signal delayed by the time distance $\Delta t_x$. It should be apparent by inspecting FIG. 9 that these autocorrelation values for voiced sounds each can assume a maximum value when the time distance $\Delta t_x$ of the taps is equal to the period length $T_G$ of the frequency of the fundamental sound of the voice signal or a multiple thereof, that is to say, when there exists the relationship:

$$\Delta t_x\,(\max) = n\, T_G$$

In line *a* of FIG. 9A there is graphically portrayed a voiced speech signal with a harmonic frequency spectrum and a fundamental sound period $T_{GT}$. This period $T_{GT}$ corresponds to the lowest fundamental sound frequency which occurs during speech in the order of for instance 80 Hz, wherein therefore $T_{GT} = 12.5$ ms. In line *b* of FIG. 9B there is plotted the course of the fundamental sound frequency, that is to say, the first harmonic and in line *c* the course of the second harmonic with twice the frequency.

Figure 9F:
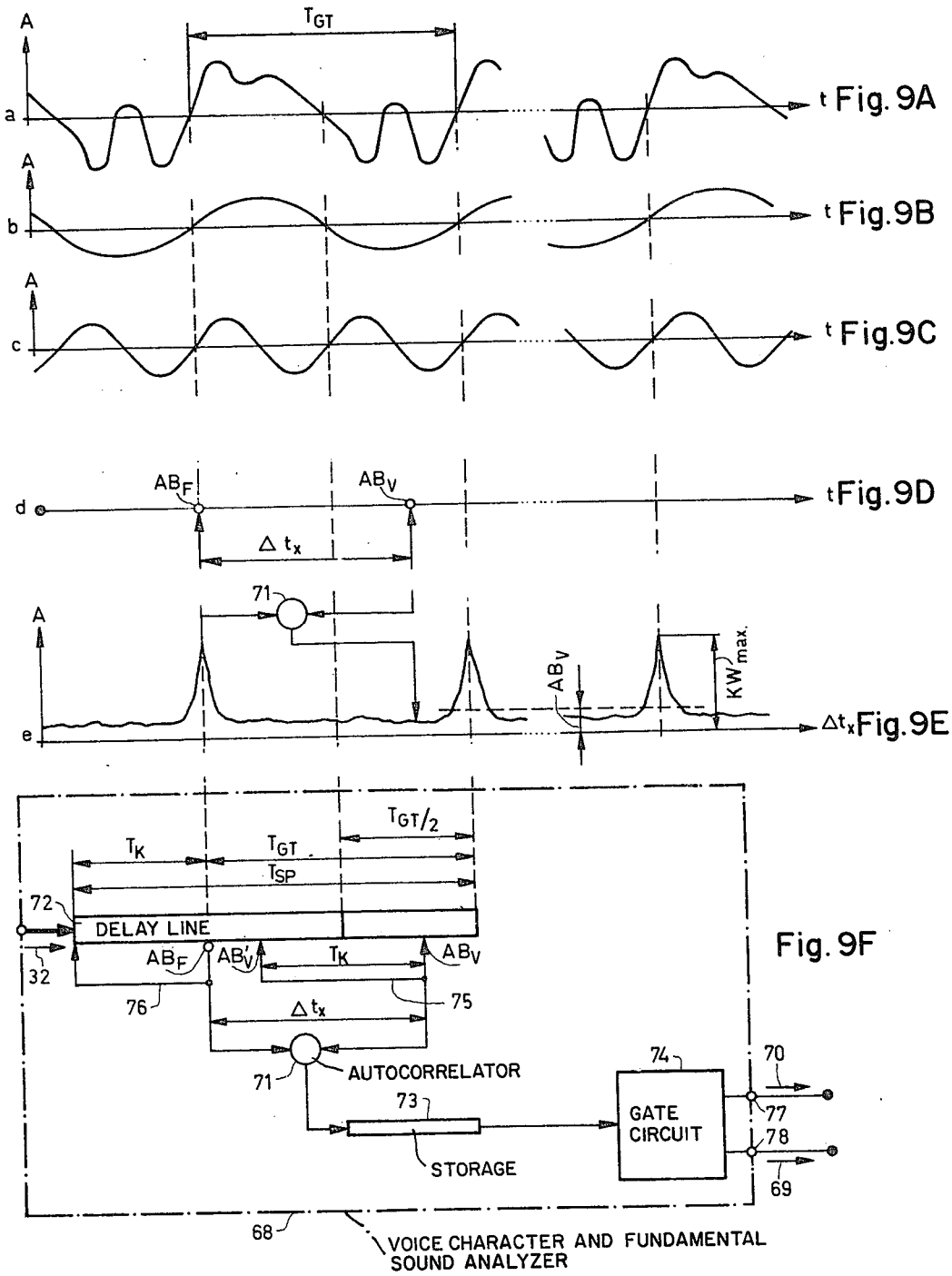
FIG. 9, which embodies the FIGS. 9A to 9F respectively, graphically illustrates a speech or voice signal to be analyzed, the analysis frequencies and the auto-correlation curve as well as schematically illustrating a device for determining the fundamental sound pitch coefficients.

In lines *d* and *e*, of FIGS. 9D and 9E respectively, there is schematically illustrated the course of the autocorrelation value obtained as a function of the time distance $\Delta t_x$ of both taps $AB_F$ and $AB_V$ by means of the autocorrelator 71, and which autocorrelation value is plotted in line *e*, when such taps are connected with the delay line 72 through which passes the voice or speech signal according to line *a*. As can be seen by inspecting line *e* of FIG. 9E there are obtained extreme maximum values of the autocorrelation value when the time distance is a whole multiple of the fundamental period $T_{GT}$. The distance of two neighboring maximum values corresponds to the fundamental period. By changing the position of at least one of the taps and forming the autocorrelation value it is therefore possible to determine the fundamental period $T_{GT}$ by scanning or sampling. With the voice character- and fundamental sound analyzer 68 portrayed at the lower portion of FIG. 9, i.e. in FIG. 9F, there have not been shown the lines for delivering the clock signals from the clock generator 24 and the line for controlling this analyzer by the control device 25.

The delay line 72 is for instance a shift register in which there can be stored the binary numbers of the sampled amplitude value of the voice signal, as such has been previously discussed with regard to the short-time storage 31 and FIG. 6. In the delay line 72 there can be stored a voice section or interval of the length $T_{SP}$, this length being greater by the correlation interval or section $T_K$ than the period length $T_{GT}$ of the lowest fundamental frequency. If the sampling rate of the voice signal is selected such that the period length $T_{GI}$ of the lowest fundamental sound, of for instance 12.5 ms, is represented by 256 binary numbers and if there is selected the correlation interval or section $T_K = 6$ ms, corresponding to about 120 binary numbers, then there are to be stored 376 binary numbers in the delay line corresponding to a voice section of 18.5 ms. The sampling period therefore amounts to (12.5/256) ms = 0.05 ms. The information derived from the variable tap $AB_V$ again can be supplied to the delay line 72 through the agency of a return or feedback line 75 and via a further variable tap $AB'_V$. Both taps $AB_V$ and $AB'_V$ always have the same time spacing or distance, corresponding to the correlation interval $T_K$.

The information derived from the stationary tap $AB_F$ can be fedback via a second feedback line 76 to the input of the delay line 72, wherein the tap $AB_F$ from the input likewise possesses the time distance according to the correlation interval $T_K$. The mode of operation of the voice character- and fundamental sound analyzer 68 is as follows: the regulated, digital voice signal 32 is stored in increments or intervals, for instance with an interval length of $T_{SP} = 18.5$ ms, in the delay line 72. Then there is initiated the sampling operation for determining the maximum autocorrelation value in the following manner. Initially, and with reference to FIG. 9, the variable tap $AB_V$ is located at the right end of the delay line 72, whereby the time spacing $\Delta t_x$ is maximum. The intervals of the length of the correlation section $T_K$, i.e. the intervals $AB'_V$ to $AB_V$ and the input of the delay line to $AB_F$ of the information contained in the delay line 72, and which intervals are contained in both feedback lines 75 and 76, are now synchronously read-out exactly once from the delay line with markedly increased clock frequency via the feedback lines and again stored in the delay line. During this cycling of the information there is determined in the autocorrelator 71 the correlation value via the correlation interval $T_K$ and stored as a binary number in a storage 73. Then the variable taps $AB_V$ and $AB'_V$ are shifted through one sampling distance of the delay line, that is to say, shifted towards the left from one binary number to the next, with the result that due to the further transformation of the information in the autocorrelator 71 there is derived a further correlation value and stored in the storage 73. This procedure is repeated for such length of time until the variable taps have been shifted through one-half of a period $T_{GT}$ of the lowest occurring fundamental sound. With a sampling width, corresponding to one-half of the period length, that is to say with a variation of the time distance $\Delta t_x$ by $T_{GT}/2$ there is scanned from the lowest fundamental sound over an octave, that is to say up to twice the frequency of the fundamental sound, in other words for instance from a fundamental frequency according to line *b* of FIG. 9B to a frequency according to line *c* of FIG. 9C. With this sampling or scanning width, which extends over an octave, there is positively determined a maximum correlation value, the associated time distance $\Delta t_x(\max)$ of which is equal to the sought fundamental period $T_G$ or is a multiple thereof. At the end of the scanning operation there are contained at the storage 73, for instance 128 correlation values, corresponding to the number of sampling values during one-half of a period, wherein at least one of which is the maximum correlation value associated with the fundamental period $T_G$. Now if there are numbered the sampling values stored in the delay line 72 from the tap $AB_F$ towards the right from 1–256, wherein the sampling value of the final region $T_{GT}/2$ possesses the order numbers 129–256, then these order numbers also can be associated with the corresponding correlation values in the storage 73. The order number of the maximum correlation value then corresponds to the period length of the sought fundamental sound. Due to successive input of the correlation value stored at the storage 73 into a gate circuit 74 there is determined the order number of the maximum correlation value, which for instance as an eight place binary number forms the fundamental sound pitch coefficient 70 at the line or conductor 77. At the conductor or line 78 there is simultaneously delivered the voiced/voiceless information coefficient 69 as the binary number 0, which signifies voiced sounds.

The accuracy of the sound pitch determination for 128 stages per octave is better than 1% with a maximum error of (1/128). If there is not determined any pronounced maximum of the correlation value, i.e., when the relationship of the maximum correlation value $KW_{max}$ to the average or mean value of the correlation value $KW_{mit}$ of the scanning or sampling range remains below a predetermined threshold value, then the voice signal will be determined to be a voiceless or unvoiced signal, that is will be considered to be non-harmonic and at the line 78 there appears the voiced/-voiceless coefficient 69 as the binary number 1, signifying voiceless sounds. At the line 77 the fundamental sound pitch coefficient 70 is then signified by the binary number 0.

The time needed for sampling the fundamental period of the voice signal is to be calculated in the example given as follows: the lowest fundamental frequency is 80 Hz, i.e. its period length $T_{GT} = 12.5$ ms. The sampling range corresponds to a duration of 6.25 ms. The actual time distance between the binary numbers of the voice signal amounts to about 0.05 ms, so that for the sampling range there result 128 binary numbers. If during sampling the variable taps are shifted from one binary number to the next and in each new position there is determined the autocorrelation value there then results 128 correlation value determinations. The autocorrelation values are determined over a correlation section $T_K$ of, for instance, 6 ms with 120 binary numbers. Therefore for the correlation value determination there are $128 \times 120 = 15{,}000$ multiplications and additions which must be carried out. The time available for this is the duration of a voice signal interval of for instance 30 ms. Consequently, the time available for a multiplication amounts to 30 ms:15,000 = 2μs. This is also the clock period by means of which the information contained in the delay line 72 is read-out and via the feedback lines 75 or 76 respectively again introduced therein. This increased clock frequency therefore amounts to 500 kHz. For the performance of 500,000 multiplications of each two respective binary numbers per second there are required special multiplier devices which will be disclosed more fully hereinafter. Of course, it is also possible by using more multiplier devices to prolong the multiplying time. A further method for determining the fundamental sound pitch is also described more fully hereinafter.

In the Fourier analyzer 34 there is carried out the analysis of the regulated, digital voice signal in intervals or increments over the signal increments or intervals of 15–30 ms. The length of such intervals is dependent upon the voice character, the most rapid changes of the voice or speech sounds occurring in time intervals of this magnitude. Signal intervals of 15–30 ms approximately correspond to about 1–2 periods $T_{GT}$ of the lowest voice fundamental frequency of 80 Hz for voiced sounds. The analysis can thus take place over one or two whole periods of the fundamental sound and can be carried out in synchronism with the fundamental sound. The frequency storage 38 is adjusted to the fundamental sound frequency which was previously determined in the voice character and fundamental sound analyzer 68 and thereafter the analysis is carried out over exactly one or two periods of the fundamental frequency, as such has been explained above with respect to FIG. 6. If there is intended to be used for the sampling of the fundamental sound a complete or full signal interval length of, for instance, 30 ms, then the voice signal which is to be delivered to the Fourier analyzer 34 is to be delayed in the short-time storage 31 likewise by at least 30 ms, so that at the start of the analysis the frequency storage 38 can be adjusted to the fundamental sound.

The adjustment or setting of the frequency storage 38 to the determined fundamental sound can occur in the following manner: the clock period $T_H$ of the frequency storage is variable by means of the binary number of the fundamental sound pitch coefficient in a range of 1–0.5, that is for a fundamental sound pitch variation through one octave. In this range the value of the fundamental sound pitch-binary number varies from 256–129 and for this range the clock period $T_H$ must be made variable.

Figure 10:
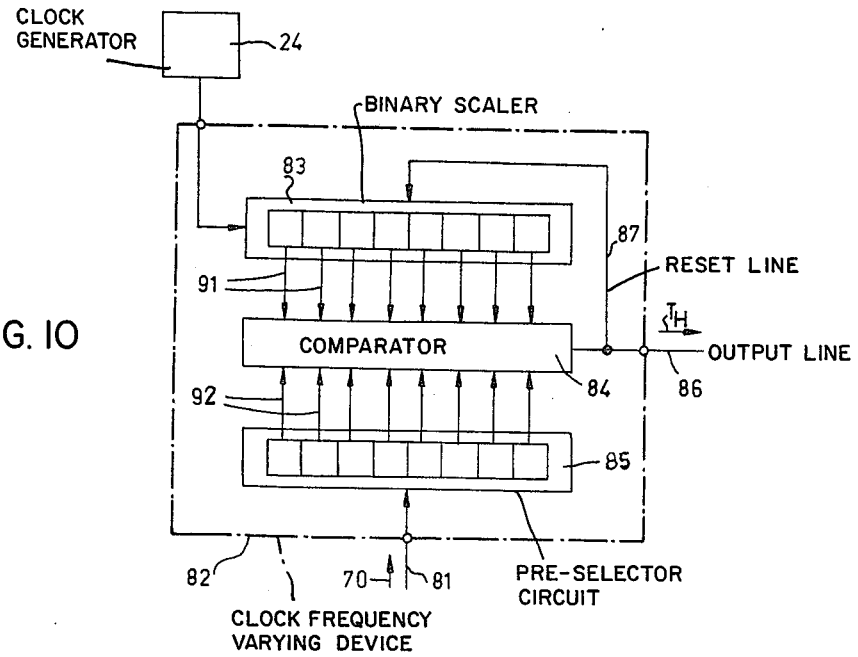
FIG. 10 is a block circuit diagram of an apparatus for digitally generating a variable clock frequency.

For this purpose there is used a device 82 for varying the clock frequency as shown in FIG. 10. The clock generator 24 generates a constant clock frequency of, for instance, 2.56 MHz. This frequency is scaled or stepped down in an eight stage binary scaler 83. A conventional scaler will deliver at its output a scaled down clock frequency of $1/T_H$ of 2.56 MHz:$2^8$ = 2560 kHz: 256 = 10 kHz with a clock period $T_H$ = 0.1 ms. If this clock frequency is delivered to the frequency storage 38, then such produces a harmonic spectrum with a fundamental frequency of 80 Hz. The device 82 renders possible, however, with the aid of a preselector circuit 85, a comparator 84 and a resetting line 87, that there can be removed from the output line 86 a clock period $T_H$ which is selectable in a range of 0.1–0.05 ms. Consequently, the fundamental frequency of the frequency storage 38 can be adjusted over one octave, that is in a range of 80– 160 Hz. The shifting of the fundamental frequency within this frequency range occurs in 128 stages.

The device 82 is part of the frequency storage 38, the fundamental sound pitch coefficient 70 determined by the voice character- and fundamental sound analyzer 68, with the gate 88 open, arrives as an eight place binary number over a line 81 at the preselector circuit 85 and is stored in the eight storage positions or places of such preselector circuit 85. These storage positions are connected via the lines 92 with the comparator 84. The eight storage places or positions of the binary scaler 83 are connected via lines 91 with comparator 84. Then there appears at the output line 86 of the device 82 a clock pulse $T_H$ when there exists a coincidence condition between the binary number stored at the preselector circuit 85, which corresponds to the determined fundamental sound pitch of the voice signal, and the binary number stored at the binary scaler 83. By means of the feedback line 87 the binary scaler 83 is reset to null, as soon as a clock pulse is produced. If the binary number of the fundamental sound pitch coefficient corresponds, for instance, to the value 192, which corresponds to the binary value 11000000, then the binary scaler 83 will count 192 input pulses of the clock generator 24 and then there will be determined at the comparator 84 identity of both binary numbers, which brings about that a clock pulse $T_H$ will be delivered via the output line 86 and the binary scaler 83 will be reset to null, so that the counting can begin anew. In each case after 192 pulses of the clock generator 24 there is delivered to the frequency storage 38 a clock pulse $T_H$ via the output line 86, so that in the frequency storage 38 there is held ready the information concerning a harmonic mixture with a fundamental frequency of 120 Hz, corresponding to a clock period of 0.075 ms. If 128 pulses of the clock generator 24 are counted, then such corresponds to a fundamental frequency of 160 Hz and if 256 pulses of the clock generator are counted, then such corresponds to a fundamental frequency of 80 Hz. The change of the fundamental frequency of the frequency storage 38 also requires a change in the sampling or scanning times, these amount to for instance, at 80 Hz to 0.1 ms, at 120 Hz to 0.075 ms and at 160 Hz to 0.05 ms. Hereinafter there will be explained that the analysis also can be carried out with different sampling times of the speech signal and the signal from the frequency storage 38.

When voiced speech signals are present, prior to the actual analysis the frequency storage 38 is adjusted to the determined fundamental sound frequency and the Fourier analysis of each signal section is carried out in synchronism with the fundamental sound over one or more periods. The multiplication of the individual binary numbers delivered from the frequency storage 38 with the binary numbers sampled from the voice signal occurs in the multipliers M1 sin, M*s* sin to M*n* sin and M1 cos, M2 cos to M*n* cos of the multiplier device 35, which is illustrated in FIG. 4. Under the precondition that for each harmonic frequency there is provided a multiplier, therefore for instance for 40 sine frequencies and 40 cosine frequencies there are required a total of 80 multipliers. A section interval, over which there is carried out the analysis, encompasses for instance 125 binary numbers, corresponding to the sampling time of 0.1 ms and the fundamental sound period $T_{GT}$ = 12.5 ms. During a signal interval which lasts for 30 ms there are to be thus carried out a total of 125 × 80 = 10,000 multiplications. If these multiplications, instead of being simultaneously carried out with 80 multipliers, are carried out with only a single multiplier which can be sequentially switched for all 80 frequencies, then there is available for carrying out a multiplication 30 ms/10,000 = 3 $\mu$s. By carrying out sequential operations it is possible to notably reduce the expenditure required in multipliers.

In order to prevent that the multiplier must be switched or reversed 80 times for each clock pulse $T_H$, for instance the scaled down clock frequency $1/T_H$ could be ten times greater, for instance 100 kHz instead of 10 kHz. With such increased operating frequency it is possible to simultaneously carry out with a total of 8 multipliers the analysis in ten groups each containing 8 harmonic frequencies.

The integrators I1 sin, I2 sin to I*n* sin and Il cos, I2 cos to I*n* cos of the Fourier integrator device 36 of the Fourier analyzer 34 according to FIG. 4 are constituted by standard binary number adders or adder mechanisms, wherein in reality in contrast to FIG. 4 only one is provided or only two are provided, which sequentially carry out the integrations for all determined signal products. Similarly, of the average value computer elements MR1, MR2 to MR*n* which have been shown in FIG. 4 there is provided for instance only a single one which sequentially calculates all of the average values which characterize the Fourier coefficients C1, C2 to C*n*.

Figure 11:
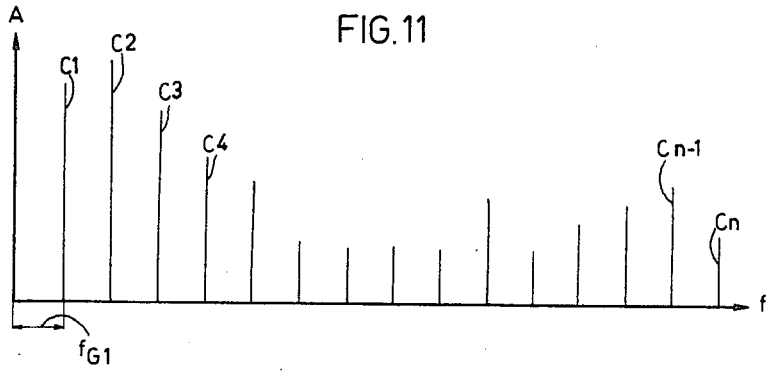
FIG. 11 illustrates the spectrum lines of a speech or voice sound.
Figure 12:
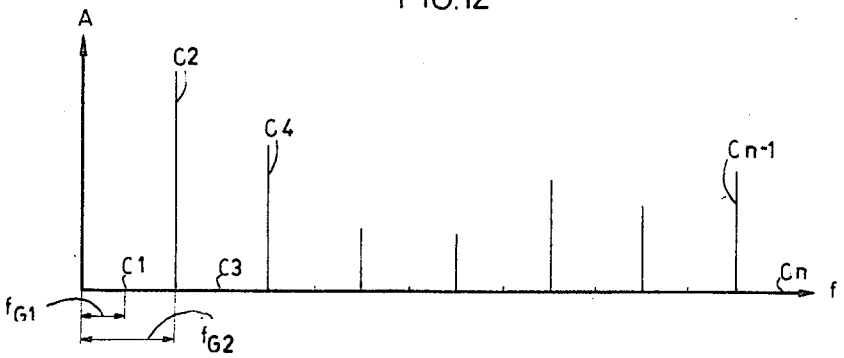
FIG. 12 illustrates the same speech sound as in FIG. 11, however with twice the fundamental frequency.

With the above-disclosed technique for determining the fundamental sound, i.e. for scanning or sampling the time distance $\Delta t_x$ with maximum autocorrelaton, there can be obtained as the result the fundamental sound period $T_G$. Therefore the subsequent analysis can be carried out with the correct fundamental sound frequency $f_G$ or with a sub-harmonic thereof. In FIG. 11 there is illustrated the spectrum of a voiced speech signal with the fundamental sound frequency $f_{G1}$, which speech signal is analyzed with the correct fundamental sound frequency of the frequency storage 38. The individual Fourier coefficients C1, C2 to C*n* are exactly determined. In FIG. 12 there is plotted the spectrum of a voiced speech signal with twice the fundamental sound frequency $f_{G2}$, which signal is analyzed with a false fundamental sound frequency $f_{G1} = f_{G2}/2$ of the frequency storage 38. Nonetheless the result is correct since during the analysis the uneven Fourier coefficients C1 = 0, C3 = 0 and so forth are determined. This method is then permissible when the Fourier coefficient C1 to C*n* determined for each frequency of the frequency storage 38 is also transmitted.

Naturally, the fundamental frequency contained in the frequency storage 38, instead of only being changed over a single octave, also could be changed over all 4 to 6 octaves of the human speech. This would however cause unnecessary technical difficulties. In the event value is placed upon the fact that there should be determined and transmitted the actual fundamental sound, there nonetheless can be maintained a variation range of the frequency storage 38 only over one octave, when an octave coefficient or factor, which possesses the value 1–6 and, for instance, is transmitted as a three place binary number.

If in the voice character and fundamental sound analyzer 68 the voice signal is recognized as a voiceless sound, then with the gate 89 open there appears the binary value 1, characterizing the voiced/unvoiced information coefficient 69, at a line or conductor 80 which leads to the frequency storage 38. Consequently, the fundamental frequency of the frequency storage 38 is set to a constant value of for instance $f_G = 60$ Hz. The analysis is then carried out with this fundamental sound. In the case of voiceless sounds there does not exist any harmonic frequency spectrum, rather a spectrum with noise characteristic.

The Fourier coefficients which are determined over a signal interval correspond to the frequency portions in the neighborhood of the individual frequencies delivered by the frequency storage 38. Since the portions do not coincidentally mutually eliminate one another or produce over the integration time the value null, there can be taken into account, instead of the final or terminal value, also a maximum correlation value which has occurred during integration, for instance the correlation value $KW_3$, as best recognized by referring to FIG. 7. This taking into account occurs in the parameter signal computer 67 by storage of the maximum correlation value which has occurred over the signal interval. For the multiplication and the formation of the average value $\sqrt{A^2 + B^2}$ there is preferably employed an electronically stored dual-logarithm table, the argument and function values of which can be electronically introduced and retrieved. The function values $y = \log x$ for the argument $x = 1$ to $x = 2$ are retrievably stored, for instance, as a six place binary number in a storage, which preferably is designed in LSI-technique (large scale integration technique). The $x$-and $y$-values which are stored in the form of binary numbers can be directly addressed by means of known decoding circuits by means of externally introduced binary number values.

The use of the electronic stored dual logarithm table affords the advantage that a multiplication can be carried out by means of an addition, with the result that the multiplication time can be considerably shortened. The table range from $x = 1$ to $x = 2$ is adequate, because values located outside thereof can be shifted into the table range due to displacement of binary places. Furthermore, there are realized the still further advantages.

If the table range of $x = 1$ to 2 is subdivided for instance into 128 partial regions or increments of the same distance or spacing, then a partial region at the upper edge of the table corresponds to a percentual change of about 0.4% and at the lower edge of the table to about 0.8%. The ratio of the changes from partial region to partial region therefore at most is 1 : 2, whereas this relationship or ratio when using a base 10 logarithm system is 1:10. It is therefore not necessary to change the resolution of the $x$-argument over the range of the table, and such for instance would be the case when using a base 10 logarithm i.e. a common system of logarithms. The mathematical operations such as squaring and forming roots are considerably simplified. The squaring operation in logarithms corresponds to a multiplication by the value 2, and the square root corresponds to a division by the value 2, and multiplication by or division with the value 2 in a binary number system corresponds to a shifting of the decimal point to a higher or lower position. Consequently, such type operations can be carried out in a few microseconds, so that for the entire installation there are only necessary a few such tables.

The Fourier coefficients C1 to C*n* derived at the Fourier analyzer 34, arrive for instance in the form of six place binary numbers at the parameter signal computer 67. These Fourier coefficients are valid, for instance, for a signal interval and are newly determined for each further signal interval. There can be used two variants:

a. The Fourier coefficients are processed through the parameter signal computer 67 without change and arrive directly at the cipher-decipher device 22.

b. At the parameter signal computer 67 there is formed the average value from, for instance, two harmonic frequencies neighboring the Fourier coefficients and such average value arrives as a composite or combined coefficient in the form of a binary number at the cipher-decipher device.

The variant (*b*) has the advantage that there is a lesser amount of information content which is to be transmitted and the drawback of the less exact reproduction of the frequency spectrum at the receiver end. Since it is not the primary objective of the installation to get by with a minimum of information content or intelligence to be transmitted, the variant (*a*) is preferred and this variant will now be described hereinafter.

Figure 3:
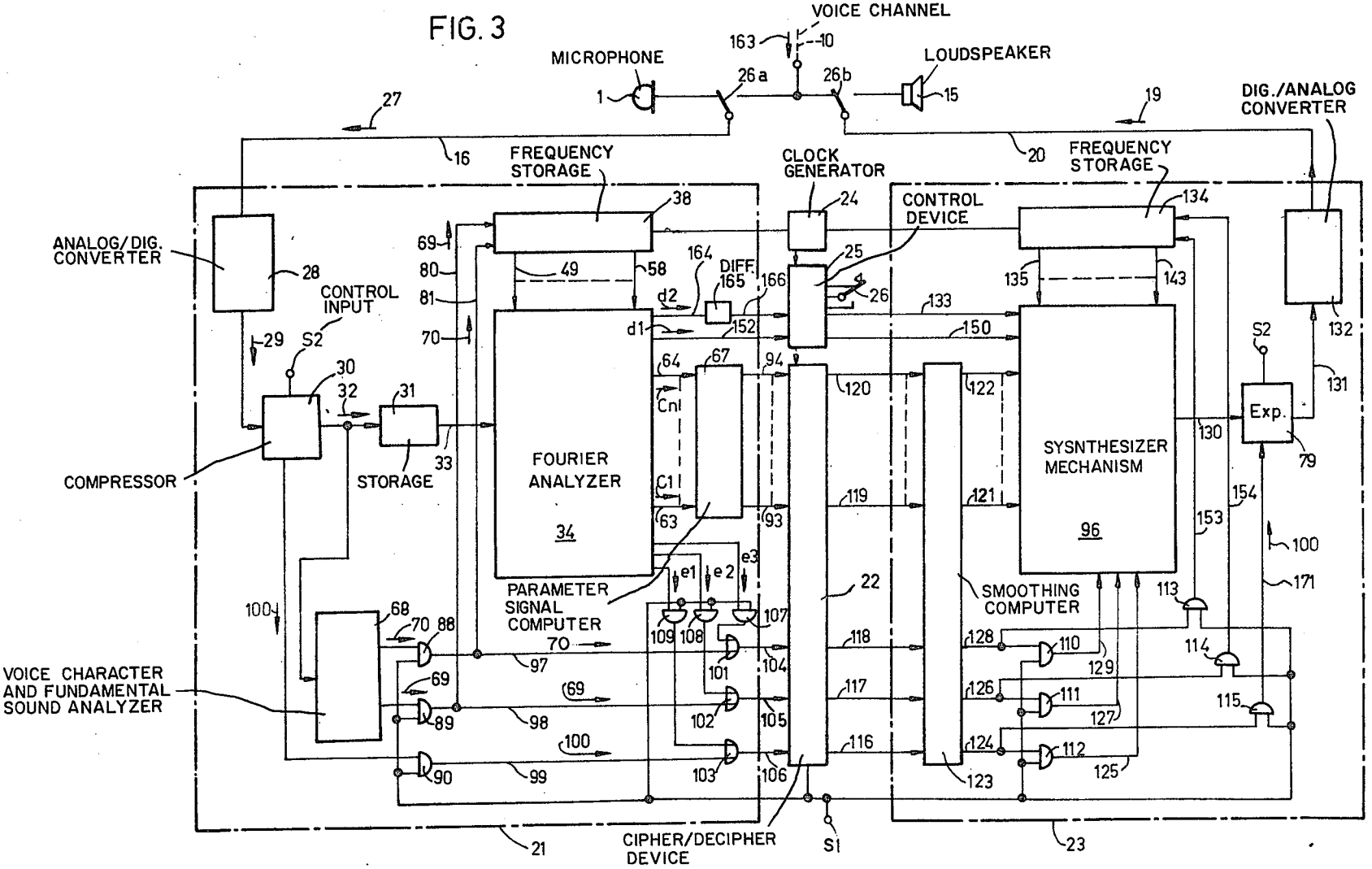
FIG. 3 is a schematic block diagram of the installation depicted in FIG. 2 but showing further details.

The input of the cipher-decipher device 22 has delievered thereto for each voice signal interval, for instance, of 30 ms. the following parameter signals:

via a number of lines or conductors 93, 94, of which only two have been portrayed in FIG. 3, the Fourier coefficients C1 to C*n*, for instance in the form of six place binary numbers, via a conductor 97, a gate 101 and a conductor 104, the fundamental sound pitch coefficient 70, for instance as an eight place binary number, via a conductor 98, a gate 102 and a conductor 105, the voiced/unvoiced information coefficient 69, for instance as a one-place binary number, and via the conductor 99, the gate 103 and a conductor 106, the regulation value 100 generated by the compressor 30, for instance as a two- or three-place binary number.

It is to be observed that when the installation is set to operate in the transmitting mode, the potential of the point or junction 51 is maintained by the control device 25 at a voltage which corresponds to the logical value 1, and the gates 107 to 109 and 113 to 115 are closed. For ciphering such one to eight place binary numbers, which characterize the parameter signals, a pseudo-random number of a ciphering program is now associated with each of the binary numbers at the cipher-decipher device 22, wherein the pseudo-random number again is a binary number with at least the same number of places as the binary number to be enciphered, that is to say, a one-place binary number has associated therewith at least a one-place pseudo-random number and a six-place binary number has associated therewith at least a six-place pseudo-random number of the ciphering program.

For cryptological reasons the ciphering result, that is to say, the ciphered number, should not exceed the amplitude range of the pseudo-random numbers. The amplitude range, with a one-place binary number, amounts to two amplitude stages, for a three-place binary number to eight amplitude stages, for a six-place binary number to 64 amplitude stages, and for an eight-place binary number to 256 amplitude stages. Ciphering takes place by addition of the binary numbers to be coded with the associated pseudo-random number of the cipher program, whereby upon exceeding the amplitude range only the excess, not however the amount brought forward, is to be taken into account. In the case of a one-place binary number with an amplitude range encompassing two amplitude stages, there can be employed for ciphering a modulo-2-addition, the result table of which is given hereinafter:

| Binary Number | Random Number | Result |
|---|---|---|
| 0 | 0 | 0 |
| 1 | 0 | 1 |
| 0 | 1 | 1 |
| 1 | 1 | 0 |

Deciphering likewise occurs with modulo-2-addition of the ciphered number with the pseudo-random number of the ciphering program and as the result produces the original binary number.

In the case of a six-place binary number with an amplitude range of 64 amplitude stages, there is employed for ciphering the modulo-64-addition. During ciphering the pseudo-random number of the ciphering program is added to the binary number and there is produced as the sum or as the excess beyond 64 the ciphered number. During deciphering the pseudo-random number is subtracted from the ciphered number and produces, after possibly adding the range number 64, the original binary number. In the table given hereinafter there are set forth a number of values which respectively occur during ciphering and deciphering an amplitude range with 64 amplitude stages.

| Ciphering | | | Deciphering | | |
|---|---|---|---|---|---|
| Binary Number | Pseudo-Random Number | Result | Ciphered Number | Pseudo-Random Number | Binary Number |
| 25 | 17 | 42 | 42 | 17 | 25 |
| 48 | 39 | (87–64) 23 | 23 | 39 | (−16+64) 48 |

If during ciphering the result exceeds the number 64, then the excess beyond 64 (for instance 23) is used as the result. If during deciphering the result becomes negative (for instance −16) then there is added thereto the number 64. If in the table the words "ciphering" and "deciphering" and also "binary number" and "result" are interchanged, then the process described above for deciphering can be used for ciphering and the process described for ciphering can be used for deciphering. Both of these types of ciphering and deciphering techniques also can be used mixed and controlled by the cipher or coding computer.

At the output lines or conductors 116–120 of the cipher-decipher device 22 there appear the ciphered or coded parameter signals as ciphered numbers, wherein for each nine signal intervals (for instance 30 ms) there is coded with different pseudo-random numbers. If the parameter signals, for instance as explained in the example, are binary numbers possessing one, two, six and eight places, then all can be coded with modulo-$2^8$, and there is no loss in the security of the cryptograph. In order to obtain a large transmission security there is preferably chosen the same for all binary numbers the highest occurring amplitude value, for instance 256. The place significance is accommodated to the common amplitude range such that the highest occurring binary number values of the different place parameter signals possess the following values:

| | |
|---|---|
| For one-place binary numbers | 10000000.0 |
| For two-place binary numbers | 11000000.0 |
| For six-place binary numbers | 11111100.0 |
| For eight-place binary numbers | 11111111.0 |

These ciphered parameter signals arrive through the agence of the conductors 116–120 at a smoothing computer 123 of the voice synthesis device 23. If the installation is in its transmitting mode, then the ciphered parameter signals arrive without change via the conductors 124, 125; 126, 127; 128, 129 as well as via a number of conductors 121, 122, of which only two have been illustrated, at the multipliers MR, MS, MG as well as $MC_1$, $MC_2$–$MC_n$ of a multiplier device 95 which is part of a synthesizer mechanism 96 which belongs to the synthesizer device 23. The multiplier device 95 has been depicted in greater detail in FIG. 5. The synthesizer device 23 has operatively associated therewith a frequency storage 134 which delivers its own harmonic frequencies, and which frequency storage is connected via the conductors 135–143 with the multipliers of the multiplier device 95, wherein each mutliplier has delivered thereto a particular harmonic frequency. The fundamental frequency of the frequency storage 134 is constant when the installation is in its transmitting mode. This fundamental frequency is lower than the lowest fundamental sound of the spoken voice and preferably is at 60 Hz. The clock frequency with which the frequency storage 134 is operated is, for instance, 10 kHz, so that for each frequency the binary numbers which portray the momentary values can be readout at a cycle of 10 kHz, corresponding to a clock period $T_H = 0.1$ ms.

If there is used a fundamental frequency of 60 Hz, then there can be transmitted approximately 50 harmonic frequencies over the transmission channel 10 having a bandwidth of 300–3300 Hz. The amplitudes of such harmonic frequencies can be modulated proportional to the individually enciphered parameter signals by means of the multipliers and with each of the 50 harmonic frequencies there can be transmitted the information of a parameter signal in the form of the amplitude of the relevant frequency. The modulated frequencies appear at the conductors or lines 144–149 and are delivered to the summation element 151 where the individual binary numbers of the different frequencies are continually added or summed. The summation signal appearing at the output line 130 of the summation element 151 consists of a sequence of binary numbers with the sampling rate of, for instance, 10 kHz which is determined by the clock frequency of the frequency storage 134. This output signal arrives through the agency of the expander 79 which is ineffective when the system is functioning in its transmitting mode and via a conductor or line 131 at a digital-analog converter 132. In this digital-analog converter the digital signal is transformed into analog form and is delivered as a transmission signal 19 via the conductor 20, the reversing contact **26*b* to the voice channel 10.**

In each case over a signal interval of, for instance, 30 ms length the amplitudes of the individual harmonic frequencies are constant, and specifically in accordance with the associated value of the ciphered parameter signals. These amplitudes assume a new value during the next signal interval. When the lowest fundamental sound of the spoken speech amounts to 80 Hz, then in the frequency range of 300–3400 Hz, there are to be transmitted in an enciphered condition at most about 40 Fourier coefficients. Apart from such, there are also the fundamental sound pitch coefficient, the voiced/unvoiced information coefficient, and the regulation value, in other words, a total of 43 values. With the 50 harmonic frequencies there can be still further transmitted seven values, that is to say, seven bits of information, each with a respective harmonic frequency. Such can be a synchronization signal produced via a line 133 from the control device 25 and sampled with the aid of the multiplier MSY, and which synchronization signal is delivered via line 160 to the summation element 151, as best seen by referring to FIG. 5. This synchronization signal is alternatively sampled from signal interval to signal interval at null and at maximum amplitudes and graphically illustrated in line *c* of FIG. 13C, and a pseudo-random signal 167 which is sampled via a line 150 from the control device 25 with a multiplier MPZ, and which signal 167 is delivered via a line 159 to the summation element 151 and shown in line *e* of FIG. 13E. This signal is likewise sampled in each case over an entire signal interval $T_A$ for 0 or maximum value 1, wherein the sequence of 0 and 1 is pseudo-coincidental and dependent upon date and time of an electronic digital clock in the control device 25, upon a secret code and upon the ciphering computer in the ciphering and deciphering device 22. The pseudo-random signal 167 serves for the automatic synchronization of the receiver endciphering and deciphering device 22 and its cipher computer.

Possibly further synchronization signals alternately sampled by the control device for 0 and 1, of which their associated frequencies of the frequency storage 134 are divided over the bandwidth of the voice channel 10, in other words from one extremity or side of the band over the center of the band to the other extremity or side of the band. One such sampled synchronization signal in the neighborhood of the lower band limit has been plotted in line *d* of FIG. 13D and specifically the received signal following transmission. The larger transmission-transit time at the band extremity brings about a time displacement by the transit time value $T_L$. Such synchronization signals which are introduced as a function of frequency between the parameter signal signals, for instance line *a* in FIG. 13A, permits the determination of the relative transit time over the transmission bandwidth and allows for the proper setting of the evaluation time of the received frequencies. Moreover, they also allow the determination of the frequency-dependent dampening in the voice channel and for the compensation thereof.

Furthermore, redundancy signals can be transmitted. Paticularly important parameter signals such as fundamental sound coefficients, voiced/unvoiced information coefficient and possibly regulation values can be redundantly transmitted by means of two or three frequencies of the frequency storage 134, wherein such frequencies can be in different transmission ranges.

The frequency storage 134 of the signal synthesizer 23 can be constructed in the same manner as the frequency storage 38 of the signal analyzer 21, however the cosine frequencies are not required. Similarly the multiplier device or mechanism 95 of the signal synthesizer 23 can be similar to the multiplier device 35 of the signal analyzer 21. Similar to that situation, instead of using the many individual multipliers there can be provided only one or a few such multipliers if the multiplication operations are sequentially carried out.

The summation element 151 can consist of a single binary number adder. The trasmission signal 19 delivered to the transmission channel 10 therefore consists of a harmonic frequency mixture with, for instance, 50 constant frequencies which are derived from a constant fundamental frequency of for instance 60 Hz. The information to be transmitted, that is to say, the coded or ciphered parameter signals, lies wihin the amplitude of such individual frequencies. These amplitudes are constant for a signal interval $T_H$ of, for instance, 30 ms and can change from signal interval to signal interval. The transmission signal 19 has the character of a voiced sound with constant fundamental frequency at least for each signal interval and also can be analyzed similar to such a signal at the receiver side.

Figures 13A, 13B, 13C, 13D, 13E, 13F, 13G:
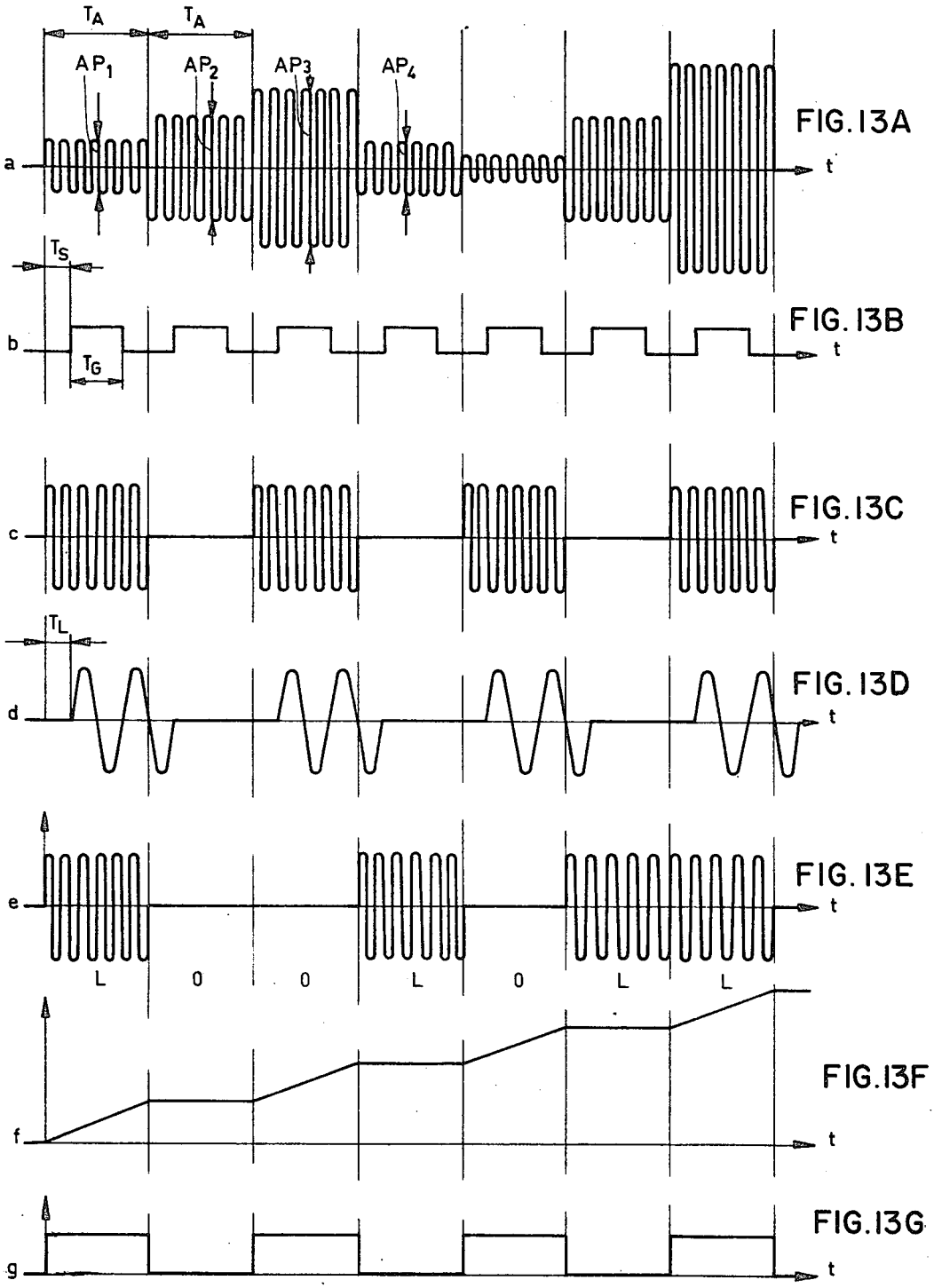
FIG. 13, which embodies FIGS. 13A to 13G, graphically illustrates a frequency of the transmission signal as well as signals for generating, transmitting and reobtaining a synchronization signal.

In line a of FIG. 13A there is plotted the possible course of one such frequency modulated by a ciphered parameter signal. Owing to the ciphering, the sequence of the amplitudes AP1, AP2, AP3, AP4... and so forth has a pseudo-random characteristic. The individual ciphered parameter signals can possess a different number of amplitude stages, for instance the Fourier coefficients 64 amplitude stages (6 bits), the fundamental sound pitch coefficient 256 amplitude stages (8 bits), the voiced/unvoiced information coefficient two amplitude stages (1 bit), the regulation value four amplitude stages (2 bits) and the synchronization signals two amplitude stages (1 bit).

The fundamental sound pitch coefficient also can be transmitted with two harmonic frequencies each having 16 amplitude stages (each with 4 bits) in order to overcome the high accuracy requirements of 256 amplitude stages. The amplitude surges from one signal interval to the next, as seen by an inspection of line *a* of FIG. 13A, can be rounded prior to multiplication by means of the smoothing computer 123, as will be disclosed more fully hereinafter for the receiving mode of operation.

The first four types of coefficients, which have been coded or enciphered, however also as explained above, can be present by enciphering in the same amplitude range and in the same stage, producing certain advantages regarding uniformity of the transmission signal 19. This transmission signal, after transmission to the receiver part or side, is to be analyzed with a similar apparatus, the ciphered parameter signals are to be deciphered and there is to be formed the synthesized clear speech or voice.

At the receiver end there is located an identical apparatus as has been depicted in FIG. 3, only with the difference that the operation selector switch 26 is now shifted so that the system operates in the receiving mode. Consequently, all of the gates which are coupled with the control device 25 and which previously were conductive are now blocked and all of the gates which were previously blocked are now conductive. The transmission signal 19 originally introduced into the voice channel 10 is received as a transmission signal 163 which is somewhat modified due to the transmission.

By means of the reversing contact 26*a*, the transmission signal 163 arrives at the analog-digital converter 28 which transforms the received transmission signal into digital form, that is, into a sequence of binary numbers which characterize the amplitude values. This transformation occurs for instance at a rate of 10,000 binary numbers per second.

This transformed digital signal arrives at the compressor 30 which has been switched by the control device 25 via the input S2 into the receiving operating mode and accordingly functions in the following manner: from the digital signal delivered to this compressor 30 there is formed with a relatively large time-constant, thus for instance over 8 signal intervals of 30 ms length and a total of, for instance, 2048 binary numbers, the signal mean or average value through the addition of all binary numbers and the division by 2048, which division corresponds to place shifting of the binary summation number by 11 places. If the thus obtained average value $A_{MW}$ deviates from a prescribed signal reference value $A_{SW}$, then it is regulated from signal interval to signal interval to the reference or rated value by multiplication with the value $A_{SW}/A_{MW}$. For these calculations there can be employed for instance the abovementioned electronic dual logarithm table. This regulation has the function of compensating changes in the transmission path in order to carry out the signal analysis at the receiver end always with the same signal peak.

It is to be observed that the pseudo-random input signals always possess a constant average value due to the effect of the transmitter side-enciphering over a longer time interval or period of time, completely independent of whether the clear voice was loud or soft or whether there were pauses in the speech.

The regulated, digital signal arrives via the short-time storage 31, which is not needed for the receiving mode of operation, as an input signal 32 at the Fourier analyzer 34 where there is derived from the harmonic frequency mixture the Fourier coefficients, which coefficients characterize the ciphered parameter signals. This analysis is carried out in the same manner as described above for the transmitting mode for the speech analysis, but with the following slight differences:

a. the fundamental frequency of the frequency storage 38 is constant and amounts, for instance, to 60 Hz. This fundamental frequency is similar to that of the transmitter side-frequency generator 134. A deviation therefrom will be described more fully hereinafter in conjunction with the carrier drift compensation. All harmonic freqencies of the frequency storage 38 are constant and the same for all signal intervals.

b. the voice character-fundamental sound analyzer 68 is placed out of operation and the gates 88, 89 and 90 are blocked.

c. the analysis duration in the Fourier analyzer 34 per signal interval is constant and for each signal interval amounts to one period of the fundamental frequency, therefore the instance to 16.66 ms.

d. the clock frequency of the frequency storage 38 is normally a whole multiple of the fundamental frequency.

The analysis duration, which corresponds to a period $T_G$ of the fundamental frequency, should be placed into a middle region of the signal interval $T_A$ in order, on the one hand, to be insensitive to transmit time differences and, on the other hand, to be insensitive to signal distortions in the voice or speech channel brought about by the transient effects at the start and end of the signal intervals due to the band limits. With an analysis duration of 16.6 ms and a signal interval of 30 ms there can be processed transit time differences of a maximum of 13.4 ms. There is delayed the analysis range of the frequencies to be analyzed which are located at the region of the transmission channelband limits in contrast to the frequencies located at the center of the band. A simple technique to carry this out will be explained more fully hereinafter.

For determining as a function of time the analysis range in the signal interval it is possible to use the sampled synchronization signal contained in the input signal, according to line *c* of FIG. 13C. The Fourier coefficient *d*2 (FIG. 3) of this signal is continuously derived, without any interval limitations and its course has been plotted in line *f* of FIG. 13F. This continuously increasing value is of course reset to null at some point in time. The coefficient *d*2 appears at a line or conductor 164, see FIG. 3, and is delivered to a differentiator 165 in which there is formed the differential signal as the synchronization signal and delivered via a conductor 166 to the control device 25. The synchronization signal which is obtained in this manner is shown in line *g* of FIG. 13G. The length of a synchronization signal is equal to the signal interval length $T_A$ of for instance 30 ms, which is relatively large and renders the synchronization quite simple. With this synchronization signal and with the aid of the control device 25 there is fixed or determined the integration boundaries as a function of time for the analysis range, i.e. for the parameter signals in the Fourier integration device 36.

In line *b* of FIG. 13B there are plotted the analysis regions or ranges which are effective for each signal interval $T_A$ for the duration of a period $T_G$ of the fundamental frequency. These regions are placed, in the showing of FIG. 13, for instance at the middle of the signal interval $T_A$, so that for instance transit time differences of the signal of the line *a* in the order of magnitude $\pm T_S$ practically do not impair the function. As already mentioned in the case of very pronounced transit time differences it is possible to more or less individually accommodate the analysis region for the different frequencies due to the transmission of synchronization signals introduced over the entire bandwidth, for instance see line *d* of FIG. 13D. With these introduced synchronization signals there also can be determined and compensated the damping over the bandwidth. Generally, however, both of the last-mentioned measures are not necessary. By means of this Fourier analysis of the received signal in synchronism with the fundamental frequency it is possible to really accurately obtain the Fourier coefficients which characterize the ciphered parameter signals. This derivation technique offers the following advantages: there is no phase-dependency of the analysis, easy overcoming of relatively large transit time differences, practically no dependency upon damping distortions, small dependency of short-time disturbances owing to the relatively large integration time, and maintaining the frequency accuracy of the frequency generator with the aid of quartz oscillators is possible in a very simple manner.

The only source of disturbance, to which particular attention should be paid, is the carrier drift which can occur in transmission channels at carrier frequency installations. The difficulties arising therefrom and the elimination thereof will be discussed hereinafter.

At the output of the Fourier analyzer 34 there are obtained as the Fourier coefficients, parameter signals characterized by binary numbers which are sequentially enciphered from signal interval to signal interval: the ciphered Fourier co-efficients (ciphered coefficients Cl–C*n*), the coefficient el as the ciphered fundamental sound pitch coefficient, the coefficient e2 as the ciphered voiced/unvoiced information coefficient and the coefficient e3 as the ciphered regulation value.

These last three coefficients arrive through the agency of the AND gates 107, 108 and 109 respectively, which gates are opened when the system operates in the receiving mode, as well as via the OR-gates 101, 102 and 103 respectively, as the input of the cipher-decipher device 22 for deciphering. The coefficients Cl–C*n* arrive at the parameter signal computer 67 which is normally short-circuited in the receiving mode and thus likewise at the cipher-decipher device. The parameter signal computer 67 in the receiving mode of operation then only has to fulfill one function when the transmission channel is associated with carrier drift, as such will be explained hereinafter.

To decipher the parameter signals there is prepared by the cipher computer of the cipher-decipher device 22 the same cipher program, as a sequence of the pseudo-random numbers, as employed for enciphering and which continuously change from signal interval to signal interval. This change determines the transmitter- and receiver side synchronization of the ciphering or coding computer. In order to ensure for such synchronization there is produced by the transmitter end-apparatus the pseudo-random signal 167 (FIG. 5) and transmitted to the voice channel. This signal, which has been depicted in line *e* of FIG. 13E, is detected by the Fourier analyzer 34 as the coefficient d1 in the analysis region or range $T_G$. This coefficient formation produces a pseudorandom sequence of the binary numbers 1 and 0, wherein for each signal interval there is then present a 1 when the sampled frequency was present and a signal 0 appears when there was not present any frequency. This has been indicated in line *e* of FIG. 13E. Each of these binary numbers is valid for an entire signal interval $T_A$ of for instance 30 ms and therefore the synchronization length is likewise equal to 30 ms, in other words relatively large and the synchronization operation is thus rendered noncritical.

The transmitter end-generated-pneudo-random signal 167 arrives in the form of the received pseudo-random signal d1 via a line 152 at the control device 25 in which there has been held prepared a signal with the aid of the ciphering or coding computer as well as the electronic clock and the secret code, and which signal with the received signal d1 is examined regarding its position as a function of time, compared and finally equalized. In the case where there are provided identical ciphering computers and secret codes at the transmitter end and receiver end the position as a function of time of the transmitter side-generated, transmitted and received pseudo-random signals and the receiver-side generated pseudo-random signals only still differ by the transmission transit time and the deviations of the clock at the transmitter and receiver sides. The transmission transit time amounts to less than 100 ms and the clock deviation with quartz clocks amounts to, for instance, 30 sconds over a six month period.

If it is not desired to reset the clocks during six months, then it would be necessary to store a scanning range of 1000 bits, corresponding to 1000 interval lengths of 30 ms, that is to say, the storage for the sampling-correlation-synchronization must encompass 1000 bits. By means of the correlation-synchronization process, while using the pseudo-random signals, the receiver side ciphering computer is synchonized in fractions of a second and therefore there occurs, in the manner described during ciphering, the deciphering of the parameter signal. These deciphered parameter signal are binary numbers, which are prepared from signal interval to signal interval for voice synthesis. For deciphering it is necessary that the received, ciphered parameter signals possess the correct amplitudes and their binary numbers the correct values, something which, among other things, can be realized by means of the compressor 30 at the receiver side.

The deciphered parameter signals are transmitted via the conductors 116–120 to the smoothing computer 123. This smoothing computer has the function of compensating the surges or jumps of the parameter signal values from one signal interval to the next and to smooth the same. This function is carried out for analog signals by means of low-pass filters, the boundary frequency of which for a interval length of 30 ms is at about 20–30 Hz.

Figures 14A, 14B, 14C, 14D, 14E, 14F:
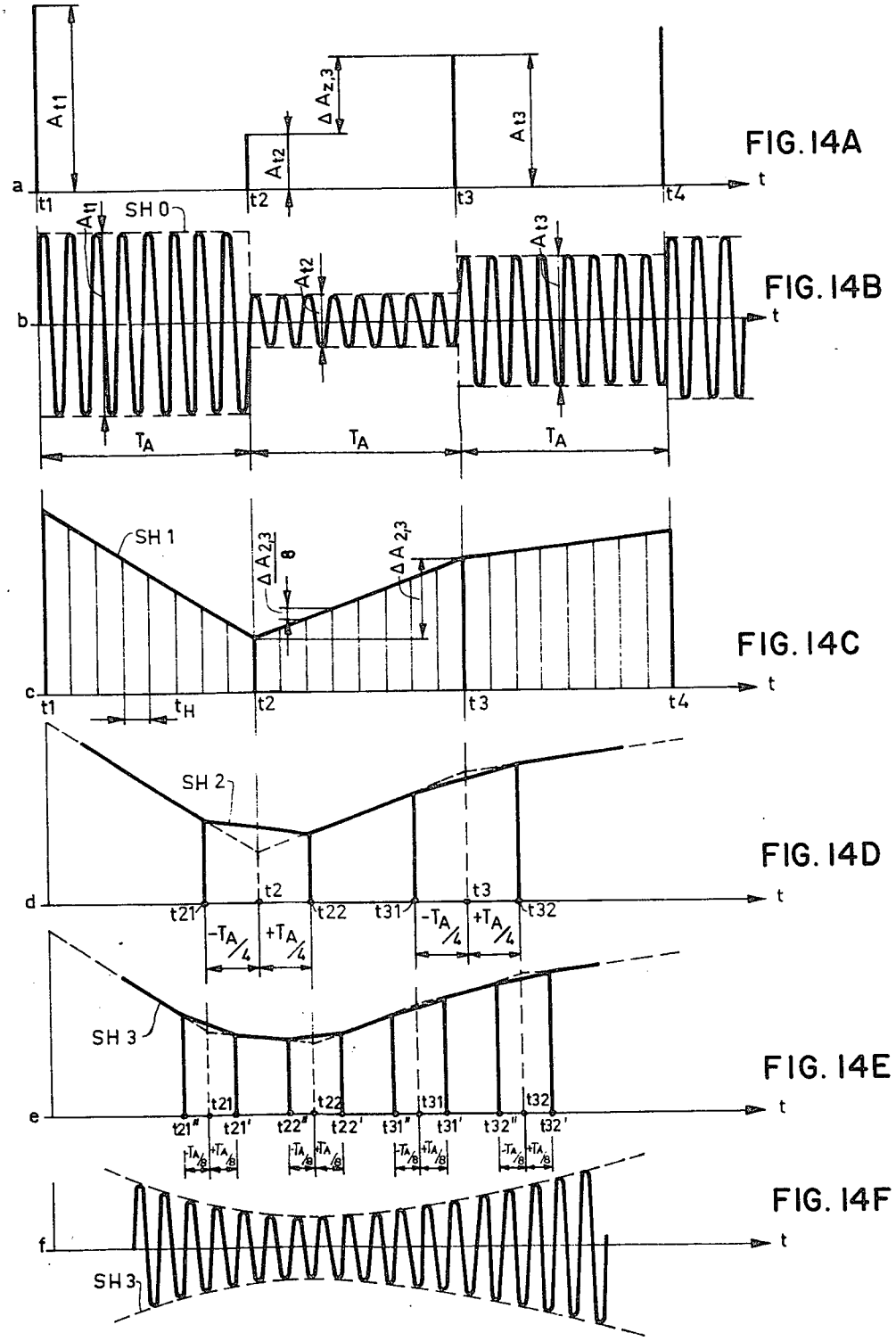
FIGS. 14A to 14F, illustrates signals at different time regions for explaining the function of a smoothing computer of the installation according to FIG. 3.

In line *a* of FIG. 14A there is plotted a sequence of parameter signals, for instance the sequence of Fourier coefficients, which are delivered by the cipher-decipher device 22 as binary numbers with the amplitude values $A_{t1}$, $A_{t2}$, $A_{t3}$ and so forth at the points in time *t*1, *t*2, *t*3 and so forth, at a spacing from the signal interval $T_A$ of for instance 30 ms. If the voice synthesis is carried out such that in the multipliers of the voice synthesizer 96 and the multiplier device 95 the multiplication is carried out in each case for an entire signal interval $T_A$ with a constant parameter signal value, in other words with $A_{t1}$, $A_{t2}$ or $A_{t3}$, then there is produced the frequencies according to line *b* of FIG. 14B which possess a rectangular envelope curve, and the same also analogously holds true for the frequency modulation of the fundamental sound pitch. Such sharp transitions from one signal interval to the next do not of course occur during speech and such transitions are to be rounded, i.e. smoothed. For digital signals there can be used for this purpose digital low-pass filters. But also in the case of other computer programs in the smoothing computer it is possible to realize the desired smoothing effect. A simple computer program of a smoothing computer which processes coefficients which are in the form of a sequence of digital binary numbers will be explained more fully hereinafter with regard to lines c – f of FIGS. 14C to 14F respectively.

In the line *c* of FIG. 14C there are again plotted the coefficients which occur for the signal internal times *t*1, *t*2 and *t*3 with the amplitude values $A_{t1}$, $A_{t2}$ and $A_{t3}$. In this simplified example for each signal interval $T_A$ there are provided eight binary numbers (sampling values) for the speech to by synthesized. In reality there are for instance 256 sampling values which appear over an interval length of 20–30 ms, wherein the sampling or scanning period $T_H$ amounts to 0.1 ms and accordingly the sampling frequency amounts to 10 kHz. The interval between each two respective computed coefficients spaced from a signal interval $T_A$ of for instance 25.6 ms should now be filled with binary numbers, which correspond to sampling values, at a spacing according to the sampling period $T_H$ of for instance 0.1 ms, the envelope curve of which is smooth. The computer program for the smoothing computer 132 consists of the following computation steps.

First step: The determination of the difference $\Delta A$ of the amplitude values of the parameter signals of two neighboring signal intervals, for instance at the time points *t*1 and *t*2, by subtraction of two binary numbers for instance $\Delta A_{2,3} = A_{t3} - A_{t2}$. This difference is linearly subdivided over the introduced sampling value by dividing by the number of sampling periods, in the example of FIG. 14 by dividing by the number eight. The number of sampling periods is advantageously selected for instance at $2^3 = 8$ or $2^8 = 256$, since then the division can be simply carried out by shifting the decimal place. In the example according to FIG. 14 the division $(\Delta A_{2,3}/8)$ is carried out by shifting the decimal place of the binary number $A_{2,3}$ by three places. The result from $(A_{2,3}/8)$ from the time point *t*2 starting from the left towards the right, is added to each subsequent value. The entire operation constitutes a linear interpolation and the result is the envelope curve SH1 portrayed in line *c* of FIG. 14C.

Second step: The determination of two new base values at the envelope curve SH1 at a spacing of $\pm T_A/4$ from *t*2 and *t*3 respectively, and the renewed interpolation between these new base points *t*21 and *t*22 as well as *t*31 and *t*32 according to the method of the first step. From this there results the envelope curve SH2 which has been portrayed in line *d* of FIG. 14D.

Third step: The determination of two respective new base points at a spacing of $\pm T_A/8$ from *t*21, *t*22, *t*31 and *t*32 and the linear interpolation between these new base points *t*21″, *t*21′ as well as *t*22″, *t*22′ as well as *t*31″, *t*31′ as well as *t*32″, *t*32′. There thus results the envelope curve SH3 according to line *e* of FIG. 14E. With the sampling values of this envelope curve there are modulated the harmonic frequencies and the smoothed signal is illustrated in line *f* of FIG. 14F.

Smoothing can be continued by using the same principal with further base points, however for most applications such is not necessary. The above-described smoothing computation technique is extremely simple and as a practical matter affords sufficient smoothing results. At the output of the smoothing computer 123 there thus appear the ciphered parameter signals as a sequence of binary numbers in cycle with the scanning frequency of for instance 10 kHz, the envelope curve SH3 of which has been formed from the original rectangular envelope curve SHO of the parameter signals by the above-described smoothing process. In the smoothing computer 123 there are stored the calculated intermediate values over two signal interval lengths and are transmitted with a sampling cycle of, for instance, 10 kHz to the multiplier device 95.

Normally, there is associated with each harmonic frequency during the synthesis a respective parameter signal. However, there was previously described a variant embodiment where after the transmitter side speech analysis at the parameter signal computer, there are grouped together for instance harmonic frequencies neighboring two respective Fourier coefficients into a composite or combined coefficient by carrying out the formation of an average value. In this case, this composite coefficient is to be delivered to two multipliers of neighboring frequencies and these frequencies are modulated by the composite coefficients. Normally the voiced/unvoiced information coefficient and the regulation value are not smoothed. However, in certain cases smoothing of the regulation value is of advantage, whereby then the expansion must be carried out in the expander 79 by means of a multiplier circuit.

The synthesized speech is obtained by multiplication of the amplitudes of the individual harmonic frequencies of the frequency storage 134 by the deciphered Fourier coefficients. According to FIG. 5, such multiplication takes place at the multipliers MC1, MC2–MC*n*. In the receiving operating mode the multipliers MSY, MPZ, MG, MS and MR are out of operation. The multiplication occurs individually for each scanning or sampling value, that is to say, by multiplication of the binary number of the frequency momentary value with the binary number of the value of the Fourier coefficient calculated at the smoothing computer 123 with the sampling rate of for instance 10 kHz.

The calculated products arrive, with the same sampling rate, as binary numbers at the summation element 151, where they are continuously added and as the result deliver the synthesized version of the speech in digital form to the output line 130.

For the speech or voice synthesis, there primarily arise both of the following situations: voiced sounds with harmonic frequency spectrum and defined fundamental sound pitch as well as voiceless sounds with noise spectrum.

Initially there will be treated the situation of voiced sounds. In the case of voiced sounds there is determined at the transmitter side the fundamental sound pitch and transmitted in a coded or ciphered state as the fundamental sound pitch coefficient and deciphered at the receiver part or end.

From the smoothing computer, in which smoothing occurs in the above-described manner, the fundamental sound pitch coefficient in the form of a sequence of binary numbers arrives with a scanning or sampling rate of, for instance 10 kHz via the conductor 128, the gate 113, which is opened in the receiving mode, and a conductor 153 at the frequency storage 134, in order to control its fundamental frequency. Such control of the fundamental frequency can take place by means of the apparatus or device 82, depicted in FIG. 10, which is contained in the frequency storage 134. There is delivered to the apparatus 82 via the conductor 81 the signal at the conductor 153. This apparatus is also suitable for handling continuously changing fundamental sound pitch coefficients, as such emanate from the smoothing computer 123. Each new clock pulse $T_H$, at interval ranges of for instance 0.05 – 0.1 ms, with each new scanning or sampling value of the fundamental sound pitch coefficients can be individually set due to the action of the apparatus 82, so that there is possible a practically continuous change of the fundamental frequency. The entire harmonic frequency spectrum can be continuously varied in this manner in the fundamental sound pitch, as such is the case for voiced sounds.

In the case of voiceless sounds, there appears at the conductor 153 the binary value 0. The deciphered voiced/unvoiced information coefficient is delivered as the binary value 1 from the output of the smoothing computer 123 via the conductor 126, the gate 114 and conductor 154 to the frequency storage 134. With this signal at the line 154 and which is in the form of a binary 1 the frequency storage 134 is caused to deliver a noise spectrum, the spectrum portions of which however can be modulated with the Fourier coefficients via the multipliers MC1, MC2–M*cn* for generating a noise spectrum with modulatable envelope curve. This operation will be explained more fully hereinafter in conjunction with FIGS. 15 and 16.

Figure 15:
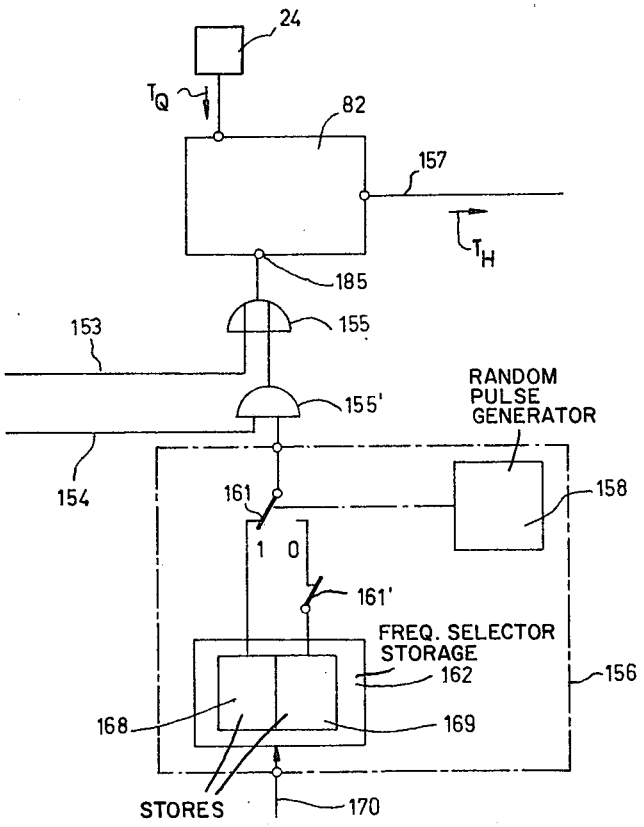
FIG. 15 schematically illustrates a block diagram of an apparatus for producing voiceless sounds.

The frequency storage 134 contains a circuit of the type disclosed in FIG. 15, possessing an apparatus 82 according to the showing of FIG. 10 and delivering clock pulses $T_H$ of variable clock period for controlling the frequency storage.

As above described, in the case of voiced sounds, the voiced/voiceless information coefficient is delivered via line or conductor 153 to the frequency storage 134, which coefficient determines the clock period $T_H$. In the cases of voiceless sounds, there is present at the line or conductor 153 a binary signal 0 and at the line 154 a binary signal 1, with the result that the gate 155 becomes conductive and thus the output of the circuit component 156 switches through.

This circuit component has the purpose of forming the sequence of clock pulses $T_H$, which appear at the output line 157 of the apparatus 82, such that the frequency storage 134 which is controlled thereby delivers a noise spectrum with modulatable envelope curve. The circuit component 156 contains a random pulse generator 158 which switches back and forth as a function of time an electronic reversing switch 161 as a function of the laws of chance or pseudo-chance between the positions 1 and 0. A section of one such random or chance program for controlling the reversing switch 161 has been shown in line *a* of FIG. 16A. A frequency selector storage 162, see FIG. 15, contains two partial stores 168 and 169, in which there is stored a respective binary number as the clock frequency-preselection or preset value, for instance an eight place binary number corresponding to a certain clock period $T_H$. In the position 1 of the reversing switch 161, the preselection value stored at the partial storage 168 arrives at the input 185 of the apparatus 82 and in the position 0 the preselection value stored at the partial storage 169 arrives at the input 185 of the apparatus 82. In this way the clock signal $T_H$ is sampled as a function of the position of the reversing switch 161 and the random pulse generator 158. One such type of sampled clock signal $T_H$ has been shown in line *b* of FIG. 16B. In this illustration the clock periods $T_{H1}$ and $T_{H2}$ have been shown markedly different from one another for clarity purposes. In reality, their relative difference only amounts to about 5% or 10%. If the reversing switch 161 is continuously left in the position 1, then there is continuously generated the one switching frequency with the clock period $T_{H1}$, and if on the other hand the reversing switch 161 is continuously left in the position 0, then there is produced continuously the other switching frequency with the clock period $T_{H2}$.

In the frequency plan according to the showing of line *c* of FIG. 16C, there appear at the outputs 135–143 of the frequency storage 134, the frequencies marked by the arrows OF1, OF2, OF3 and so forth, when the reversing switch is in the position 1 and the frequencies marked by the arrows UF1, UF2, UF3 and so forth, when the reversing switch 161 is in the position 0. The spacing between two associated marked frequencies which are located symmetrically with regard to the harmonic frequencies HF1, HF2, HF3, and so forth, are proportional to the order number of the harmonic frequencies, in other words for the first harmonic HF1 there is valid the spacing $H_{T1}$, for the second harmonic HF2 there is valid the spacing $H_{T2} = 2\ H_{T1}$, for the third harmonic HF3 there is valid the spacing $H_{T3} = 3\ H_{T1}$, and so forth. If the clock frequency switching occurs as a function of the random signal, there then continally appear frequency spectrums, the envelope curves HK1, HK2, HK3 and so forth of which are symmetrically arranged with regard to the harmonic freqencies HF1, HF2, HF3 and so forth and at that location accordingly have their maximum value.

As can be recognized from line *c* of FIG. 16C, the bandwidth of such continuous frequency spectrum is approximately proportional to its frequency, so that with harmonic frequencies which are divided with constant frequency spacing there is not realized any uniform, continuous frequency spectrum over the entire bandwidth. By means of a variant of the invention described hereinafter, there can be realized a uniform noise spectrum.

First variant: The fundamental frequency of the frequency storage 134 is selected to amount to for instance 60 Hz. At the range of about 500 Hz there is employed each harmonic frequency and the frequency spacing $H_{T1}$ and the random signal are chosen such that there are produced the overlapping envelope curves with the same frequency spectrum. At the range of about 1000 Hz there is used each second harmonic frequency, and at the range of about 1500 Hz each third harmonic frequency, and so forth.

Second variant: Such can be used with a special frequency storage which will be described more fully hereinafter, in which for each signal interval there is generated in sequence one harmonic frequency after the other. Thus, by means of individual frequency variation of the clock preselection values, which are stored at the partial storages 168 and 169, there can be varied via an input 170 the switching keying cycle from frequency to frequency such that the frequency spacing $H_T$ for all harmonic frequencies remains constant, and in this regard attention is invited to line *d* of FIG. 16D. This frequency spacing $H_T$ and the random signal are chosen such that the addition of the partial spectrum encompassed by the envelope curves HK1, HK2, HK3, and so forth produces a uniform, continuous noise spectrum for the same Fourier coefficients, so that for instance the bit rate of the random signal according to line *a* in bit/sec. = 1.5 $H_T$ (in Hz).

A similar envelope curve distribution, as such has been illustrated in line *d* of FIG. 16D, can be obtained if a switch 161' depicted in FIG. 15 is opened and there is only produced an amplitude-sampled clock frequency according to line *e* of FIG. 16E. Consequently, the frequency storage generates so-called ON/OFF sampled harmonic frequencies, one of which has been depicted in line *f* of FIG. 16F. During amplitude sampling, the side bands in each frequency position are uniformly spaced, so that there can be realized envelope curve distributions, as such have been shown in line *d* of FIG. 16D. If the Fourier coefficients derived at the side of the transmitter are all of the same magnitude, then there appear symmetric to the individual harmonic frequencies all equal size continuous partial spectrums with envelope curves HK1, HK2, HK3 according to line *d* of FIG. 16D. If the Fourier coefficients Cl–C*n* have different values, then by modulation by means of the multipliers MC1, MC2–MC*n* (see FIG. 5), there are formed partial spectrums of different pitch according to the line *g* of FIG. 16G, whereby there exists a total frequency spectrum with the envelope curve HK which corresponds to a consonant, for instance *s*.

Apart from both of the most important cases concerning voiced or voiceless sounds, there also can be taken into account mixed voiced-voiceless sounds, for instance a voiced spoken *s*. The voiced/unvoiced information coefficient would then be characterized by a multi-place binary number instead of the single place binary number 0 or 1, which binary numbers during voice synthesis would be weighed in importance to the voiced and voiceless sound parts.

The synthesized speech in digital form arrives through the agency of the conductor or line 130 (see FIG. 3) at the expander 79, where by means of the deciphered regulation value 100 which is delivered via the line 124, the gate 115 and line 171, there occurs in the above described manner, the dynamic expansion of the speech or voice signal, in increments or sections from signal interval to signal interval. The expanded synthesized speech signal arrives via the digital-analog converter 132, the reversing switch **26*b* as the synthetically generated speech signal at the headset or loudspeaker 15.**

The mode of operation of the above-described installation will be described in summation hereinafter and with regard to FIGS. 17 and 18 once again. In the columns *a* – *p* there are plotted multiple frequency spectrums, wherein at the horizontal coordinate there is plotted the amplitude and at the vertical coordinate the frequencies. In individual columns, namely *d, e, f,* and *k, l, m,* there are plotted the amplitude values of binary numbers of parameter signals, for instance Fourier coefficients or cipher program- or ciphered binary numbers. Also for these columns there is plotted at the horizontal coordinate the amplitude, corresponding to the binary number value, on the other hand there is plotted at the vertical coordinate the order number of the coefficients or the ciphered binary numbers.

Figure 17:
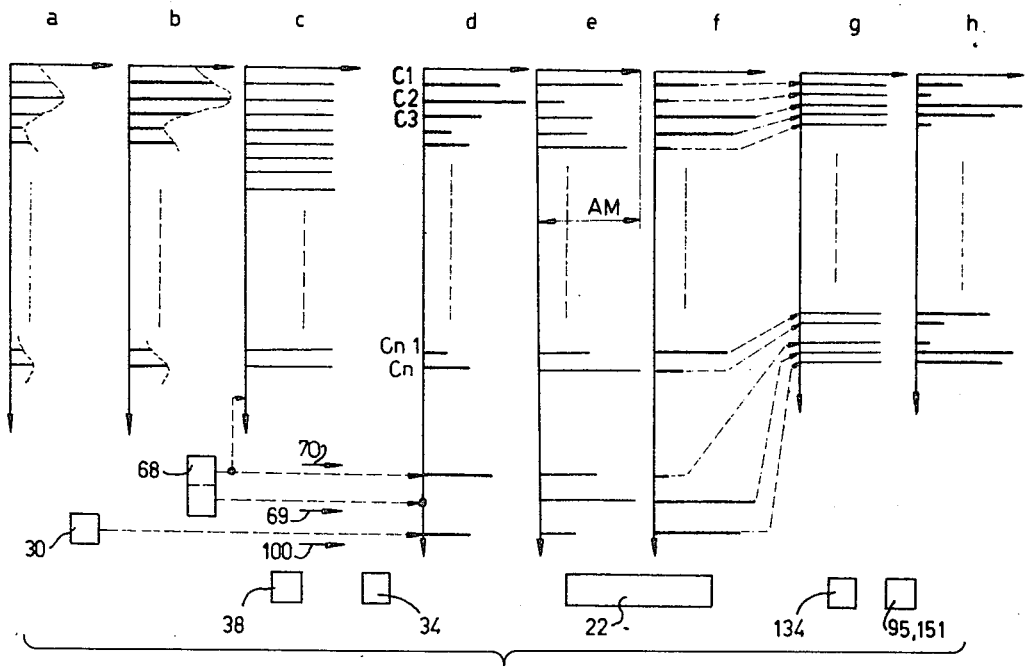
FIG. 17 is a graphic illustration of the formation of the transmission signal at the transmitter side or part of the installation.
Figure 18:
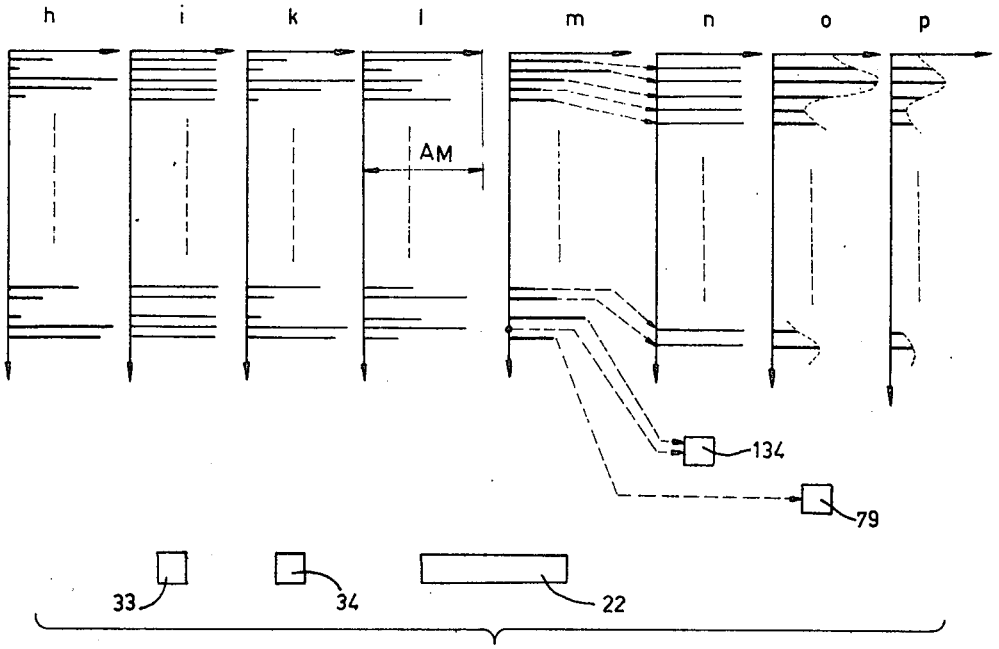
FIG. 18 graphically illustrates the reconstructing of the transmission signal arriving at the receiver side into the original speech or voice signal.

In FIG. 17 there is illustrated by way of example for a voiced sound with harmonic spectrum from the left towards the right, the analysis at the transmitter side, the enciphering and the generation of the transmission signal, and in FIG. 18 there is illustrated the analysis of the transmission signal, the deciphering and the speech or voice synthesis.

In column *a* there is plotted the voice spectrum of a voiced sound which has been introduced into a microphone 1 and in column *b* there is plotted the digital voice signal regulated by the compressor 30, wherein the here-illustrated regulation constitutes a "negative compression" (increase of the signal). With the aid of the regulated speech or voice signal there is determined at the voice character-fundamental sound pitch analyzer 68 the fundamental sound pitch coefficient 70 and in the case of a voiceless sound the voiced/unvoiced information coefficient 69. In column *c* there is plotted the frequency spectrum of the frequency storage 38, the fundamental frequency of which is adjusted by the derived fundamental sound pitch coefficient. In column *d* there are plotted the Fourier coefficients Cl–C*n* derived at the Fourier analyzer 34, as well as the fundamental sound pitch coefficient 70, the voiced/unvoiced information coefficient 69, which in this example has the value 0, and the regulation value 100. In column *e* there are plotted the pseudo-random members of the cipher or coding program which are generated at the cipher-decipher device 22, and which each have associated therewith a parameter signal of the column *d* which is at the same pitch. The maximum amplitude range has been designated by reference character AM and there thus occurs a modulo-AM-ciphering. In column *f* there are plotted the ciphered values, that is to say, the enciphered parameter signals as a modulo-AM-addition of two respective values of the columns *d* and *e* which are at the same pitch, wherein the vlues according to the column *f* are equal to the modulo-AM-sum of the values of the columns *d* and *e*. In the column *g* there is plotted the uniform frequency spectrum of the frequency storage 134 with a fundamental frequency of for instance 60 Hz. With the dotted arrow lines there is indicated the association of the ciphered parameter signals according to column *f* to the individual harmonic frequencies of the frequency storage, which are modulated by the relevant parameter signals for transmission. In column *h* there is plotted the frequency spectrum of the transmission signal 19 which was calculated with the aid of the multiplier device 95 and composed at the summation element 151.

The transmission signal is received by the apparatus at the receiver side and regulated to an average value which has not been here illustrated. All subsequent explanations relate to the receiving mode of operation and are concerned with FIG. 18. In column *i* the frequency spectrum of the frequency storage 38 is plotted, the fundamental frequency of which likewise amounts to 60 Hz, which frequency spectrum serves for the analysis of the transmission signal 19. At the column *k* there are plotted the ciphered parameter signals determined with the aid of the Fourier analyzer 34. In the column *l* there are plotted pseudo-random numbers of the cipher or code program of the ciphering and deciphering device 22, which are identical to the random numbers portrayed in column *e* of FIG. 17. In column *m* there are portrayed the deciphered parameter signals which are formed from the modulo-AM-subtraction, wherein the values of column *l* are subtracted from the values of column *k*. In column *n* there is plotted the uniform frequency spectrum of the frequency storage 134, the fundamental frequency of which is determined by the deciphered fundamental sound pitch coefficient. The association of the deciphered parameter signals of the column *m* to the individual frequencies of the column *n* is again marked or designated by the broken dotted arrows. In the column *o* there is plotted the frequency spectrum of the deciphered, synthesized digital voice signals which by expansion in the expander 79 produce the deciphered, digital voice or speech signals according to the column *p*. In the ideal case, the synthesized voice signal of the column *p* corresponds to the original voice signal according to the column *a*.

The operation described for instance for a voiced sound are analogously applicable also for voiceless sounds with the slight modifications discussed above.

The clock period $T_E$ by means of which there can be samplied the regulated, digital voice signal 32 to be analyzed can be different from the clock period $T_H$ of the frequency storage 38, wherein the binary numbers which are to be multiplied with one another, which correspond to both signals, appear at different positions and which positions alternate in time relative to one another. FIG. 19 shows a simple apparatus for carrying out the multiplication in this case.

The regulated, digital voice signal 32 is introduced into a shift register 172 having the shift clock period $T_E$ from the left towards the right into the last shift register stage 173. The infeed of the shift cycle to the last shift register stage 173 can be blocked by means of a gate 174 by impulses $T_H^=$. The shift register is designed for the shifting of the multi-place binary numbers which characterize the regulated speech or voice signal 32. The frequency storage 38 is operated at the clock period $T_H$ and delivers for each clock period of a binary number a harmonic frequency 47 to the multiplier Mn sin for multiplication with the binary number of the regulated, digital voice signal 32. The rythum with which it is possible to carry out the multiplication operation is determined by the lower one of both clock periods.

From the clock signal, corresponding to the clock period $T_H$, there is produced at a pulse shaper 175 the synchronized clock signal $T_H^=$, the binary value of which, during a longer time $T_U$ is always equal to the binary value 1, and during a shorter time $T_N$ to the binary value 0. During the time intervals $T_U$ the gate 174 is blocked and during this time a binary number of the regulated voice signal 32 stored in the last stage 173 of the shift register 172 remains available for the multiplication without having been changed.

If the time increment or interval $T_N$ is greater than the shift clock period $T_E$ then, shortly before each new pulse of the clock period $T_H$, the binary number stored in the second last stage 176 is introduced into the last stage 173 of the shift register 172 for carrying out the next multiplication. In line *a* (FIG. 20A) there is illustrated the course of a harmonic frequency 47 with the binary numbers which arise during the clock period $T_H$ and in line *b* (FIG. 20B) there is illustrated the course of the regulated, digital voice signal 32 with the binary numbers which arise during the clock period $T_E$. Those binary numbers of such signal which are used for multiplication are markedly attenuated.

It is advantageous if the speech or voice signal possesses a finer raster as a function of time than the signal 47 delivered by the frequency storage 38, i.e. if the sampling period $T_E$, by means of which there is sampled the voice signal, is much smaller than the sampling or scanning period $T_H$ by means of which there is sampled the corresponding information in the frequency storage 38, in order to fix with sufficient accuracy the point in time when the multiplication operation is carried out. In the event that during the analog-digital conversion of the voice signal there were selected too coarse a time grid, for instance $T_E = T_H$, then by linear interpolation or by means of a smoothing computation it is possible to calculate intermediate values of binary numbers and to shorten the clock period $T_E$. The time $T_U$ which should be available for multiplication should amount to, for instance, not less than 80% of the clock period $T_H$.

At the frequency storage 38 described with reference to FIG. 6 the binary numbers for each of the different harmonic frequencies are electronically retrievably stored over a fundamental period $T_G$ or at least over one-half of the fundamental period length, respectively. The expenditure for the storage is therefore rather considerable.

Hereinafter there will be described a frequency storage wherein there is to be stored only a single period of a sine curve or at a minimum one-quarter thereof. Apart from the saving in the storage positions of such frequency storage which is thus realized, this technique allows for a considerable simplification of the total installation. In order to facilitate the understanding the disclosure will be carried out in conjunction with a concrete numerical example. Of course, the invention is by no means limited to these assumed values which are given purely for illustrative purposes.

Figure 21:
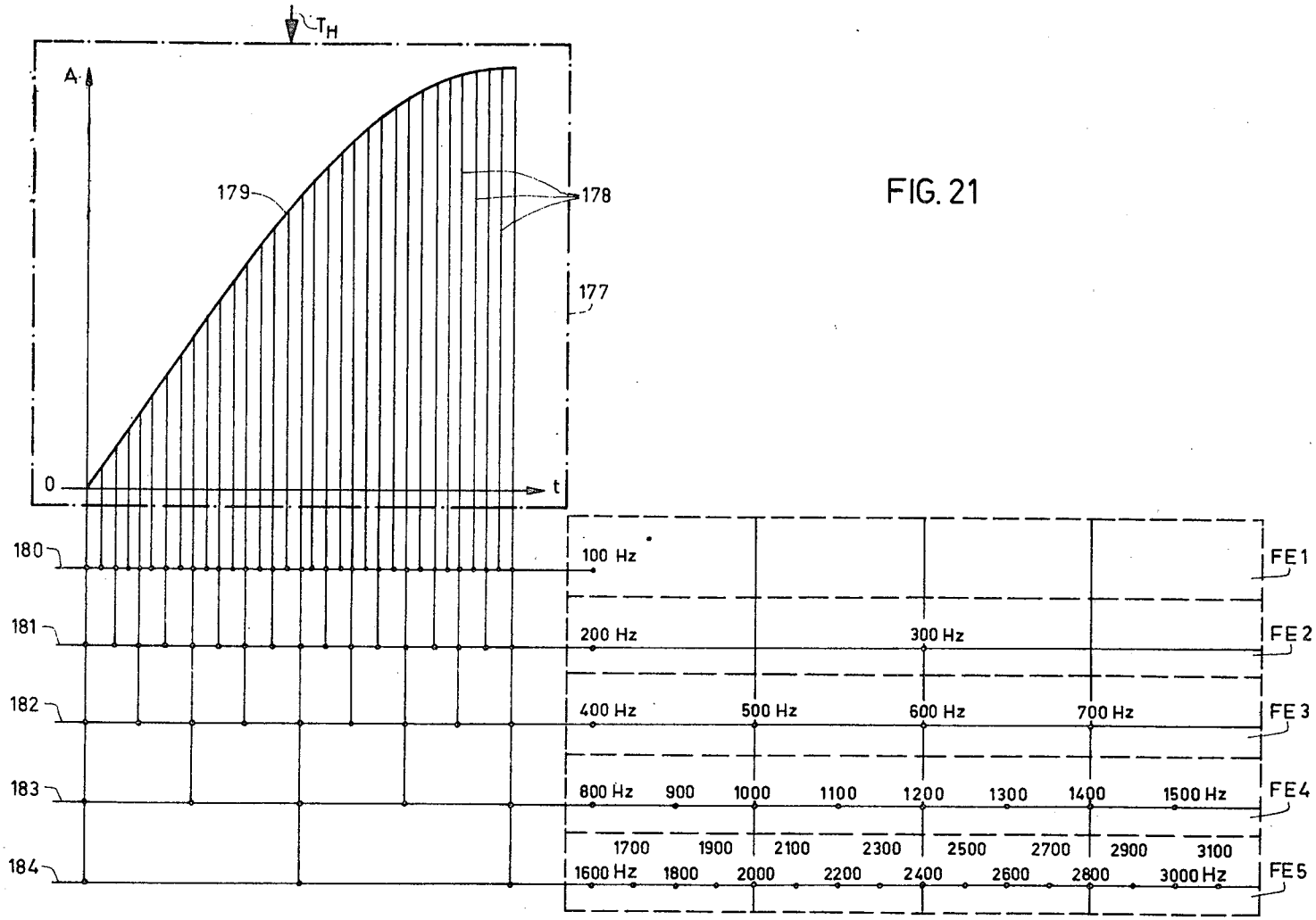
FIG. 21 graphically illustrates the mode of operation of a frequency storage or store at which there is stored the information for generating harmonic frequencies.

In FIG. 21 there is schematically illustrated at the left-hand portion thereof an electronic sine curve storage 177. The storage operation extends over one-quarter of a period, i.e. from $0-(\pi/2)$ . Of this quarter-period there are retrievably contained, for instance in a ROM-storage, 32 binary numbers as ordinate values 178 of the sine curve 179. Accordingly, the information of a full sine period encompasses 128 binary numbers. To protray a full sine period by means of this quarter-period storage the binary numbers 0–32 initially move in positive direction and thereafter from 32–0 in negative direction. The corresponding 64 binary numbers are associated with positive sign and then there occurs a second throughpass 0–32 and 32–O, wherein the read-out 64 binary numbers are associated with negative sign. These binary numbers are read out, as above described, by clock pulses with the clock period $T_H$. To generate the information of a frequency of 100 Hz with the period of 10 ms the clock period $T_H$ amounts to the value $T_H = 10$ ms/128 = 0.08 ms. The information for the frequency 100 Hz is obtained by operating the sine curve storage 177 with the clock period $T_H = 0.08$ ms, in that all binary numbers contained in the sine curve storage are delivered via a connection line 180 to a frequency field FE1 and evaluated. To a frequency field FE2 there is delivered, via a connection line 181, only each second binary number of the sine storage, which is sampled with the clock period $T_H$ =0.08 ms, for obtaining the information for the frequency 200 Hz. By not taking into consideration each uneven binary number and operating the sine storage with the same clock period the read-out frequency is increased from 100 Hz to 200 Hz. The full sine period is characterized by 64 binary numbers. With the aid of the same frequency field FE2 there can be obtained the information for the frequency 300 Hz, if the clock period, with which there is operated the sine storage 177, is reduced by the factor 1.5, the clock period $T_H$ is then equal to 0.054 ms.

To the frequency field FE3 there is delivered via a connection line 182 only each fourth binary number for generating the information concerning the frequencies 400 Hz, 500 Hz, 600 Hz and 700 Hz wherein the clock period $T_H$ is changed from 0.08–0.08/1.75 ms.

To a frequency field FE4 there is delivered only each eighth binary number via a connection line 183 for generating the information for the frequencies 800 Hz, 900 Hz, 1000 Hz, 1100 Hz, 1200 Hz, 1300 Hz, 1400 Hz, and 1500 Hz, wherein the clock period $T_H$ is changed from 0.08–0.08/1.875 ms.

There is delivered to a frequency field FE5 each sixteenth binary number via a connection line 184 for generating the information for the frequencies 1600 Hz, 1700 Hz, 1800 Hz . . . 3000 Hz and 3100 Hz, wherein the clock period $T_H$ is changed from 0.08–0.04 ms. For each complete sine period there are utilized in this case eight binary numbers. The higher the relevant frequency field is numbered that much smaller is the number of binary numbers which are available for each sine period.

With clock periods $T_H$ of 0.08–0.04 ms, the associated clock frequencies of which amount to 12,500–25,000 Hz and which are located within one octave, it is possible to generate the entire harmonic frequency spectrum of the fundamental frequency 100 Hz from 100 Hz, 200 Hz, 300 Hz . . . 3000 Hz and 3100 Hz.

In the frequency field FE5 there are only to be stored those sixteen binary numbers which are required for generating the frequencies 1600 Hz, 1700 Hz, 1800 Hz . . . 3000 Hz and 3100 Hz. These binary numbers of, for instance, eight to ten places or digits are adequate to generate the invididual 16 frequencies of the frequency octave 1600–3100 Hz, wherein the clock period $T_H$ for generating these frequencies must have the following values: 0.08 ms for 1600 Hz, 0.073 ms for 1700 Hz, 0.069 ms for 1800 Hz . . . 0.042 ms for 3000 Hz and 0.04 ms for 3100 Hz.

From these values there can be obtained in the described manner also the frequencies of the remaining frequency fields as sub-harmonic frequencies by cycle switching, each sixteenth cycle, each eighth cycle, each fourth cycle and each second cycle.

Both for the analysis as well as for the synthesis of the voice signal the fundamental frequency of the frequency generator at least must be adjustable in the range of one octave. The fundamental frequency thus should be variable from 100–200 Hz, for instance in stages of 0.04–0.08%. The frequency octave of the frequency field FE5 changes in the range

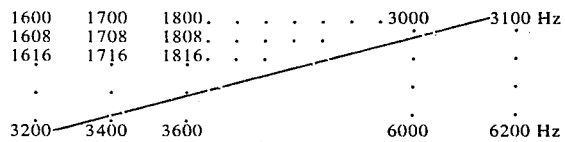

during transition of the fundamental frequency from 100 Hz to 200 Hz in toto over two frequency octaves. To this end it is necessary that the clock period $T_H$ for the operation of the sine curve storage 177 of the frequency storage is changed in the range of $T_H = 0.08$ ms − 0.02 ms, in other words in a ratio of 4:1.

In reality the variation range remains generally within the ratio 2:1, since the frequencies which are located below the broken diagonal line plotted in the above table are not necessary because they are located outside of the band of the voice channel.

Generating the clock pulses $T_H$ for operating the frequency storage 38 and its sine curve storage 177 occurs by means of the apparatus described with respect to FIG. 10, wherein for instance the ten place binary numbers at the input 185 of this apparatus are variable in a range of 1000000000 (decimal value 512) to
0010000000 (decimal value 128).

This means that the scale down region of the quartz oscillator clock period $T_Q$ varies from $T_Q/512$ to about $T_Q/128$. In so doing, there is generated with a clock period $T_H = T_Q/128$ the frequency 6400 Hz. In the illustrated example there is, however, required as the highest frequency only 6200 Hz. With eight scanning or sampling values per sine period the quartz frequency of the clock generator 24 becomes $f_T = 8.521.1600 = 6.5536$ MHz.

Now in conjunction with the showing of FIG. 22 there will be described a frequency storage from which there can be read-out, during a period of the increased fundamental frequency, at least a part of the frequencies in successive time rasters or grids one after the other. The analysis and the synthesis occur sequentially i.e. in series with increased clock frequency, whereby also the speech or voice signal 27 and the received transmission signal 163 are stored in sections and read out with increased clock frequency. One harmonic frequency after the other is delievered by the frequency storage during the duration of a signal internal. To this end the oscillator frequency $f_Q = 1/T_Q$ must be chosen to be correspondingly high, for instance 20 times higher, i.e. selected to be 20.65536 = 130 MHz. The clock period generated by the apparatus 82, with an oscillator frequency $f_Q = 130$ MHz amounts to $T_{H1} = 4\mu s$ and for $f_Q = 51.2$ MHz amounts to $T_{H2} = 1\mu s$. For the reasons explained with respect to the above-shown table there is selected as the smallest sampling period $T_{H2} = 2\mu s$. The fundamental or base period $T_G$, which encompasses 128 clock pulses, in the first case amounts to $128 . 4\mu s = 512\mu s$ and in the second case amounts to $128 . 1\mu s = 128\mu s$.

The Fourier analysis should be carried out during a fundamental period $T_G$, thus according to the example should be terminated within at most $512\mu s$. If the analysis is carried out for 32 harmonic frequencies, then there are required 32 . 0512 ms = 16 ms, i.e. the Fourier analysis can be readily carried out within a signal interval of 30 ms.

For the synthesis there are generated the 16 frequencies in the frequency field FE5 in succession and simultaneously thereto the eight frequencies in the frequency field FE4, then there are generated in succession the four frequencies in the frequency field FE3 and simultaneous therewith there are generated two frequencies in the frequency field FE2. Hence, in 16 + 4 = 20 through-passes there can be generated 30 frequencies and with a twenty-fold increased clock frequency there can be carried out with each respective single sine curve storage 177 both the analysis as well as also the synthesis. For the analysis there are required two multipliers, one for the sine frequency and one for the cosine frequency, and for the synthesis there are likewise required two multipliers for the two simultaneously to be generated frequencies in two frequency fields.

Figure 22:
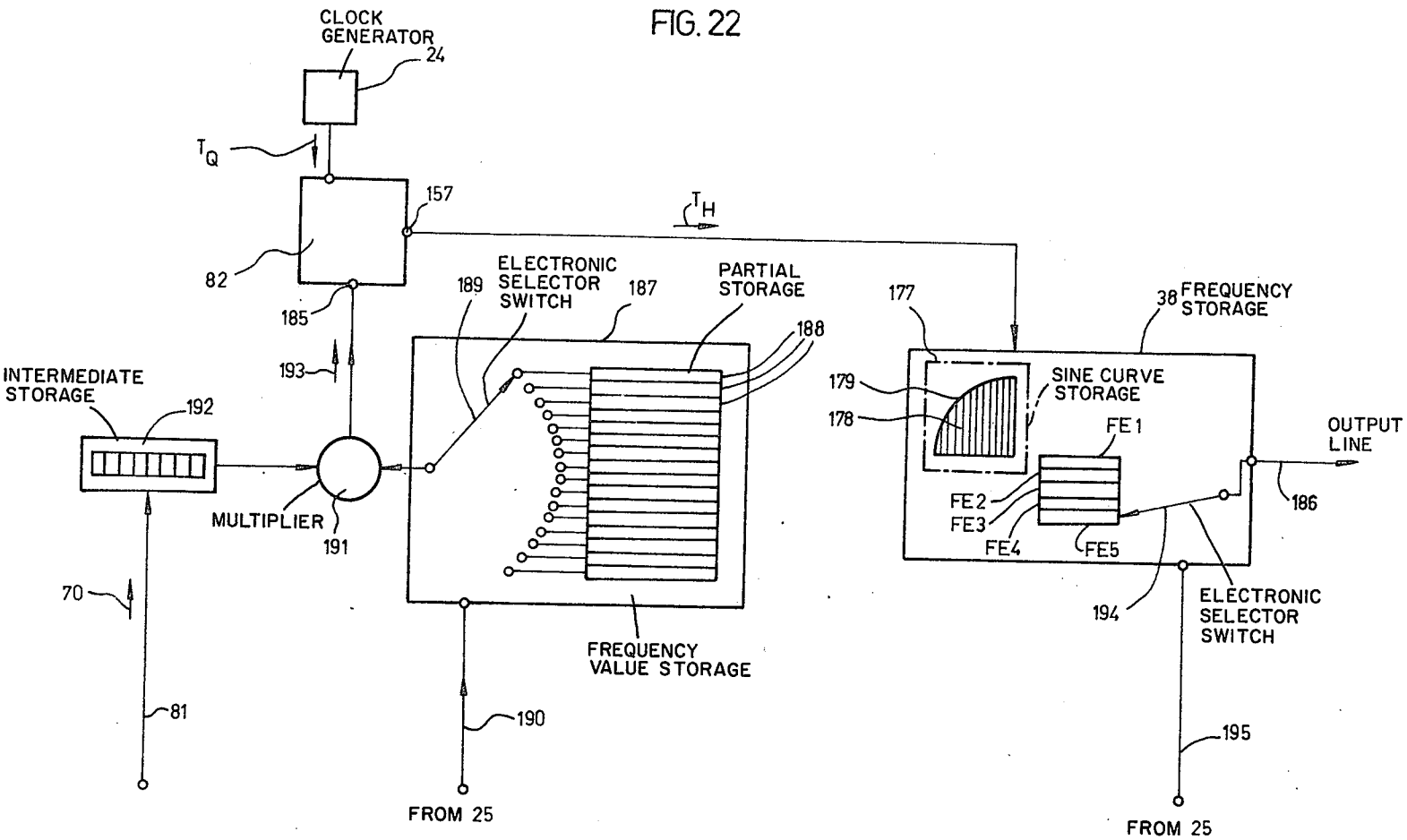
FIG. 22 is a schematic block diagram of an exemplary embodiment of a frequency storage for generating harmonic frequencies.

At the right side of FIG. 22 there is plotted an examplary embodiment of the frequency storage 38, via the single output line 186 of which there can be successively tapped off the individual harmonic frequencies. A circuit for generating the clock perior $T_H$ has been plotted at the left-hand side of FIG. 22. It encompasses a frequency value storage 187 with the 16 frequency values stored in the form of binary numbers in the partial storage 188. These frequency values can be selected by means of an electronic selector switch 189, which is coupled via a conductor 190 with the control device 25, and the selector frequency value is delivered to a multiplier 191. The fundamental sound pitch coefficient 70 is delivered in the form of the binary number which encompasses the range of one octave via an intermediate storage 192 to the multiplier 191 and multiplied with the frequency value. At most there is to be carried out one multiplication per clock period $T_H$, and therefore the multiplication rate is between 4 and $1\mu s$. The product 193 from the frequency value and fundamental sound pitch coefficient 70 is delivered as a preselection binary number to the input 185 of the apparatus 82 described with regard to FIG. 10. This apparatus is the only piece of equipment which must operate to the high frequency of $f_Q = 130$ MHz. All of the remaining components, which have been shown in FIG. 22, at most operate with the frequency which is derived from the clock period $T_H$. This frequency at most therefore amounts to 1 MHz.

With the clock period $T_H$ generated in this manner, there is operated the sine curve storage 177 of the frequency store or storage 38 and which has been described with regard to FIG. 21. With the aid of an electronic selector switch 194, which is coupled via a conductor 195 with the control device 25, it is possible to control the frequency fields FE1–FE5 which are to be read out. At the output line 186 there appears the information concerning the harmonic frequencies in the form of a sequence of binary numbers with a clock period $T_H$ of $1–4\mu s$.

In these intervals there is to be also carried out the multiplication required for the analysis and synthesis. If the time available for the multiplication is considered to be short, then the time grid instead of being twenty-fold, only should be undertaken to amount to ten- or five-fold, in which case there then would be required two or four respectively, circuits of the type shown in FIG. 22.

Figure 23:
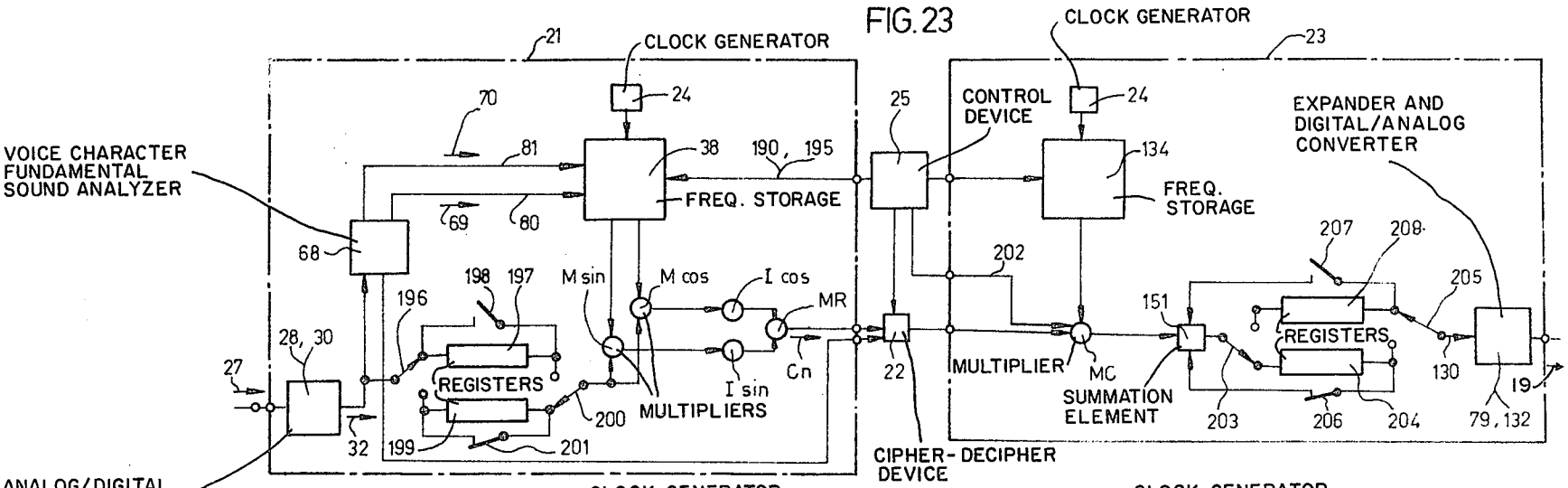
FIG. 23 is a schematic block diagram of an exemplary embodiment of installation which differs from that depicted in FIG. 2 for the transmitting mode.
Figure 24:
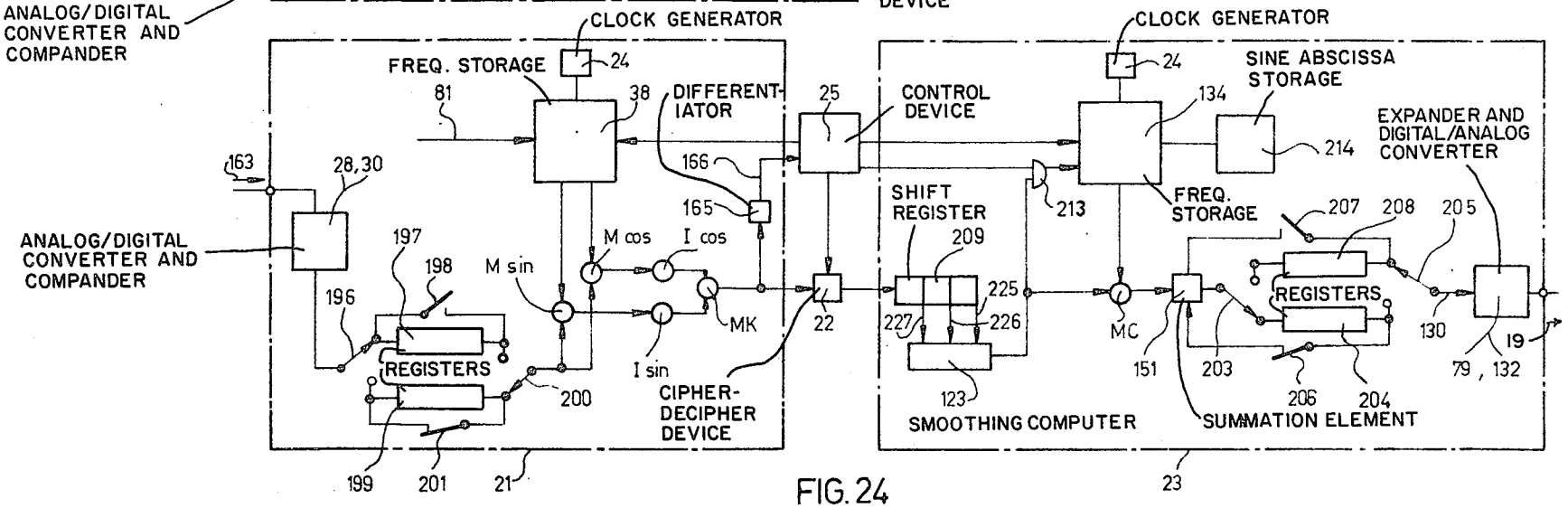
FIG. 24 is a schematic block diagram of the same exemplary embodiment as shown in FIG. 23 for the receiving mode.

In FIGS. 23 and 24 there is illustrated an installation, the harmonic frequencies of which are sequentially produced in a circuit according to the showing of FIG. 22, and specifically the installation according to the showing of FIG. 23 is used for the transmitting operating mode and the installation shown in FIG. 24 is shown for the receiving operating mode. The major difference of this installation, in contrast to the installation described above with respect to FIGS. 3, 4 and 5 is that, for the analysis, the ciphering and the synthesis, the information concerning the harmonic frequencies are processed successively in time and not simultaneously in the installation. Only at the transmission path are there simultaneously present all of the harmonic frequencies. The advantage of this installation is the considerably saving in circuit components, since such need only be provided once for carrying out the analysis, the ciphering and the synthesis operation for all frequencies.

According to the showing of FIGS. 17 and 18, the principal mode of operation is such that with each signal interval for instance initially the uppermost frequency and the uppermost coefficient are processed for all columns $a - p$, with the exception of column $h$, and thereafter from the top to the bottom there are processed the second, third, fourth frequencies and so forth of the signal intervals.

According to the showing of FIG. 23, in the transmitting mode of the installation, the speech or voice signals 27 arrive via the input circuit consisting of the analog-digital converter 28 and the compressor or compander 30 on the one hand at the voice character-fundamental sound analyzer 68 and, on the other hand, via a reversing switch 196 at a first register 197. The density of the binary numbers in this register is four to eight times greater than that of the associated harmonic frequencies. In this register 197 there can be stored the regulated voice signal 32 over a signal interval of for instance 30 ms. During the time that a new signal interval is stored in the register 197, with the switch 198 opened, the preceding signal interval is stored in a second register 199 for the duration of a complete signal interval for carrying out the analysis. By means of a reversing switch 200 the information of the preceding signal interval which has been stored at the register 199 arrives at the multipliers M sin and M cos of the Fourier analyzer 34, this information is read out with a clock frequency which has been increased for instance twenty-fold.

From the frequency storage 38 the information concerning one of the harmonic frequencies after the other, as described in conjunction with FIG. 22, serially or succesively likewise arrives at the multipliers, in which there occurs the multiplication with the regulated voice signals during a fundamental period which is shortened in accordance with the increased clock frequency. After each change of the frequency in the frequency storage 38, the same voice signal again arrives at the multipliers. For this purpose the register 199 is constructed as a shift register and the read-out information or intelligence is delivered through the agency of a closed switch 201 again to the input of this register. After each signal interval there is changed the position of the switches 196, 198, 200 and 201 and the function of both registers 197 and 199 are interchanged.

The control of the sequential or series output of the information concerning the individual frequencies of the frequency storage or generator 38 occurs in the manner described with regard to FIG. 22 via the conductors 190 and 195 by means of the control device 25. The determination of the fundamental period of the frequency storage or generator 38 occurs in the described manner by means of the voice character-fundamental sound pitch analyzer 68, to which there is delivered for voiced sounds, via the line 81, the fundamental sound pitch coefficient 70, and for voiceless sounds the voiced/unvoiced information coefficient 69 via the conductor 80.

After each signal section which has been time-compressed by the increased clock frequency there appears at the output of the average value computer 37 a Fourier coefficient $Cn$ which in each case is immediately coded or enciphered in the cipher-decipher device 22 and delivered as a ciphered signal component to the multiplier MC of the signal synthesizer device 23. Also the cipher or coding computer of the cipher-decipher device 22 operates completely sequentially and successively generates the sequence of the pseudo-random numbers, something which from the standpoint of the cryptology is quite advantageous. The regulation value, the voiced/unvoiced information coefficient and the fundamental sound pitch coefficient are likewise enciphered in succession as a function of time after ciphering all of the Fourier coefficients and thus arrive at the multiplier MC.

The frequency storage 134 delivers in succession as a function of time to the multiplier MC, in each instance for the duration of a time-compressed signal interval, information concerning one harmonic frequency after the other, wherein the control occurs by means of the control device 25. The fundamental frequency of the frequency storage 134 is constant during the transmitting mode of operation. The synchronization signals generated by the control device 25 are likewise delivered in succession as a function of time via a conductor or line 202 with the ciphered parameter signals and during each respective time-compressed signal interval to the multiplier MC.

The harmonic frequencies of the frequency storage 134 which are modulated by the ciphered parameter signals arrive one after the other in a time-compressed form via the summation element 151 and a reversing switch 203 at the register 204, which is preferably constructed as a shift register and can store a complete signal section. The register 204 possesses four to eight times as many storage positions or locations as there are retrieved the average number of sampling values of the individual frequencies in order that the binary numbers of the individual sampling or scanning values in the register can be set practically free of error as a function of time.

The switches 203, 205, 206 and 207 are alternately shifted into the illustrated position during one signal interval and during the next signal interval in the reverse position. In the illustrated position, for instance with a twenty-fold increased clock frequency, the entire storage content for the duration of a time-compressed signal interval is shifted about once in the circuit via the summation element 151 and the switches 206 and 203. In so doing all of the binary numbers of a signal interval and corresponding to the scanning or sampling values are added to one of the harmonic frequencies in the summation element and during the next pass through the circuit to that of the next frequency. At the end there are contained in the register 204 in an added condition all of the harmonic frequencies. there is available for the entire procedure the time of a non-time compressed signal interval for instance 30 ms. During this procedure the information concerning the preceding signal interval and located in storage or register 208 is read-out at a normal cycle via the switch 205 and the output line 130 and delivered to the expander 79 as well as the digital-analog converter 132. In the latter there is formed the transmission signal 19 and such as delivered to the voice or speech channel 10. Then the switch positions are changed and the function of both registers 203 and 208 are interchanged. This transmission signal 19 which appears at the transmission channel is composed of a multiplicity of harmonic frequencies and varies from signal interval to signal interval for instance every 30 ms, as such has been described above with regard to FIG. 3.

FIG. 24 illustrates the same embodiment of the installation as that of FIG. 23, however in the receiving operating mode. The functions, with few exceptions, are the same as those which occur during the transmitting operating mode and only these differences will be more fully explained hereinafter.

The frequency storage 38 operates in the receiving mode with a constant fundamental frequency. The synchronization signals which are derived as parameter signals in the Fourier analyzer 34 arrive through the agency of the differentiating device or differentiator 165 and the conductor 166 at the control device 25 where they carry out the functions discussed above. From the output of the cipher-decipher device 22 there are delivered into a shift register 209 the deciphered parameter signals with increased sampling speed, and which register is capable of storing all parameter signals of three successive signal intervals. This shift register 209 possesses three taps 225, 226 and 227 at which there can be tapped-off a respective successive amplitude value $A_{t1}$, $A_{t2}$ and $A_{t3}$ of the same signal component, according to line a of FIG. 14A, and transferred to the smoothing computer 123. The latter here likewise operates in sequence for all parameter signals, for instance according to the manner described above with respect to FIG. 14.

The deciphered voiced/unvoiced information coefficient and the fundamental sound pitch coefficient arrive via an AND-gate 213 at the frequency generator or storage 134 and determine its fundamental frequency. From the individual frequency intervals there is produced with the aid of the summation element 151 and the registers 204 and 208 the synthesized speech and finally delivered to the headset or loudspeaker 15. The synthesis occurs in the same manner as that of the tramsmission signal which has been described with regard to FIG. 23. However there are to be considered the following differences.

Although for the transmission signal 19 phase changes or shifts at the signal interval boundaries are permissible, such phase shifts disturb the generation of a synthesized voice. In order to avoid such disturbances there is provided a sine abscissa storage 214 which stores for each of the harmonic frequencies the abscissa value of the sine curve storage 177 (FIG. 21) which is present at the end of a signal interval. During the next following signal interval of the relevant frequency, there begins the time count for the exact determination of the interval length at such abscissa value, so that the sine curves become continuous and free of phase changes.

With regard to FIGS. 23 and 24, there was described above a completely series or sequentially operating exemplary embodiment of the inventive installation. This installation possesses a markedly reduced number of circuit components, however requires relatively high switching speeds for the individual circuits. The complete parallel or simultaneously operating exemplary embodiment according to FIG. 3 possesses a considerably larger expenditure in its circuit design, but operates with much lower switching speeds.

There can be provided further exemplary embodiments which operate partially sequentially and partially simultaneously. If the switching speed is further increased, then there can be provided, instead of the frequency storages 38 and 134, a single frequency storage which carries out the functions for the analysis and the synthesis in sequence.

The determination of the fundamental sound pitch and its coefficients, instead of using the autocorrelation techniques described with respect to FIG. 9, also can be carried out according to the hereinafter described technique with the aid of the frequency storage.

Prior to the analysis there is formed from, for instance, the five lowest harmonic frequencies of the frequency generator with increased clock frequency the summation of the five Fourier coefficients C1, C2, C3, C4 and C5 of the voice signal section over a period $T_{G1}$ and this first coefficient summation value C1+C2+C3+C4+C5 is stored at the parameter signal computer 67. The period $T_{G1}$ corresponds to the lowest possible fundamental frequency of the voice. Then for a period $T_{G2}$ which is reduced for instance by 2% there is formed a second coefficient summation value and stored and then for $T_{G1}$ - 4% there is formed the coefficient summation value and so forth, until for instance there are derived a total of 25 coefficient summation values for $T_{G1}$, $T_{G1}$-2%, $T_{G1}$-4%, $T_{G1}$-8% . . . to $T_{G1}$-50% = $T_{G1}/2$ and such stored. The sampling range again extends over an octave from $T_{G1}$ - $T_{G1}/2$. The period $T_G$ corresponding to the maximum coefficient summation value corresponds to the stored fundamental frequency or to a whole multiple thereof. With this technique there is advantageously only required as the sampling length a single fundamental period of the speech or voice signal. A further advantage of this technique resides in the fact that it can be carried out with means which are available anyway at the analysis device or analyzer.

With the aid of the frequency generator and the Fourier analyzer, it is possible to also, as a further variant of the invention, derive the voiced/voiceless information coefficient. By forming the quotient of the coefficient summation value, for instance the five lowermost harmonic frequencies, divided by the coefficient summation value of the five uppermost harmonic frequencies, there can be determined for results greater than one and for results less than one between voiced and voiceless conditions respectively.

Owing to the relatively large signal interval length of 30 ms and owing to the selected transmission form the system of this development possesses, particularly with regard to the transmission security and the non-sensitivity against disturbances. Great advantages such as synchronization free of problems, no phase sensitivity, practically no transit time sensitivity, only a very slight sensitivity to brief disturbance pulses owing to the integration over a time of 30 ms and good adaptability for radio relay or telecommunicatons, even if such is associated with disturbances.

Apart from these advantages for the transmission, the above-described system or installation possesses the following additional advantages: no falsification of the speech, as such occur during the analysis and the synthesis when using band filters due to the building-up or transient operations. It is not necessary to recalculate the coefficient between the analysis and the synthesis, as such is necessary when using band filters. Certain devices and apparatuses for the analysis and the synthesis can be used for multiple purposes. The equipment of the installation at the transmitter end and the receiver end are identical. The devices and apparatuses can be fabricated in LSI-technology and certain components can be used both for analysis and synthesis.

A serious transmission problem occurs if a carrier line possessing carrier drift is part of the transmission channel. However, also this problem can be solved in a relatively simple manner as will be hereinafter explained. In line *a* of FIG. 25A there is plotted the harmonic frequency spectrum of a transmission signal with a fundamental frequency of 100 Hz. The individual harmonic frequencies are designated by markedly extended arrows. The lowest transmitted frequency amounts to 300 Hz. In the case depicted in FIG. 25, the assumed carrier drift at the transmission path amounts to 10 Hz, constituting a very large value which in practice hardly ever arises. Normally the carrier drift amounts to at most 2 Hz, and in an exceptional case to 5 Hz. At the receiver end all of the frequencies are upwardly shifted by 10 Hz due to the carrier drift. The received frequencies thus amount to 310 Hz, 410 Hz, 510 Hz, 610 Hz, and so forth and therefore no longer constitute any exact harmonic spectrum. Such shifted received frequencies have been designated by the broken arrows. If there is carried out at the receiver end the Fourier analysis with the shifted frequencies, then there would thus result greater errors of the parameter signals, as the same can easily be recognized from FIG. 7 and the associated description.

The function of the carrier drift compensation will be explained for the exemplary embodiment depicted in FIGS. 23 and 24. For determining the magnitude of the carrier drift at the receiver part or side, there is used the analyzer 21 which has been shown in FIG. 24. For instance, the lowermost frequency of 300 Hz capable of being transmitted in the transmission channel is used as the test frequency, see also line *a* of FIG. 25A, for the carrier drift-determination and transmitted in each signal interval with the complete amplitude. At the receiver side there is carried out the Fourier analysis over exactly one period of the fundamental frequency by means of a detection frequency of, for instance, 200 Hz which is spaced form the test frequency by the fundamental frequency. If no carrier drift is present, then the correlation value KW exactly equals null over a fundamental period $T_G$, as such can easily be recognized from FIG. 7. If carrier drift is present, then there appears at the receiver side an error signal FS, which corresponds to a correlation value deviating from null, and which was formed due to the fundamental period $T_G$ which has been changed owing to the carrier drift and has been portrayed in line *b* of FIG. 25B. Along the abscissa there is plotted the time *t*, wherein the distance or path from 200 Hz – 300 Hz corresponds to the fundamental period $T_G$ and the distance or path 200 Hz – 310 Hz which has been changed by the carrier drift corresponds to the period $T_{G''}$. In a number of iterative steps for different magnitudes of the correlation time over the period $T_G$ there is determined that period $T_{GD}$ at which the error signal FS equals null. From the relationship $1/T_{GD} - 1/T_G$ there can be derived the carrier drift. The drift frequency also can be determined of course by filtering by means of band filters.

With the aid of this determined value the carrier drift compensation is individually carried out according to the following method for each of the different harmonic frequencies. The installation according to FIG. 24 permits of an individual treatment, since the individual frequencies are serially or sequentially processed. For this purpose there is introduced via the conductor 81 the fundamental frequency into the frequency storage 38 and which has been corrected for each harmonic frequency. If the frequency for the tenth harmonic is for instance 1000 Hz, and if the carrier drift has been ascertained to amount to 10 Hz, then the received frequency in reality amounts to 1010 Hz, and such will be determined as the tenth harmonic frequency. Consequently, there is delivered as the corrected fundamental frequency 1010/10 = 101 Hz instead of 100 Hz via the conductor 81 to the frequency storage 38. The neighboring harmonic frequencies owing to the corrected fundamental frequency are thus, according to line *c* of FIG. 25C, 808 Hz, 909 Hz (1010 Hz), 1111 Hz and 1212 Hz and deviate only so slightly from the received frequencies 810 Hz, 910 Hz, (1010 Hz), 1110 Hz, 1210 Hz, that the prevailing errors are negligible.

The further removed frequencies deviate much more in proportion to their spacing, however also their correlation value becomes smaller in inverse proportion to the spacing.

According to line *d* of FIG. 25D, for the fifth harmonic frequency 500 Hz, with the carrier drift of 10 Hz, the received fifth harmonic frequency amounts to 510 Hz and the corrected fundamental frequency is determined as 510/5 = 102 Hz. The neighboring frequencies therefore amount to 306 Hz, 408 Hz, (510 Hz), 612 Hz and 714 Hz.

Actually, there are also possible methods for carrier drift compensation in which the carrier drift is exactly compensated. Furthermore, the determination of the carrier drift can be carried out with the aid of special test signal intervals which are transmitted for instance during transmission direction changes or during pauses in the speech, and during which only one or two frequencies are transmitted. Hereinafter there will be further explained additional exemplary embodiments.

During the determination of the fundamental sound pitch such can vary during the determination duration and can be associated with a gradient, for instance −6%, −3%, 0%, +3%, +6%. That gradient which produces the highest correlation value, will be determined as the correct one and transmitted as the ciphered or coded parameter signal.

During the sequential processing of the frequency, it is easy to take into account their different transit times at the transmission channel and to thus further reduce the sensitivity of the installation to frequency-dependent transit times. In analgous manner, during the sequential processing of the frequencies in the installation according to FIGS. 23 and 24, it is also possible to easily eliminate frequency-dependent damping of the transmission channel.

The speech or voice signal and the transmission signal need not possess the same bandwidth. The voice signal can lie, for instance, in a range of 80 – 4,000 Hz and the transmission signal can be in a range of 300–3,400 Hz.

For voiced sounds there can be taken into account, for instance, only a low frequency band of 80 to 2000 Hz and for voiceless sounds only a high frequency band of 1200 – 4000 Hz, i.e. when for instance the sound has been determined to be a voiced sound then there is only taken into account the frequency band of 80 – 2000 Hz.

A further exemplary embodiment of frequency storage will be described hereinafter. A sine curve storage with, for instance, 1000 sampling or scanning values per period is operated at a high clock frequency $f_{TE}$ of, for instance 20 MHz, with the result that there can be generated a sine frequency of $f_1 = 20$ kHz with the aid of 1000 sampling values per period. The clock frequency $f_{TH}$ of, for instance, 19.7 kHz is logically coupled in a circuit similar to that of FIG. 19 by means of the gate 174 and the last shift register stage 173 with the period $T_E$ of the sine curve clock frequency, whereby similar to the stroboscope effect there appears at the output of the last stage 173 a frequency of 300 Hz as the differential frequency of 20−19.7 kHz. This frequency of 300 Hz is sampled with a sampling frequency of 19.7 kHz and accordingly possesses 19,700/300 = 60 sampling values per period.

If for sampling there is used a clock frequency of $f_{TH}$ of 17 kHz, then the generated frequency is 3000 Hz and possesses 17,000/3,000 = 5.66 scanning values per period. For each of the harmonic frequencies which are to be generated there is to be selected a special clock frequency $f$, and in this manner it is possible to derive from a single sine curve storage all harmonic frequencies. The fundamental sound pitch coefficient brings about a variation of the clock frequency $f_{TH}$ for generating the harmonic frequencies. In this case from the circuit depicted in FIG. 19 it is only necessary to employ the pulse shaper 175, the gate 174 and the shift register stage 173. In the event that a number of harmonic frequencies are to be simultaneously generated, then there are to be used a number of sets or groups of such circuit components. The clock periods $T_H$ are to be stored for each frequency to be generated in one storage. Also with such type frequency storage the circuit expenditure is considerably less than that of the frequency storage which operates according to the illustration of FIG. 6.

The above-described installation permits the transmission at the same time only in one direction and the directional change occurs by switching or reversing (simplex operation). Of course, if there are simultaneously used two such installations, there also can be achieved duplex operation where it is possible to carry out the simultaneous transmission in both directions.

Reductions in redundance, apart from the described grouping together of a number of Fourier coefficients, also can be realized, among other things, in that the coefficients of successive signal sections, which do not change, are not transmitted. Generally, however, it is possible to dispense with redundance reductions.

The speech signal interval boundaries for the speech or voice analysis also can be variable and correspond to the natural interval boundaries of the spoken voice sounds. The natural voice signal intervals, that is, the phonemes possess lengths of 15 ms for explosive sounds up to 300 ms for expanded vowels. The average length is in the order of about 70 ms. The time points of such natural interval boundaries, which can be detected by monitoring the simultaneous pronounced changes of a number of parameter signals, are transmitted in ciphered form as parameter signals and again used for the receiver side-speech synthesis, so that the natural signal intervals are also present in the synthetic speech or voice.

The signal intervals of the transmission or transmitted signal, on the other hand, possess constant length and specifically somewhat less than the average length of the natural speech signal intervals, thus for instance 60 ms. The use of the variable natural speech interval boundaries has the advantage that the synthetic speech or voice sounds quite natural, although the transmission information flow, for instance is only half as large (60 ms-intervals) than with the transmission with fixed speech interval boundaries (30 ms-intervals).

In FIG. 26 there is illustrated the technique with variable voice or speech signal intervals on the basis of a simplified example. The line *a* of FIG. 26A portrays the time course of the German spoken word SPRACHE. The time axis is subdivided, wherein the spacing between two partial lines or divisions corresponds to a time of 10 ms. The voice signal intervals can be a whole multiple of such division, in other words whole multiples of 10 ms. For speaking the letter S there are required 60 ms, for the letter P 10 ms, for the letter R 50 ms, and so forth. The division or increments of the time axis are continuously numbered and specifically with the numbers 0–31 which are written in the form of binary numbers, in binary code 00000–11111. After 31 the numbering begins anew. The time points of the natural boundaries of the voice signal intervals, which are fixed by determining the large changes of the parameter signals, are located in the raster or grid of the time division and are designated in line *a* of FIG. 26A with the numbers Z1, Z2, Z3, Z4, Z5 and Z6.

The transmission takes place with constant signal interval lengths of, for instance, 60 ms, during which, on the one hand, per signal interval the parameter signals of a speech signal interval are transmitted in ciphered form, for instance $S_c$, $P_c$, $R_c$, and, on the other hand, the numbers Z1*c*, Z2*c*, Z3*c*, and so forth, of the time divisions are likewise transmitted in ciphered form. To this end there is required one of the harmonic frequencies.

At the receiver side, both information or intelligence is deciphered and according to line *c* of FIG. 26C there is formed the original speech with the natural interval boundaries. The time displacement between the signals illustrated in line *a*, line *b*, and line *c* of FIGS. 26A, 26B and 26C, respectively, of course cannot be randomly large and should not exceed 300 ms. For this reason the numbering of the time divisions is only carried out from null to 31.

For determining and compensating the frequency-dependent damping as well as the frequency-dependent transit time in the transmission channel there can be used the hereinafter described techniques. In each case after a change in direction and or a pause in speech during at least one, preferably during one or a number of test signal intervals, while transmitting all frequencies of the frequency storage the synthesizer device transmits with the same amplitude. This transmission during pauses in the speech can be automatically controlled by the regulation value. At the receiver part or side there is determined for each frequency a check or test Fourier coefficient by analysis over a fundamental period and stored. (Without the effect of the transmission damping each check Fourier coefficient would have the same value). During the following speech processing, each ciphered parameter signal determined at the side of the receiver, prior to its deciphering, is divided by the check or test Fourier coefficients of the same frequency, with the result that there is eliminated the frequency-dependent transmission damping. This division again can be carried out with the aid of the dual logarithm table and specifically for all frequencies with the same apparatus in sequence. The storage of all test Fourier coefficients can take place in a single shift register. This simple measure enables carrying out a faultless modulo-amplitude range-deciphering even in the presence of a frequency-dependent damping. At the side of the receiver there can be determined, by storing the derived interval boundaries of the individual frequencies of the test signal intervals, the transit time frequency response of the transmission channel and used for frequency-dependent transit time-compensation.

For the Fourier analysis there also can be employed the technique of the so-called rapid Fourier-transformation (FFT).

While there is shown and described present preferred embodiments of the invention, it is to be distinctly understood that the invention is not limited thereto, but may be otherwise variously embodied and practiced within the scope of the following claims.

Accordingly, what is claimed is:

1. A method of transmitting and receiving electrical speech signals transmitted in ciphered form from a transmitter to a receiver, I. wherein at the transmitter end there are carried out the steps of:

a. forming from the speech signal at intervals to be transmitted parameter signals containing frequency spectrum-, voiced/voiceless information- and fundamental sound pitch coefficients;

b. ciphering said parameter signals;

c. forming a mixture of harmonic frequencies of a fundamental frequency with a fundamental period which is constant at least for each signal interval;

d. determining by means of the ciphered parameter signals the amplitudes of said individual harmonic frequencies in each signal interval;

e. transforming the ciphered parameter signals into a transmission signal;

f. transmitting the transmission signal from the transmitter to the receiver; and II. wherein at the receiver end there are carried out the steps of:

a. recovering at intervals the ciphered parameter signals from the received transmission signal by frequency analysis over at least one full period of the fundamental frequency of this signal;

b. deciphering the recovered ciphered parameter signals; and c. producing by synthesis from the thus recovered deciphered parameter signals a speech signal similar to the original speech signal.

2. The method as defined in claim 1, wherein during step (a) carried out at the transmitter end checking each signal interval to determine whether it constitutes a voiced sound or a voiceless sound, carrying out the analysis of the voiceless signal intervals with the harmonic frequencies of a predetermined constant fundamental frequency, determining for each voiced signal interval the fundamental sound of the speech signal to be transmitted, and which fundamental sound is characterized by the fundamental sound pitch coefficients, and adjusting the fundamental frequency of the harmonic frequencies with which the analysis is carried out at least approximately to the value of the determined fundamental sound or a sub-harmonic thereof.

3. The method as defined in claim 1, including the step of maintaining at a constant value the fundamental frequency for the synthesis of the transmission signal at the transmitter end and for the analysis of the transmission signal at the receiver end.

4. The method as defined in claim 1, including the step of controlling the fundamental frequency by the fundamental sound pitch coefficients during the receiver end synthesis of a speech signal similar to the original speech signal for voiced sound-signal sections.

5. The method as defined in claim 1, including the step of modulating the fundamental frequency and the harmonic frequencies by a random signal during the receiver end synthesis of a speech signal similar to the original speech signal for voiceless speech-signal intervals.

6. The method as defined in claim 5, wherein the modulation step constitutes frequency modulation.

7. The method is defined in claim 5, wherein the modulation step constitutes amplitude modulation.

8. The method as defined in claim 5, wherein the modulation step selectively comprises at least any one of frequency modulation, amplitude modulation, or both.

9. The method as defined in claim 1, including the step of modulating the fundamental frequency and the harmonic frequencies by a pseudo-random signal during the receiver end synthesis of a speech signal similar to the original speech signal for voiceless speech-signal intervals.

10. The method as defined in claim 9, wherein the modulation step comprises frequency modulation.

11. The method as defined in claim 9, wherein the modulation step comprises amplitude modulation.

12. The method as defined in claim 9, wherein the modulation step selectively comprises at least any one of frequency modulation, amplitude modulation, or both.

13. The method as defined in claim 1, wherein the steps (a) to (f) at the transmitter end and the steps (a) to (c) at the receiver end for each signal interval for the individual harmonic frequencies are carried out in sequence.

14. The method as defined in claim 1, wherein the steps (a) to (f) at the transmitter end and the steps (a) to (c) at the receiver end for each signal interval for the parameter signals are carried out in sequence.

15. The method as defined in claim 1, further including the steps of transmitting the transmission signal over a transmission channel from the transmitter to the receiver, transmitting a number of harmonic frequencies distributed over the frequency bandwidth of the transmission channel with the same constant amplitude during at least one signal interval duration during a change in the transmission direction, obtaining at the receiver end by analysis test coefficients dependent upon the amplitudes of the frequencies, storing such test coefficients, and during each signal interval dividing the determined ciphered parameter signals by its associated test coefficient for the compensation of the frequency response of the transmission channel.

16. The method as defined in claim 1, further including the steps of transmitting the transmission signal over a transmission channel from the transmitter to the receiver, transmitting a number of harmonic frequencies distributed over the frequency bandwidth of the transmission channel with the same constant amplitude during at least one signal interval duration during pauses in speech, obtaining at the receiver end by analysis test coefficients which are dependent upon the amplitudes of the frequencies, storing such test coefficients, and during each signal interval dividing the determined ciphered parameter signals by its associated test coefficient for the compensation of the frequency response of the transmission channel.

17. The method as defined in claim 1, wherein jumps of the parameter signals between each two respective neighboring signal intervals are smoothed prior to the synthesis of the speech signal.

18. The method as defined in claim 1, wherein jumps of the parameter signals between each two respective neighboring signal intervals are smoothed prior to the synthesis of the transmission signal.

19. The method as defined in claim 1, including the step of determining at the transmitter end the natural phoneme boundaries of the spoken voice and the length of the speech signal intervals at these boundaries, selecting all signal intervals of the same length during synthesis of the transmission signal, transmitting the determined lengths of the original signal intervals in the form of further parameter signals, and again respectively elongating or shortening the signal intervals to their original length with the aid of the received further parameter signals during the synthesis of the speech signal at the receiver end.

20. The method as defined in claim 1, including the step of digitalizing the speech signal at the transmitter end and carrying out in digital fashion all further processing steps including the synthesis of the transmission signal, wherein the latter is analogized for transmission, and at the receiver end the incoming analog transmission signal is likewise digitalized and all further processing steps including the synthesis of the speech signal which is similar to the original speech signal is carried out in a digital manner and the last mentioned digital signal is placed in analog form.

21. An installation for transmitting and receiving electrical speech signals which are transmitted in a ciphered form, comprising a signal analysis device for the transmitter end determination of parameter signals by frequency analysis of a speech signal to be transmitted, a cipher-decipher device for selectively ciphering and deciphering the parameter signals, a first device for the transmitter end conversion of the ciphered parameter signals into a transmission signal, a second device for the receiver end reobtaining of the ciphered parameter signals from the received transmission signal, a synthesis device for the receiver end formation of a speech signal similar to the original speech signal from the reobtained parameter signals, the improvement of: the first device comprising a signal synthesis device containing a frequency storage for the generation of individual modulatable harmonic frequencies with a fundamental frequency, and the second device comprises a signal analysis device containing a frequency storage for generating individually deliverable harmonic frequencies with a fundamental frequency, and wherein the individual frequencies are each capable of being delivered in a phase position designated as sine harmonic and a phase position shifted by 90° designated by cosine harmonic.

22. The installation as defined in claim 21, further including switching means for switching the installation from its transmitting mode into its receiving mode and vice versa, the signal synthesis device when operating in the transmitting mode serving to generate a transmission signal consisting of harmonic frequencies and when operating in the receiving mode serving to form a speech signal similar to the original speech signal from reobtained deciphered parameter signals, the signal analysis device when operating in the receiving mode serving to reobtain the deciphered parameter signals from the received transmission signal and when operating in the transmitting mode serving to form the parameter signals from the speech signal to be transmitted.

23. The installation as defined in claim 21, wherein the signal analysis device has an input and the signal synthesis device an output, an analog-digital converter in circuit with said input of the signal analysis device and a digital-analog converter in circuit with the output of the signal synthesis device, the signal analysis device and the signal synthesis device being constructed such that digital binary coded signals can be processed, a clock generator and a control device for controlling the analysis and synthesis as well as the ciper-decipher device.

24. The installation as defined in claim 23, wherein said clock generator generates clock pulses, said frequency storage of the signal analysis device including for each of the harmonic frequencies a respective partial store for the storage of the course of the curve of the frequency in the form of a sequence of binary numbers and which curve course extends over at least one-half of a period of the fundamental frequency, and wherein all of said partial stores respond to the clock pulses of the clock generator and deliver during each clock pulse information concerning the harmonic frequency stored therein in the form of a binary number at their output.

25. The installation as defined in claim 23, wherein the analog-digital converter has an output, the signal analysis device comprising a Fourier analyzer for generating frequency coefficients characterizing the frequency spectrum coefficients, said Fourier analyzer being electrically coupled with said output of the analog-digital converter and with the frequency storage of the signal analysis device, said Fourier analyzer possessing a multiplier device with at least a first multiplier and a second multiplier, a Fourier integration device with at least a first integrator and a second integrator for integrating sine- and cosine Fourier products and forming sine Fourier coefficients and cosine Fourier coefficients, and an average value computer with at least one average value computer element for forming an average value from said Fourier coefficients.

26. The installation as defined in claim 25, wherein the signal synthesis device possesses a multiplier device, wherein said last-mentioned multiplier device and the multiplier device of the Fourier analyzer as well as the average value computer each have a respective electronic dual logarithm table storage in which there are stored the function values $y$ and the argument $x$ for $y = \log x$ in the form of binary numbers.

27. The installation as defined in claim 21, wherein the signal synthesis device comprises a synthesis mechanism with a multiplier device and a summation element, the summation element containing at least one binary adder, and at least part of the summation operation is carried out sequentially during a signal section.

28. The installation as defined in claim 21, wherein the cipher-decipher device embodies at least one modulo-amplitude range-adder device and modulo-amplitude range-subtracting device, both of said adding and subtracting devices primarily sequentially ciphering and deciphering the parameter signals of a signal interval with individual binary numbers of a ciphering program derived from a cipher computer.

29. The installation as defined in claim 21, wherein the signal synthesis device comprises a smoothing computer connected in circuit with the cipher-decipher device for smoothing the transitions of the parameter signals from one signal interval to the next.

30. The installation as defined in claim 21, wherein the signal analysis device includes a voice character and fundamental sound analyzer for generating a fundamental sound pitch coefficient and a voiced/voiceless information coefficient per signal interval, said voice character and fundamental sound analyzer possessing a delay line serving as a storage for the storage of a digital speech signal over at least one period of the lowest fundamental sound of the speech signal, said delay line possessing a stationary tap, a displaceable tap and an autocorrelator for determining autocorrelation values, a storage for the storage of the autocorrelation values and a gate circuit, said storage and said gate circuit in the presence of a maximum autocorrelation value generating the fundamental sound pitch coefficients and the voiced/ voiceless information coefficients associated with a voiced speech signal and upon the presence of a number of equal magnitude autocorrelation values generating the voiced/voiceless information coefficients associated with a voiceless speech signal.

31. The installation as defined in claim 30, further including a clock generator, the frequency storage of the signal analysis device possessing an apparatus for changing the clock period by means of which there can be sampled the information contained in such frequency storage as a function of the fundamental sound pitch coefficients, so that the analysis occurs with a fundamental frequency which coincides with the fundamental sound of the speech signal or a sub-harmonic thereof.

32. The installation as defined in claim 31, wherein said apparatus for changing the clock period has an output and embodies a first binary counter connected with the clock generator, a second binary counter which can be set by the fundamental sound pitch coefficients and a comparator connected with both of said counters, wherein at said output of the apparatus there appears a clock pulse when the first binary counter there is introduced a number of pulses at which number the second counter is set by the fundamental pitch coefficients.

33. The installation as defined in claim 21, wherein the signal analysis device comprises a parameter signal computer for grouping together at least two respective parameter signals into a parameter signal constituting an average value.

34. The installation as defined in claim 21, wherein the signal analysis device and the signal synthesis device each possesses a respective frequency storage at which there is stored at least one-quarter of a sine or cosine curve in the form of digital values, which values can be retrieved by clock pulses delivered to the frequency storage, and wherein the frequency generated during retrieval is proportional to the clock pulse frequency.

35. The installation as defined in claim 21, wherein the frequency storage of the signal analysis device and the signal synthesis device possess a respective single output at which there can be delivered in sequence the individual harmonic frequencies for the length of a signal interval.

* * * * *